US007862969B2

(12) United States Patent
Suzuki et al.

(10) Patent No.: US 7,862,969 B2
(45) Date of Patent: Jan. 4, 2011

(54) IMAGE BEARING MEMBER AND IMAGE FORMING METHOD USING THEREOF, AND IMAGE FORMING APPARATUS AND PROCESS CARTRIDGE

(75) Inventors: Yasuo Suzuki, Fuji (JP); Kohichi Ohshima, Mishima (JP); Tetsuro Suzuki, Fuji (JP); Michitaka Sasaki, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 794 days.

(21) Appl. No.: 11/621,805

(22) Filed: Jan. 10, 2007

(65) Prior Publication Data

US 2007/0212625 A1 Sep. 13, 2007

(30) Foreign Application Priority Data

Mar. 10, 2006 (JP) ..... 2006-066642

(51) Int. Cl.
*G03G 5/047* (2006.01)

(52) U.S. Cl. ..... 430/58.7; 430/66; 399/159; 399/111

(58) Field of Classification Search ..... 430/58.7, 430/66, 123.43, 123.42; 399/111, 159
See application file for complete search history.

(56) References Cited

U.S. PATENT DOCUMENTS

| | | | |
|---|---|---|---|
| 5,492,784 | A | 2/1996 | Yoshikawa et al. |
| 5,578,405 | A | 11/1996 | Ikegami et al. |
| 5,665,500 | A | 9/1997 | Suzuki |
| 5,871,876 | A | 2/1999 | Ikuno et al. |
| 5,928,828 | A | 7/1999 | Suzuki |
| 6,026,262 | A | 2/2000 | Kinoshita et al. |
| 6,030,733 | A | 2/2000 | Kami et al. |
| 6,066,428 | A | 5/2000 | Katayama et al. |
| 6,136,483 | A | 10/2000 | Suzuki et al. |
| 6,151,468 | A | 11/2000 | Kami et al. |
| 6,194,535 | B1 | 2/2001 | Katayama et al. |
| 6,210,848 | B1 | 4/2001 | Nagai et al. |
| 6,861,188 | B2 | 3/2005 | Ikegami et al. |
| 6,899,983 | B2 | 5/2005 | Tamoto et al. |
| 6,936,388 | B2 | 8/2005 | Suzuki et al. |
| 7,018,755 | B2 | 3/2006 | Ikegami et al. |
| 7,112,392 | B2 | 9/2006 | Shimada et al. |
| 7,160,658 | B2 | 1/2007 | Suzuki et al. |
| 7,175,957 | B2 | 2/2007 | Suzuki et al. |
| 7,179,573 | B2 | 2/2007 | Suzuki et al. |
| 2004/0053152 | A1 | 3/2004 | Nagai et al. |
| 2004/0180280 | A1 | 9/2004 | Ikegami et al. |
| 2005/0008957 | A1 | 1/2005 | Ikegami et al. |
| 2005/0158641 | A1 | 7/2005 | Yanagawa et al. |
| 2005/0175911 | A1 | 8/2005 | Tamoto et al. |
| 2005/0196193 | A1 | 9/2005 | Tamoto et al. |
| 2005/0221210 | A1 | 10/2005 | Suzuki et al. |
| 2005/0238987 | A1 | 10/2005 | Ohshima et al. |
| 2005/0266325 | A1 | 12/2005 | Yanagawa et al. |
| 2005/0266328 | A1 | 12/2005 | Yanagawa et al. |
| 2005/0282075 | A1 | 12/2005 | Ikuno et al. |
| 2005/0287452 | A1 | 12/2005 | Tamura et al. |
| 2005/0287465 | A1 | 12/2005 | Ohshima et al. |
| 2006/0014093 | A1 | 1/2006 | Li et al. |
| 2006/0014096 | A1 | 1/2006 | Ohshima et al. |
| 2006/0051689 | A1 | 3/2006 | Suzuki et al. |
| 2006/0068308 | A1 | 3/2006 | Ohshima et al. |
| 2006/0110668 | A1 | 5/2006 | Kawasaki et al. |

FOREIGN PATENT DOCUMENTS

| | | | |
|---|---|---|---|
| JP | 56-48637 | | 5/1981 |
| JP | 64-1728 | | 1/1989 |
| JP | 4-281461 | | 10/1992 |
| JP | 7-10912 | | 1/1995 |
| JP | 2000-66425 | | 3/2000 |
| JP | 2000-241998 | | 9/2000 |
| JP | 2001-175016 | | 6/2001 |
| JP | 3194392 | | 6/2001 |
| JP | 3262488 | | 12/2001 |
| JP | 3286711 | | 3/2002 |
| JP | 2004-258344 | | 9/2004 |
| JP | 2004-258345 | | 9/2004 |
| JP | 2005173021 | A * | 6/2005 |
| JP | 2006-10972 | | 1/2006 |

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

(Continued)

*Primary Examiner*—Christopher RoDee
(74) *Attorney, Agent, or Firm*—Oblon, Spivak, McClelland, Maier & Neustadt, L.L.P.

(57) ABSTRACT

The present invention provides an image bearing member that includes: a photoconductor; and a heating unit which heats the photoconductor, wherein the photoconductor includes: a support; a charge generating layer on the support, a charge transport layer, and a crosslinked charge transport layer in this order, wherein the crosslinked charge transport layer includes a reaction product of a radically polymerizable compound with three or more functional groups which does not have a charge transporting structure, and a radically polymerizable compound with one functional group, which compound has a charge transporting structure.

8 Claims, 7 Drawing Sheets

FOREIGN PATENT DOCUMENTS

JP 2006-30985 A 2/2006

OTHER PUBLICATIONS

English language machine translation of JP 2001-175016 (Jun. 2001).*
English language machine translation of JP 2005-173021 (Jun. 2005).*
English language machine translation of JP 2006-010972 (Jan. 2006).*
U.S. Appl. No. 12/000,239, filed Dec. 11, 2007, Fujiwara, et al.
U.S. Appl. No. 09/679,480, filed Oct. 5, 2000, Suzuki, et al.
U.S. Appl. No. 12/035,016, filed Feb. 21, 2008, Iwamoto, et al.
U.S. Appl. No. 12/047,011, filed Mar. 12, 2008, Kami, et al.

* cited by examiner

IMAGE BEARING MEMBER AND IMAGE FORMING METHOD USING THEREOF, AND IMAGE FORMING APPARATUS AND PROCESS CARTRIDGE

BACKGROUND OF THE INVENTION

1. Field of the Invention

The present invention relates to: an image bearing member such that abrasion resistance and scratch resistance are high, and crack or film peeling is hard to occur, and that the image bearing member comprises a photoconductive layer having favorable electrical properties; and an image forming apparatus, a process cartridge and an image forming method that are used for a color photocopier, color printer, etc.

2. Description of the Related Art

In recent years, in order to write digital signal data, a method for forming an electrophotographic image has increasingly been employed in which a latent electrostatic image is formed on an organic photoconductor by dot light exposure and developed by a reversal developing method to form an image.

It is required that organic photoconductors employed in such a method be stable over long term use and also suitable for high resolution writing; however, the strength of organic photoconductors is low and problems due to abrasion wear of and scratches on a photoconductive layer are likely to occur. Thus, improvement of durability has been sought for.

As a technique to improve the abrasion resistance of the photoconductive layer, for example, (1) a photoconductor in which a hardening binder is used in a crosslinked charge transport layer (see Japanese Patent Application Laid-Open (JP-A) No. 56-48637), (2) a photoconductor in which a polymeric charge transport material is used (see JP-A No. 64-1728), and (3) a photoconductor in which an inorganic filler is dispersed in a crosslinked charge transport layer (see JP-A No. 4-281461) are proposed.

Among these techniques, in case of the photoconductor of (1) using a hardening binder, poor compatibility with a charge transport material and impurities such as a polymerization initiator and an unreacted residual group increase a rest potential, inviting the decrease of image density. In case of the photoconductor of (2) using a polymeric charge transport material, abrasion resistance has been improved to some extent, however, the photoconductor of (2) does not have satisfactory durability sought for organic photoconductors. In addition, the electrical properties of polymeric charge transport material are hard to be stable since the polymerization of polymeric charge transport material and its purification is difficult, and thus it is difficult to obtain charge transport polymer material with high purity. Further, there are problems during manufacture such as high viscosity of coating solution. The photoconductor of (3) in which an inorganic filler is dispersed in a crosslinked charge transport layer has higher abrasion resistance compared to the common photoconductor in which low-molecular-mass charge transport material is dispersed in an inactive polymer; however, a charge trap present on the surface of the inorganic filler increases a rest potential, inviting the decrease of image density. In addition, when the inorganic filler and a binder resin form large concavities and convexities on the surface of the photoconductor, cleaning failures may occur, causing toner filming and image deletion. These techniques of (1), (2) and (3) have not satisfied an overall durability including electrical durability and mechanical durability required for an organic photoconductor yet.

Further, in order to improve the abrasion resistance and the scratch resistance of the photoconductor of (1), Japanese Patent (JP-B) No. 3262488 proposes a photoconductor in which a cured material of a multi-functional acrylate monomer is included. In this patent literature, it is described that a cured material of a multi-functional acrylate monomer is included into a protective layer on a photoconductive layer; however, the literature only describes that a charge transport material may be included into the protective layer and there exist no specific descriptions. In addition, when simply adding a low-molecular-mass charge transport material to a crosslinked charge transport layer, the problem of compatibility with the cured material occurs. As a result, the low-molecular-mass charge transport material separates out and a white turbidity appears. The increase of the electric potential at an exposed area caused not only the reduction of image density, but also the reduction of mechanical strength in some cases. Also, the proposed photoconductor is produced, specifically, by way of causing monomers contained in a reaction mixture together with a polymer binder to react; therefore, a three-dimensional network structure is not fully developed, and a crosslink density becomes low. Thus, the photoconductor is not so satisfactory as to exert noticeable abrasion resistance.

As a technique for improving the abrasion resistance of photoconductive layer in place of these techniques, JP-B No. 3194392 proposes to provide a charge transport layer formed using a coating solution that comprises a monomer having a carbon-carbon double bond, a charge transport material having a carbon-carbon double bond, and a binder resin. The binder resin is considered to improve adhesion of the charge generating layer and a cured charge transport layer, and further to have a role to ease the internal stress of a film when a thick film is cured. The binder resin is broadly classified into a binder that has a carbon-carbon double bond and is reactive with the charge transport material and another binder that does not have the double bond and is non-reactive with the charge transport material. The proposed photoconductor represents both abrasion resistance and favorable electrical properties, which attracts attention. However, when a binder resin not having a reactivity with a charge transport material is used, the non-reactive resin is not well compatible with the cured material generated from the reaction between the monomer and the charge transport material, and phase separation is likely to occur in the crosslinked charge transport layer, which may cause scratches, fixation of an external additive in the toner and paper dusts. Further, as mentioned above, three-dimensional network structure is not fully developed, and a crosslink density becomes low. Thus, the photoconductor is not so satisfactory as to exert noticeable abrasion resistance. In addition, specifically described monomers for use in this photoconductor are bifunctional. From these reasons, the photoconductor was not satisfactory in terms of abrasion resistance. Also, even when the binder resin having a reactivity is used, the number of crosslinkage between molecules is small although the molecular mass of the cured material increases. It is difficult to obtain both proper binding amount of the charge transport material and proper crosslink density at the same time, and thus electric properties and abrasion resistance were not satisfactory.

Further, JP-A No. 2000-66425 discloses a photoconductor that comprises a photoconductive layer containing a cured compound of a hole transporting compound having two or more functional groups capable of undergoing chain polymerization in the same molecule. This photoconductive layer has a high hardness due to increased crosslink density. However, since the bulky hole transporting compound has two or more functional groups capable of undergoing chain polymerization, distortion occurs in the cured material and internal stress increases, and crack or peeling tends to occur in the crosslinked surface layer during long-term use in some cases.

Further, in order to improve the abrasion resistance, a photoconductor has been put to practical use that is provided with a photoconductive layer or a surface protective layer that comprises an organosilicon binder resin with high durability. However, the organosilicon binder resin easily absorbs moisture, causing problems such as reduced quality of images, specifically image blur and deletion due to filming. Further, in the crosslinked film of organosilicon, an unreacted hydrolyzable group and silanol group remain on the surface of the film easily, and thus the crosslinked film of organosilicon has a drawback that it is easily affected to the adsorption of water molecules under a high-humidity environment. Much unreacted group causes easily adsorption of water molecules and discharge products generated upon charging under a high-humidity environment. As a result, surface resistance is reduced, causing problems such as image deletion.

As one of measures to such image deletion caused by moisture absorption, it is known that a photoconductor is provided with a heating device and heated therewith (see JP-A No. 2000-241998).

Heating of photoconductor by providing the heating device can prevent image deletion when images are being formed. In this case, however, toner filming is likely to occur. For example, there is a drawback that image deletion occurs the day after the stop of image forming apparatus due to the moisture absorption by a filming substance. The higher durability and the higher abrasion resistance the photoconductor has, the smaller the abrasion loss of the surface layer is, causing the deterioration of the surface, which occurs during charging, or making the removal of charge products difficult. Consequently, image deletion occurs or dot reproducibility deteriorates. Especially, these phenomena are observed remarkably at the site closely near the charging electrode during the halt of a photoconductor drum. For example, it is difficult to suppress image deletion phenomenon occurring beneath a charging electrode sufficiently by airflow or the heating device arranged closely near the photoconductor drum. It is probably because even after the halt of the operation of image forming apparatus, harmful materials such as active oxygen generated during operation remain closely near each charging electrode and act on the coated photoconductive layer at the surface of the photoconductor after the halt of rotation. In addition, it is impossible to heat the surface of the photoconductor uniformly by conventional means such as blowing of airflow and a heating device arranged closely near the photoconductor as a separate body, and thus such conventional means are insufficient for preventing e.g. adsorption of water molecules under a high-humidity environment.

There has not been provided an image bearing member such that the image bearing member has a favorable charging properties and has high sensitivity and high abrasion resistance, the surface resistance is not reduced even under a high-humidity environment, and problems such as image deletion are not caused, and that even after the formed image has been left, image deletion is not caused and the image quality is remarkably stable. Thus, in the present situation, it has been highly desired to develop such image bearing member as soon as possible.

SUMMARY OF THE INVENTION

An object of the present invention is to provide an image bearing member such that the image bearing member has a favorable charging properties and has high sensitivity and high abrasion resistance, the surface resistance is not reduced even under a high-humidity environment, and problems such as image deletion are not caused, and that even after the formed image has been left, image deletion is not caused and the image quality is remarkably stable, and an image forming method using the image bearing member; and an image forming apparatus and a process cartridge.

The image bearing member of the present invention includes: a photoconductor; and a heating unit which heats the photoconductor, wherein the photoconductor includes: a support; a charge generating layer on the support, a charge transport layer, and a crosslinked charge transport layer in this order, wherein the crosslinked charge transport layer includes a reaction product of a radically polymerizable compound with three or more functional groups which does not have a charge transporting structure, and a radically polymerizable compound with one functional group, which compound has a charge transporting structure.

By adopting the above mentioned composition, the image bearing member of the present invention has a favorable charging properties and has high sensitivity and high abrasion resistance, the surface resistance is not reduced even under a high-humidity environment, and problems such as image deletion are not caused. Besides, even after the formed image has been left, image deletion is not caused and an image with high durability and high quality can be obtained over a long period.

The image bearing member of the present invention is used under the environment where a series of processes such as a charging unit, developing unit, transferring unit, fixing unit, cleaning unit, and discharging unit is repeated, and in this process, abrasion of a photoconductor occurs or a photoconductor is scratched, which causes image deterioration, resulting in the end of operating life of a photoconductor. The factors, which bring about this abrasion or scratch, are, for example, (1) decomposition of a surface composition of a photoconductor due to the electrical discharge during charging or discharging, and chemical deterioration due to oxidized gas, (2) carrier adhesion during developing, (3) friction with paper during transfer, and (4) friction, during cleaning, with a cleaning brush, cleaning blade, and residual toner or adhered carrier. In order to design a photoconductor resistant to these hazards, it is important to make the surface layer have enhanced hardness and elasticity and to make the surface layer uniform, and from a viewpoint of film structure, a method is useful in which a dense and homogeneous three-dimensional network structure is formed.

The crosslinked charge transport layer of the present invention at the surface has a crosslinking structure in which a radically polymerizable monomer with three or more functional groups is cured. Therefore, a three-dimensional network structure is developed, a surface layer with enhanced hardness and elasticity where crosslink density is very high can be obtained and high abrasion resistance and scratch resistance can be achieved. Thus, it is important to increase the crosslink density at the surface of a photoconductor, i.e., the number of crosslinkage per unit volume, but internal stress due to volume shrinkage is generated because a number of links are formed in a moment in the curing reaction. This internal stress increases with the increase of the thickness of the crosslinked layer. Thus, when the entire layer of the charge transport layer is cured, crack or film peeling occurs easily. Even if this phenomenon does not appear at the beginning, when subjected to the hazards and the influence of thermal fluctuation during charging, developing, transfer and cleaning through repeated use in the electrophotographic process, such phenomenon may easily occur with time. The method for solving such problems is directed toward a solution to soften a cured resin layer, for example, (1) introduction of high-molecular-mass component into a crosslinked layer and crosslinking structure (2) use of radically polymerizable monomer with one or two functional groups in large amount (3) use of multifunctional monomer having a flexible group. However, any one of these makes the crosslink density of the crosslinked layer low and noticeable abrasion resistance cannot be achieved.

In contrast, the image bearing member of the present invention is provided with a crosslinked charge transport layer with high crosslink density, in which a three-dimensional network structure is developed, on a charge transport layer, so that the crosslinked charge transport layer has a thickness of preferably 1 μm to 10 μm, and more preferably 2 μm to 8 μm. This prevents the above-mentioned crack and film peeling from occurring and allows for the achievement of very high abrasion resistance. The reason why the photoconductor of the present invention can suppress crack and film peeling is, for example, that the internal stress does not become large since the crosslinked charge transport layer can be formed as a thin film, and that the internal stress of the crosslinked charge transport layer at the surface can be alleviated since the photoconductor includes a charge transport layer under the crosslinked charge transport layer. Therefore, there is no requirement for the crosslinked charge transport layer to include a polymer material in large amount. When a large amount of polymer material is added to the crosslinked charge transport layer, scratch and/or toner filming are caused which results from the incompatibility between the polymer material and the cured material generated by the reaction of the radically polymerizable composition (radically polymerizable monomer and radically polymerizable compound that has a charge transporting structure); however, in the case of the image bearing member of the present invention, scratch and toner filming due to such incompatibility are hardly caused. Further, when the charge transport layer is a thick film and the entire of such layer is cured by irradiation with light energy, the light transmission into the inside of the charge transport layer is restricted due to the absorption by the charge transporting structure and a phenomenon that the curing reaction proceeds insufficiently occurs sometimes. With respect to the crosslinked charge transport layer of the present invention, when formed as a thin film of 10 μm or less, the curing reaction proceeds to the inside uniformly, and even in the inside, abrasion resistance can be kept as high as at the surface.

Additionally, the uppermost layer of the image bearing member according to the present invention includes not only the above-mentioned radically polymerizable monomer with three or more functional groups but also a radically polymerizable compound with one functional group that has a charge transporting structure. During the formation of the uppermost layer, the radically polymerizable compound with one functional group that has a charge transporting structure is incorporated in the crosslinkage when the above-mentioned radically polymerizable monomer with three or more functional groups is cured. In contrast, when the crosslinked surface layer includes a low-molecular-mass charge transport material with no functional group, the low-molecular-mass charge transport material separates out and a white turbidity appears due to the poor compatibility therebetween, also causing reduced mechanical strength of the crosslinked surface layer. On the other hand, when a charge transporting compound with two or more functional groups is used as a main component, the charge transporting compound with two or more functional groups is fixed through plural links in a crosslinking structure, increasing the crosslink density. However, since the charge transporting structure is very bulky, the distortion of the cured resin structure becomes extremely large, causing the increase of the internal stress of the crosslinked charge transport layer.

Further, the image bearing member of the present invention has favorable electrical properties. Thus, high image quality can be achieved for a long term. This attributes to the use of the radically polymerizable compound with one functional group that has a charge transporting structure as a constituent material of the crosslinked charge transport layer and to the fixing of the radically polymerizable compound with one functional group between crosslinkages in the form of a pendant. As mentioned above, a charge transport material with no functional group separates out and a white turbidity appears, causing remarkable deterioration of electrical properties such as reduced sensitivity and elevation of the rest potential after repeated use. When a charge transporting compound with two or more functional groups is used as a main component, the compound is fixed through plural links in a crosslinking structure. Thus, an intermediate structure (cation radical) during charge transport cannot be stably maintained, and reduced sensitivity and elevation of the rest potential due to a charge trap are caused easily. The deterioration of electrical properties brings about images such as an image with reduced image density and an image having a thinned letter. Further, in the image bearing member of the present invention, a design for a charge transport layer with less charge trap and high charge mobility in a conventional photoconductor can be applied to the charge transport layer under the crosslinked charge transport layer, so that the electrical side effect of the crosslinked charge transport layer can be suppressed to minimum.

The crosslinked charge transport layer is formed by curing a radically polymerizable monomer with three or more functional groups that does not have a charge transporting structure and a radically polymerizable compound with one functional group that has a charge transporting structure, and a three-dimensional network structure is developed throughout the layer. Thus, the crosslinked charge transport layer has high crosslink density. Depending on the other components (e.g., additives, such as a mono- or bi-functional monomer, a polymer binder, an antioxidant, a leveling agent and a plasticizer, and dissolved components invading from an under layer) than the above-mentioned components and on the curing conditions, the crosslink density becomes low locally sometimes or the crosslinked charge transport layer is formed as an aggregate of tiny cured material crosslinked with high density. Bonding force between cured materials of such crosslinked charge transport layer is weak, and the crosslinked charge transport layer exhibits solubility to an organic solvent. Also, through repeated use in the electrophotographic process, a local abrasion or a detachment of a tiny cured material unit occurs easily. As in the present invention, by rendering the crosslinked charge transport layer insoluble in an organic solvent, an expected three-dimensional network structure is developed leading to a high degree of crosslinking. Besides, chain reaction proceeds in a wide range and the resulting cured material has a high-molecular mass. Thus, noticeable abrasion resistance can be achieved.

An image forming method of the present invention includes: forming a latent electrostatic image on an image bearing member; developing the latent electrostatic image with a toner to form a visible image; transferring the visible image to a recording medium; fixing a transferred image transferred to the recording medium; and cleaning the image bearing member, wherein the image bearing member is the image bearing member of the present invention, and an image is formed while heating the image bearing member. Consequently, the image bearing member has high scratch resistance and high abrasion resistance, and the surface resistance thereof is not reduced under the environment of high temperature and high humidity. In addition, an image with high durability and high quality can be formed over a long period even under a high-temperature environment occurred in e.g. a high-speed process.

An image forming apparatus of the present invention includes: an image bearing member; a latent electrostatic image forming unit; a developing unit; a transferring unit; a fixing unit; and a cleaning unit. In the image forming apparatus of the present invention, the latent electrostatic image forming unit forms a latent electrostatic image on the image bearing member. The developing unit forms a visible image by developing the latent electrostatic image formed on the image bearing member with a toner. The transferring unit transfers the visible image to a recording medium. The fixing unit fixes a transferred image transferred to the recording medium. In the image forming apparatus of the present invention, as the image bearing member, the image bearing member of the present invention is used. Thus, the image bearing member has high scratch resistance and high abrasion resistance, and the surface resistance thereof is not reduced under the environment of high temperature and high humidity. In addition, an image with high durability and high quality can be obtained over a long period even under a high-temperature environment occurred in e.g. a high-speed process.

A process cartridge of the present invention includes at least any one unit selected from: an image bearing member, a latent electrostatic image forming unit which forms a latent electrostatic image on the image bearing member, a developing unit which forms a visible image by developing the latent electrostatic image with a toner, a transferring unit which transfers the visible image to a recording medium, and a cleaning unit which removes a residual toner on the image bearing member, wherein as the image bearing member, the image bearing member of the present invention is used. Thus, the image bearing member has high scratch resistance and high abrasion resistance, and the surface resistance thereof is not reduced under a high-humidity environment. In addition, an image with high durability and high quality can be obtained over a long period even under the environment of high temperature and high humidity occurred in e.g. a high-speed process. Even if blade cleaning or the like is performed, the abrasion of the image bearing member is suppressed to a remarkably small extent, and cleaning ability is also favorable.

DESCRIPTION OF THE PREFERRED EMBODIMENTS

Image Bearing Member

The image bearing member of the present invention comprises: a photoconductor; and a heating unit which heats the photoconductor, wherein the photoconductor comprises: a support; and on the support a photoconductive layer that comprises a charge generating layer, a charge transport layer, and a crosslinked charge transport layer in this order, and the image bearing member further comprises other layers according to requirements.

In the present invention, the term "image bearing member" means a concept that includes a heating unit other than a support and photoconductive layer. The "image bearing member" may be referred to as "photoconductor", "electrophotographic photoconductor", and "latent electrostatic image bearing member" in some cases; however, in the present invention, the "image bearing member" and the "photoconductor" are clearly distinguished. While the "image bearing member" includes a heating unit as a component other than the "photoconductor", the "photoconductor" does not include a heating unit as a component.

The heating unit is not particularly limited and can be appropriately selected according to applications. The photoconductor is heated, for example, by (1) a method in which hot air is blown over the surface of a photoconductor or inside of the photoconductor drum or (2) a direct heating method by a heating unit housed in the image bearing member itself. Among these, the direct heating method of (2) by a heating unit housed in the image bearing member itself is preferable.

The direct heating method of (2) includes a method in which a photoconductor is directly heated from the inside of the photoconductor drum, wherein a sheet heating element or ceramic heating element, in which a heating element is sandwiched, is integrated inside the photoconductor. Examples of the heating element include laminated thin metal sheets and those in which a heating element such as nichrome wire is sandwiched by e.g. polyethylene terephthalate resin as a support. This enables uniform heating of the photoconductor even if any position of the photoconductor drum stops beneath a charging electrode. In addition, heating of the image bearing member enables the relative humidity of the surface of the image bearing member to be reduced; thus favorable image can be obtained over the entire image even in a high-humidity environment. Therefore, the direct heating by a heating unit housed in the image bearing member itself is most effective. In addition, the use of external heater on the image bearing member in combination can further enhance the heating effect.

Figure 1:
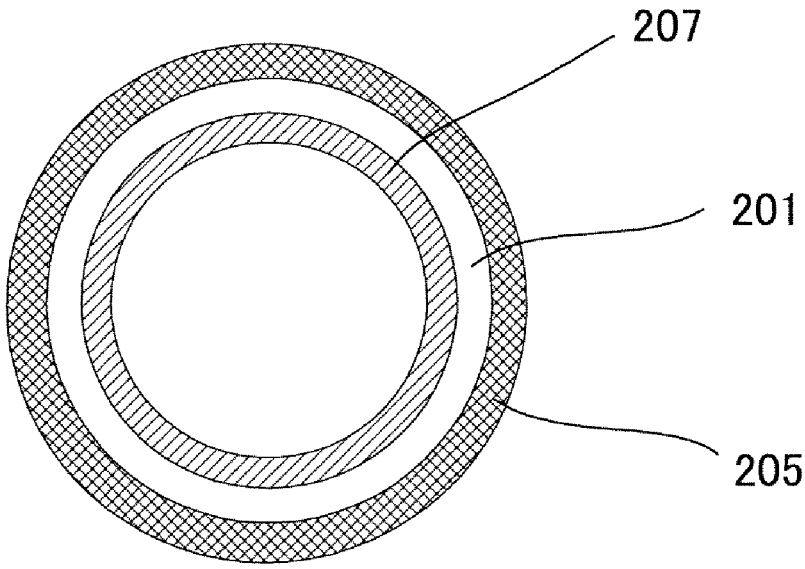
FIG. 1 is a schematic cross-section view showing an example of an image bearing member of the present invention.

In a preferable aspect, the heating unit is housed in the photoconductor and heats the photoconductor from the inside thereof. For example, FIG. 1 is a schematic cross-section view showing an example of the image bearing member of the present invention. This image bearing member comprises a support 201, a photoconductive layer 205 thereon, and a heating unit 207 inside of the support 201 brought into contact or partial contact therewith. The photoconductive layer 205 is comprised of at least a charge generating layer, a charge transport layer and a crosslinked charge transport layer, and the heating unit 207 comprises a coiled sheet heater.

Typically, the temperature of the image bearing member (surface) is preferably 30° C. to 65° C. under the environment of 50% RH or more, and preferably 40° C. to 50° C. under the environment of 70% RH or more. In order to resolve image deletion, it is effective to rotate an image bearing member while maintaining the temperature of the photoconductor in the temperature range mentioned above during the period from the power activation to the image formation.

<Photoconductor>

The photoconductor comprises a support, on the support, a photoconductive layer that includes at least a charge generating layer, a charge transport layer and a crosslinked charge transport layer in this order, and it further comprises other layers according to requirements.

Figure 2:
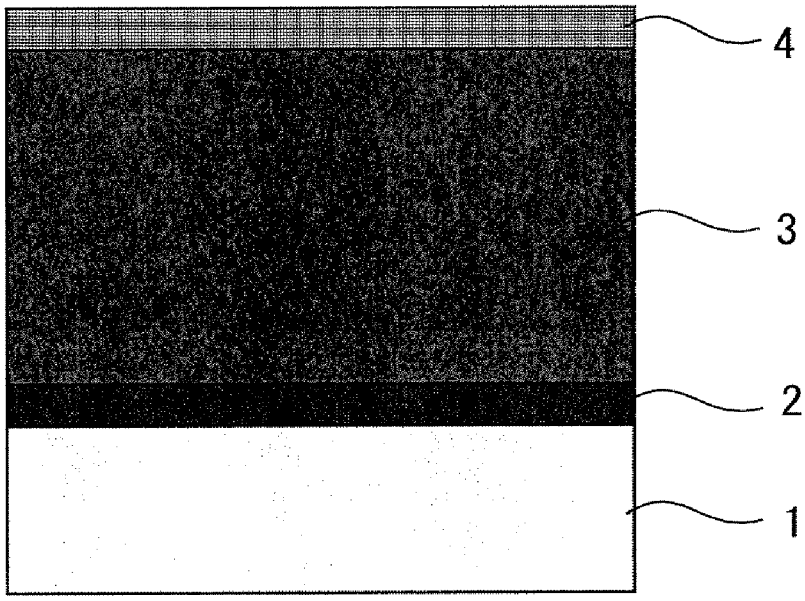
FIG. 2 is a schematic cross-section view showing an example of a layer composition of a photoconductor of the present invention.

FIG. 2 is a schematic cross-section view showing an photoconductor of the present invention. This photoconductor has a multilayer structure and comprises a conductive support 1, on the support, a charge generating layer 2 having the function of generating charge, a charge transport layer 3 having the function of transporting charge, and a crosslinked charge transport layer 4 in this order.

—Support—

The support is not particularly limited as long as it has a conductivity of $10^{10}$ Ω·cm or less in volume resistance, and can be appropriately selected according to applications. For example, it is possible to use film-like or cylindrical plastics or paper sheets coated with a metal such as aluminum, nickel, chrome, nichrome, copper, gold, silver, and platinum, or a metallic oxide such as tin oxides, and indium oxides by deposition or sputtering; plates of e.g. aluminum, aluminum alloy, nickel, and stainless; or tubes prepared by forming a cylindrical mother tube by means of techniques such as extrusion and drawing, followed by surface treatments such as cutting, super finishing, and polishing. The endless nickel belt and the endless stainless belt disclosed in JP-A No. 52-36016 can be also used as the support.

Furthermore, those prepared by applying a liquid containing an electroconductive powder dispersed in an appropriate binder resin on the support can be used as the support of the present invention.

Examples of the electroconductive powder include carbon black, acetylene black, metallic powers such as aluminum, nickel, iron, nichrome, copper, zinc, and silver, or metallic oxide powders such as conductive tin oxides and ITO. Examples of the binder resin, used together with the electroconductive powder, include polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyarylate resins, phenoxy resins, polycarbonates, cellulose acetate resins, ethyl cellulose resins, polyvinyl butyral resins, polyvinyl formal resins, polyvinyl toluene resins, poly-N-vinylcarbazole, acryl resins, silicone resins, epoxy resins, melamine resins, urethane resins, phenol resins, and alkyd resins.

Such a conductive layer can be formed by applying a coating liquid in which an electroconductive powder and a binder resin are dispersed in an appropriate solvent such as tetrahydrofuran, dichloromethane, methyl ethyl ketone, and toluene.

Further, those are favorably used as the support of the present invention that comprise a conductive layer formed on a appropriate cylindrical support using a heat-shrinkable tube made of a material such as polyvinyl chloride, polypropylene, polyesters, polystyrene, polyvinylidene chloride, polyethylene, chlorinated rubber and Teflon™; and the electroconductive powder contained therein.

—Photoconductive Layer—

The photoconductive layer comprises a charge generating layer having the function of generating charge, a charge transport layer having the function of transporting charge, and a crosslinked charge transport layer in this order, and it further comprises other layers according to requirements.

—Charge Generating Layer—

The charge generating layer comprises a charge generating substance having the function of generating charge as a main component, and it further comprises a binder resin and other components according to requirements.

Both of inorganic materials and organic materials can be suitably used as the charge generating substance.

Examples of the inorganic material include crystalline selenium, amorphous-selenium, selenium-tellurium, selenium-tellurium-halogen selenium-arsenic compounds and amorphous-silicon. For the amorphous-silicon, those in which dangling bonds are terminated by hydrogen atoms or halogen atoms; and those doped with boron atoms, phosphorus atoms, etc. are preferable.

For the organic material, a heretofore known organic material can be used. Examples of the organic material include phthalocyanine pigments such as metallic phthalocyanine and metal-free phthalocyanine; azlenium slat pigments, squaric acid methyne pigments, azo pigments having a carbazole skeleton; azo pigments having a triphenylamine skeleton; azo pigments having a diphenylamine skeleton; azo pigments having a dibenzothiophene skeleton; azo pigments having a fluorenon skeleton; azo pigments having an oxadiazole skeleton; azo pigments having a bisstilbene skeleton; azo pigments having a distyryl oxadiazole skeleton; azo pigments having a distyryl carbazole skeleton; perylene pigments; anthraquinone or polycyclic quinine pigments; quinoneimine pigments; diphenylmethane and triphenylmethane pigments; benzoquinone and naphtoquinone pigments; cyanine and azomethine pigments; indigoid pigments; and bisbenzimidazole pigments. These charge generating substances may be used alone or as a mixture of two or more thereof.

Among these, oxytitanium phthalocyanine represented by the following General Formula (1) is one of preferable materials.

General Formula (1)

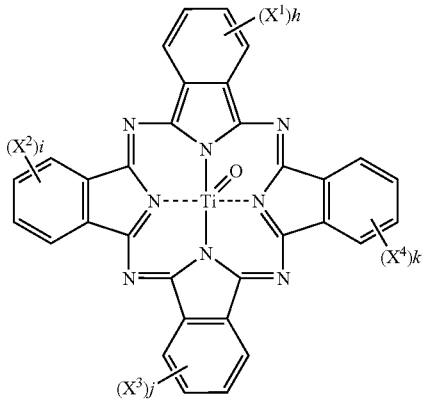

In the General Formula (1), $X^1$, $X^2$, $X^3$, and $X^4$ represent Cl or Br. h, i, j, and k represent an integer of 0 to 4.

The crystal form of the oxytitanium phthalocyanine is not particularly limited and can be appropriately selected according to applications, but oxytitanium phthalocyanine having strong peaks in CuKα characteristic X-ray diffraction at Bragg angles 2θ±0.2° of 9.0°, 14.2°, 23.9° and 27.1°, or oxytitanium phthalocyanine having strong peaks of 9.6° and 27.3° is more preferable in terms of sensitivity.

Examples of the binder resin include polyamides, polyurethanes, epoxy resins, polyketones, polycarbonates, silicone resins, acrylic resins, polyvinyl butyrals, polyvinyl formals, polyvinyl ketones, polystyrenes, poly-N-vinylcarbazoles, and polyacrylamides. These resins can be used alone or as a mixture of two or more thereof.

Specific examples of the binder resin include charge transport polymer materials disclosed in JP-A Nos. 01-001728, 01-009964, 01-013061, 01-019049, 01-241559, 04-011627, 04-175337, 04-183719, 04-225014, 04-230767, 04-320420, 05-232727, 05-310904, 06-234836, 06-234837, 06-234838, 06-234839, 06-234840, 06-234841, 06-239049, 06-236050, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085, and 09-328539.

In addition to the binder resins, polymeric charge transport materials having the function of transporting charge, can be used including, for example, polymer materials such as polycarbonates, polyesters, polyurethanes, polyethers, polysiloxanes and acrylic resins having an arylamine skeleton, a benzidine skeleton, a hydrazone skeleton, a carbazole skeleton, a stilbene skeleton, a pyrazoline skeleton, or the like; and polymer materials having a polysilane skeleton.

Specific examples thereof include polysilylene polymers disclosed in JP-A Nos. 63-285552, 05-19497, 05-70595, and 10-73944.

The charge generating layer may comprise a low-molecular-mass charge transport material. For the low-molecular-mass charge transport material, both of hole transport materials and electron transport materials are suitable.

For the electron transport material, electron accepting substances are suitable. Examples thereof include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide and diphenoquinone derivatives. These may be used alone or in combination of two or more.

For the hole transport material, electron donating substances shown below are suitable. Examples thereof include oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, and enamine derivatives. These may be used alone or in combination of two or more.

The method for forming the charge generating layer is not particularly restricted and can be appropriately selected according to applications, including a vacuum thin-film preparation method and a casting method with solution dispersal.

Suitable examples of the vacuum thin-film preparation method include a vacuum deposition method, a glow discharge decomposition method, an ion plating method, a sputtering method, a reactive sputtering method, and a CVD method. Favorable film formation of the above-mentioned inorganic materials and organic materials is possible with these vacuum thin-film preparation methods.

The charge generating layer can be formed by the casting method, for example, as follows. Specifically, the inorganic or organic charge generating substance is dispersed optionally with a binder resin using a solvent with a ball mill, an attritor, a sand mill, beads mill, etc., the dispersion liquid is diluted properly and applied to form the charge generating layer. Examples of the solvent include tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate, and butyl acetate. If required, a leveling agent such as dimethyl silicone oil and methylphenyl silicone oil may be added to the dispersion liquid. The dispersion liquid can be applied by dip-coating method, spray-coating method, bead-coating method, ring-coating method, or the like.

The thickness of the charge generating layer is not particularly restricted and can be appropriately selected according to applications. It is preferably 0.01 μm to 5 μm, and more preferably 0.05 μm to 2 μm.

—Charge Transport Layer—

The charge transport layer is a layer having the function of transporting charge and is formed by dissolving or dispersing a charge transport material having the function of transporting charge and a binder resin in an appropriate solvent, applying the solution or dispersion on a charge generating layer, and drying.

For the charge transport material, the electron transport materials, hole transport materials, and polymeric charge transport materials that were described in the charge generating layer can be used. As mentioned above, use of polymeric charge transport material is particularly useful since the solubility with respect to the lower layer can be reduced when the charge transport layer is formed thereon.

Examples of the binder resin include polystyrene resins, styrene acrylonitrile copolymers, styrene-butadiene copolymers, styrene-maleic anhydride copolymers, polyester resins, polyvinyl chloride resins, vinylchloride-vinylacetate copolymers, polyvinylacetate, polyvinylidene chloride, polyarylate resins, phenoxy resins, polycarbonate resins, cellulose acetate resins, ethylcellulose resins, polyvinylbutyral resins, polyvinylformal resins, polyvinyltoluene resins, poly-N-vinylcarbazole resins, acrylic resins, silicone resins, epoxy resins, melamine resins, urethane resins, phenol resins and alkyd resins. These may be used alone or in combination of two or more.

The amount of the charge transport material to be added is preferably 20 parts by mass to 300 parts by mass and more preferably from 40 parts by mass to 150 parts by mass, relative to 100 parts by mass of the binder resin. When the polymeric charge transport material is used, however, it can be used alone or in combination with the binder resin.

Solvents used for forming the charge generating layer can be also used as the solvent for use when the charge transport layer is formed, and those dissolving the charge transport material and binder resin well are suitable. These solvents can be used alone or by mixing two or more. The lower layers of the charge transport layer can be formed by the same coating method as that used for forming the charge generating layer.

Further, a plasticizer or a leveling agent may be added to the charge transport layer, if required.

The plasticizer can be plasticizers for typical resins, such as dibutylphthalate and dioctylphthalate. An appropriate amount of the plasticizer to be used is about 0 part by mass to about 30 parts by mass relative to 100 parts by mass of the binder resin.

For the leveling agent, for example, silicone oil such as dimethyl silicone oil and methylphenyl silicone oil; and polymers or oligomers having a perfluoroalkyl group in the side chain are used. A preferable amount of the leveling agent to be used is about 0 part by mass to about 1 part by mass relative to 100 parts by mass of the binder resin.

The thickness of the charge transport layer is not particularly restricted and can be appropriately selected according to applications. It is preferably 5 μm to 40 μm, and more preferably 10 μm to 30 μm.

—Crosslinked Charge Transport Layer—

A crosslinked charge transport layer coating solution described later is applied on the charge transport layer, dried according to requirements, and then a curing reaction is allowed to proceed by the external energy such as heat and light irradiation, resulting in the formation of crosslinked charge transport layer.

The crosslinked charge transport layer is a layer that has the function of transporting charge and has a crosslinking structure. The crosslinked charge transport layer is formed by dissolving or dispersing into an appropriate solvent at least a radically polymerizable monomer with three or more functional groups that does not have a charge transporting structure and a radically polymerizable compound with one functional group that has a charge transporting structure, applying this solution on the charge transport layer, and drying.

The radically polymerizable monomer with three or more functional groups that does not have a charge transporting structure represents a monomer which neither has a hole transporting structure such as triarylamine, hydrazone, pyrazoline and carbazole nor has an electron transport structure such as condensed polycyclic quinone, diphenoquinone, and an electron attractive aromatic ring having a cyano group or a nitro group, and which has three or more radically polymerizable functional groups. The radically polymerizable functional group may be any functional group, provided it has a carbon-carbon double bond and is capable of radically polymerizing. Examples of the radically polymerizable functional group include the following 1-substituted ethylene functional groups and 1,1-substituted ethylene functional groups.

Suitable examples of the 1-substituted ethylene functional group include functional groups represented by the following General Formula (2):

$$CH_2{=}CH{-}X_1{-} \qquad \text{General Formula (2)}$$

where $X_1$ represents an arylene group such as a phenylene group and a naphthylene group that may have a substituent, an alkenylene group that may have a substituent, a —CO-group, a —COO-group and a —CON($R_{10}$)-group (wherein $R_{10}$ represents a hydrogen atom, an alkyl group such as a methyl group and an ethyl group, an aralkyl group such as a benzyl group, a naphthylmethyl group, and a phenethyl group, and an aryl group such as a phenyl group and a naphtyl group), or a S-group.

Specific examples of the substituent include a vinyl group, a styryl group, a 2-methyl-1,3-butadienyl group, a vinylcarbonyl group, an acryloyloxy group, an acryloylamide group, and a vinylthioether group.

Suitable examples of the 1,1-substituted ethylene functional group include functional groups represented by the following General Formula (3):

$$CH_2{=}C(Y){-}X_2{-} \qquad \text{General Formula (3)}$$

where Y represents an alkyl group that may have a substituent, an aralkyl group that may have a substituent, an aryl group such as a phenyl group and a naphtyl group that may have a substituent, a halogen atom, a cyano group, a nitro group, an alkoxy group such as a methoxy group or an ethoxy group and a —$COOR_{11}$ group (wherein $R_{11}$ represents a hydrogen atom, an alkyl group such as a methyl group and an ethyl group that may have a substituent, an aralkyl group such as a benzyl group and a phenethyl group that may have a substituent, an aryl group such as a phenyl group and a naphtyl group that may have a substituent), or a $CONR_{12}R_{13}$ (wherein $R_{12}$ and $R_{13}$ represent a hydrogen atom, an alkyl group such as a methyl group and an ethyl group that may have a substituent, an aralkyl group such as a benzyl group, a naphthylmethyl group or a phenethyl group that may have a substituent, or an aryl group such as a phenyl group and a naphtyl group that may have a substituent, and $R_{12}$ and $R_{13}$ may be the same as or different from each other); $X_2$ represents the same substituent as $X_1$ in the General Formula (2), and a single bond or an alkylene group; and at least one of Y and $X_2$ is any one of an oxycarbonyl group, a cyano group, an alkenylene group and an aromatic ring.

Examples of the substituent include a α-acryloyloxy chloride group, a methacryloyloxy group, a α-cyanoethylene group, a α-cyanoacryloyloxy group, a α-cyanophenylene group, and a methacryloylamino group.

Examples of the substituent for the substituents of $X_1$, $X_2$ and Y include a halogen atom, a nitro group, a cyano group, an alkyl group such as a methyl group and an ethyl group, an alkoxy group such as a methoxy group and an ethoxy group, an aryloxy group such as a phenoxy group, an aryl group such as a phenyl group, a naphthyl group, an aralkyl group such as a benzyl group and a phenethyl group.

Among these radically polymerizable functional groups, the acryloyloxy group and methacryloyloxy group are particularly useful. A compound having three or more acryloyloxy groups can be prepared, for example, by ester reaction or ester exchange reaction using a compound having three or more hydroxyl groups in the molecule thereof and acrylic acid or acrylate, acrylic acid halide, or acrylic ester. A compound having three or more methacryloyloxy groups can be also prepared in the same way. The radically polymerizable functional groups in the monomer having three or more radically polymerizable functional groups may be the same or different.

Examples of the radically polymerizable monomer with three or more functional groups that does not have a charge transporting structure, include the following compounds, but are not limited to these compounds.

Examples of the radically polymerizable monomer include trimethylolpropanetriacrylate (TMPTA), trimethylolpropane trimethacrylate, trimethylolpropane alkylene-modified triacrylate, trimethylolpropane ethyleneoxy-modified (hereinafter, referred to as "EO-modified") triacrylate, trimethylolpropane propyleneoxy-modified (hereinafter, referred to as "PO-modified") triacrylate, trimethylolpropane caprolactone-modified triacrylate, trimethylolpropane alkylene-modified trimethacrylate, penta-erythritol triacrylate, pentaerythritol tetraacrylate (PETTA), glycerol triacrylate, glycerol epichlorohydrin-modified (hereinafter, referred to as "ECH-modified") triacrylate, glycerol EO-modified triacrylate, glycerol PO-modified triacrylate, tris(acryloxyethyl)isocyanurate, dipentaerythrithol hexaacrylate (DPHA), dipentaerythritol caprolactone-modified hexaacrylate, dipentaerythritol hydroxypentaacrylate, alkylated dipentaerythritol pentaacrylate, alkylated dipentaerythritol tetraacrylate, alkylated dipentaerythritol triacrylate, dimethylolpropane tetraacrylate (DTMPTA), pentaerythritol ethoxytetraacrylate, phosphoric acid EO-modified triacrylate, and 2,2,5,5-tetrahydroxymethylcyclopentanone tetraacrylate. These compounds can be used alone or in combination.

Further, in the present invention, among radically polymerizable compounds with three or more functional groups, the compound represented by the following General Formula (A) is preferably used;

General Formula (A)

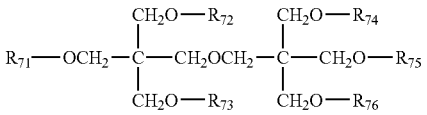

where $R_{71}$, $R_{72}$, $R_{73}$, $R_{74}$, $R_{75}$, and $R_{76}$ each represent a hydrogen atom or a group represented by the following structural formula. Four or more of $R_{71}$ to $R_{76}$ are not hydrogen atoms at the same time.

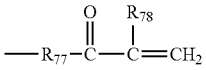

$R_{77}$ represents any one of a single bond, an alkylene group, an alkylene ether group, a polyoxyalkylene group, an alkylene ether group substituted with a hydroxy group, an alkylene ether group substituted with a (meth)acryloyloxy group, an oxyalkylene carbonyl group, and a poly(oxyalkylene carbonyl) group. $R_{78}$ represents a hydrogen atom or a methyl group.

In order to attain an object of the present invention, the $R_{77}$ in the above-mentioned General Formula (A) is preferably a single bond or an alkyl ether group substituted with a hydroxy group.

Further, in order to attain an object of the present invention, the compound represented by the above-mentioned General Formula (A) preferably comprises at least one compound having five or more radically polymerizable functional groups of (meth)acryloyloxy groups.

Compared to the case where compounds having only three or four functional groups are used, three-dimensional network is further developed, and a crosslinked surface layer with enhanced hardness where the degree of crosslinking is very high can be obtained, and high abrasion resistance is achieved. In addition, the compatibility with the radically polymerizable compound with one functional group that has a charge transporting structure, described in the present invention is satisfactory. These compounds are hardened simultaneously in a short time, and the improvement of hardening speed makes it possible to achieve the formation of smooth surface layer, giving more strength to the hazard caused by cleaning. In addition, smooth surface increases removal performance, enabling further improvement of the effect of the present invention.

Further, a uniformly crosslinked film with less distortion can be formed in the crosslinked layer by hardening the radically polymerizable monomer represented by the General Formula (A) and not having a charge transporting structure, which has many reactive functional groups and has fast hardening speed; and the radically polymerizable compound with one functional group that has a charge transporting structure. Consequently, unreacted portion of charge transport material in the crosslinked surface layer is decreased, improving the homogeneity inside of crosslinked film greatly. This enables stable electrical properties as well as the improvement of abrasion resistance.

Here, the compound of General Formula (A) will be described.

A compound having five or more acryloyloxy groups can be prepared, for example, by ester reaction or ester exchange reaction using a compound having five or more hydroxyl groups in the molecule thereof and acrylic acid or acrylate, acrylic acid halide, or acrylic ester. A compound having five or more methacryloyloxy groups can be also prepared in the same way. The radically polymerizable functional groups in the monomer having five or more radically polymerizable functional groups may be the same or different.

Examples of the radically polymerizable monomer represented by the General Formula (A) and not having a charge transporting structure include compounds, with respect to $R_{71}$ to $R_{76}$, having three acryloyloxy groups and three hydrogen atoms, compounds having four acryloyloxy groups and two hydrogen atoms, compounds having five acryloyloxy groups and one hydrogen atom, compounds having six acryloyloxy groups, compounds having three methacryloyloxy groups and three hydrogen atoms, compounds having four methacryloyloxy groups and two hydrogen atoms, compounds having five methacryloyloxy groups and one hydrogen atom, and compounds having six methacryloyloxy groups. Further, specific examples include the following compounds, but are not limited to these compounds.

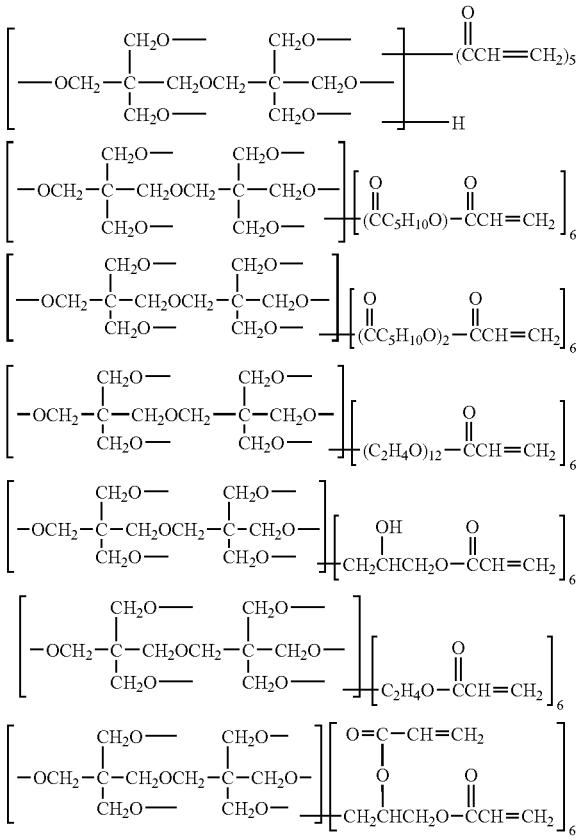

-continued

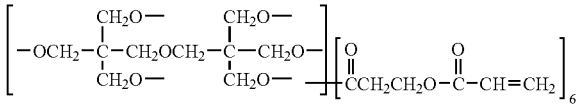

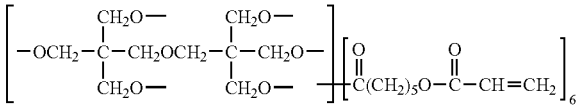

These may be used alone or in combination.

These monomers can be produced, for example, by the esterification of polyhydric alcohol because of excellent yield, low production cost, and high productivity. When a monomer having six radically polymerizable functional groups are used in the case where two or more of these monomers, more specifically, two, three, or four different monomers are used in combination, a mixture of a monomer having six radically polymerizable functional groups obtained by esterification, and a monomer having five or less radically polymerizable functional groups in which a hydrogen atom remains without esterification, can be preferably used because of excellent yield. With respect to the mixing ratio, the content of the monomer having six radically polymerizable functional groups is preferably 20% by mass to 99% by mass, more preferably 30% by mass to 97% by mass, most preferably 40% by mass to 95% by mass also because of excellent yield. Similarly, when a monomer having five radically polymerizable functional groups is used, the content thereof is preferably 20% by mass to 99% by mass, more preferably 30% by mass to 97% by mass, most preferably 40% by mass to 95% by mass, similarly, when a monomer having four radically polymerizable functional groups is used, the content thereof is preferably 0.01% by mass to 30% by mass, more preferably 0.1% by mass to 20% by mass, most preferably 3% by mass to 5% by mass, and similarly, when a monomer having three radically polymerizable functional groups is used, the content thereof is preferably 0.01% by mass to 30% by mass, more preferably 0.1% by mass to 20% by mass, most preferably 3% by mass to 5% by mass.

More specifically, due to the same reason, examples include: a mixture that contains a compound having five acryloyloxy groups and one hydrogen atom in an amount of 30% by mass to 70% by mass and preferably 40% by mass to 60% by mass, and a compound having six acryloyloxy groups in an amount of 70% by mass to 30% by mass and preferably 60% by mass to 40% by mass; a mixture that contains a compound having five acryloyloxy groups and one hydrogen atom in an amount of 30% by mass to 65% by mass and preferably 40% by mass to 55% by mass, a compound having six acryloyloxy groups in an amount of 65% by mass to 30% by mass and preferably 55% by mass to 40% by mass, and one, two, three, or four different compound(s) selected from the compounds listed below in an amount of 0.01% by mass to 5% by mass and preferably 1% by mass to 3% by mass:

- Compound having one acryloyloxy group and five hydrogen atoms
- Compound having two acryloyloxy groups and four hydrogen atoms
- Compound having three acryloyloxy groups and three hydrogen atoms
- Compound having four acryloyloxy groups and two hydrogen atoms;

a mixture that contains a compound having five methacryloyloxy groups and one hydrogen atom in an amount of 30% by mass to 70% by mass and preferably 40% by mass to 60% by mass, and a compound having six methacryloyloxy groups in an amount of 70% by mass to 30% by mass and preferably 60% by mass to 40% by mass; a mixture that contains a compound having five methacryloyloxy groups and one hydrogen atom in an amount of 30% by mass to 65% by mass and preferably 40% by mass to 55% by mass, a compound having six methacryloyloxy groups in an amount of 65% by mass to 30% by mass and preferably 55% by mass to 40% by mass, and one, two, three, or four different compound(s) selected from the compounds listed below in an amount of 0.01% by mass to 5% by mass and preferably 1% by mass to 3% by mass:

- Compound having one methacryloyloxy group and five hydrogen atoms
- Compound having two methacryloyloxy groups and four hydrogen atoms
- Compound having three methacryloyloxy groups and three hydrogen atoms
- Compound having four methacryloyloxy groups and two hydrogen atoms.

The radically polymerizable monomer with three or more functional groups that does not have a charge transporting structure preferably has a ratio of the molecular mass to the number of functional groups (molecular mass/number of functional groups) in the monomer not greater than 250. When the ration of the molecular mass to the number of functional groups in the monomer is more than 250, the crosslinked charge transport layer becomes soft, resulting in slightly reduced abrasion resistance. Thus, for the monomer having a modifying group such as EO-, PO-, and caprolactone among the monomers described above, single use of the monomer having an extremely long modifying group is not preferable. In addition, the content of the radically polymerizable monomer with three or more functional groups that does not have a charge transporting structure, to be used in the crosslinked charge transport layer, is preferably 20% by mass to 80% by mass and more preferably 30% by mass to 70% by mass, relative to the total mass of the crosslinked charge transport layer. When the content of the monomer is less than 20% by mass, the density of a three dimensional crosslinkage in the crosslinked charge transport layer is low and the noticeable improvement of the abrasion resistance may not be attained compared to the case where a conventional thermoplastic binder resin is used. When the content of the monomer is more than 80% by mass, the content of the charge transporting compound is reduced, resulting in the degradation of the electrical properties. In view of the balance of the electrical properties and the abrasion resistance, the content is most preferably 30% by mass to 70% by mass, although required electrical properties and the abrasion resistance are different depending on a used process and the thickness of the crosslinked charge transporting layer of the photoconductor differs depending on the different electrical properties and the abrasion resistance.

The radically polymerizable compound with one functional group that has a charge transporting structure for use in the crosslinked charge transport layer of the present invention represents a compound which has a hole transporting structure such as triarylamine, hydrazone, pyrazoline and carbazole, and has an electron transport structure such as condensed polycyclic quinone, diphenoquinone, and an electron attractive aromatic ring having a cyano group or a nitro group, and which has one radically polymerizable functional group. This radically polymerizable functional group includes those described in the radically polymerizable monomer above and, particularly, an acryloyloxy group and a methacryloyloxy group are useful. The charge transporting structure of a triarylamine structure shows high effect, in particular, when the compound represented by the following General Formula (4) or (5) is used, electric properties such as sensitivity and rest potential are favorably maintained.

General Formula (4)

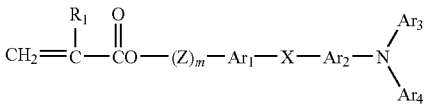

General Formula (5)

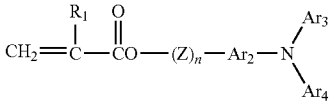

where $R_1$ represents a hydrogen atom, a halogen atom, an alkyl group that may have a substituent, an aralkyl group that may have a substituent, an aryl group that may have a substituent, a cyano group, a nitro group, an alkoxy group, —$COOR_7$ (wherein $R_7$ represents a hydrogen atom, an alkyl group that may have a substituent, an aralkyl group that may have a substituent or an aryl group that may have a substituent), a halogenated carbonyl group or $CONR_8R_9$ (wherein $R_8$ and $R_9$ represent a hydrogen atom, a halogen atom, an alkyl group that may have a substituent, an aralkyl group that may have a substituent or an aryl group that may have a substituent, and may be the same as or different from each other); $Ar_1$ and $Ar_2$ represent a substituted or unsubstituted arylene group and may be the same or different; $Ar_3$ and $Ar_4$ represent a substituted or unsubstituted aryl group and may be the same or different; X represents a single bond, a substituted or unsubstituted alkylene group, a substituted or unsubstituted cycloalkylene group, a substituted or unsubstituted alkylene ether group, an oxygen atom, a sulfur atom or a vinylene group; Z represents a substituted or unsubstituted alkylene group, a substituted or unsubstituted divalent alkylene ether group or a divalent alkyleneoxycarbonyl group; and m and n represent an integer of 0 to 3.

With respect to substituents of $R_1$ in the General Formula (4) or (5), examples of the alkyl group include a methyl group, an ethyl group, a propyl group, and a butyl group; examples of the aryl group include a phenyl group, and a naphtyl group; examples of the aralkyl group include a benzyl group, a phenethyl group, and a naphthylmethyl group; and examples of the alkoxy group include a methoxy group, an ethoxy group, and a propoxy group. These may be substituted by an alkyl group such as a halogen atom, a nitro group, a cyano group, a methyl group and an ethyl group; an alkoxy group such as a methoxy group and an ethoxy group; an aryloxy group such as a phenoxy group; an aryl group such as a phenyl group and a naphthyl group; an aralkyl group such as a benzyl group and a phenethyl group.

Among the substituents of $R_1$, a hydrogen atom and a methyl group are most preferable.

$Ar_3$ and $Ar_4$ are a substituted or unsubstituted aryl group; examples of the aryl group include a condensed polycyclic hydrocarbon group, a non-condensed cyclic hydrocarbon group, and a heterocyclic group.

The condensed polycyclic hydrocarbon group is preferably a group having a carbon number, which forms a ring, of 18 or less. Examples thereof include a pentanyl group, an indenyl group, a naphthyl group, an azulenyl group, a heptanyl group, a biphenylenyl group, an as-indacenyl group, a s-indacenyl group, a fluorenyl group, an acenaphthylenyl group, a pleiadenyl group, a acenaphthenyl group, a phenalenyl group, a phenanthryl group, an anthryl group, a fluoranthenyl group, an acephenanthrylenyl group, an aceanthrylenyl group, a triphenylenyl group, a pyrrenyl group, a chrysenyl group and a naphthacenyl group.

Examples of the non-condensed cyclic hydrocarbon group include monovalent groups of monocyclic hydrocarbon compounds such as benzene, diphenyl ether, polyethylenediphenyl ether, diphenylthioether and diphenylsulphone, monovalent groups of non-condensed polycyclic hydrocarbon compounds such as biphenyl, polyphenyl, diphenylalkane, diphenylalkene, diphenylalkyne, triphenylmethane, distyrylbenzene, 1,1-diphenylcycloalkane, polyphenylalkane and polyphenylalkene, and monovalent groups of ring assembly hydrocarbon compounds such as 9,9-diphenylfluorene.

Examples of the heterocyclic group include monovalent groups of carbazole, dibenzofuran, dibenzothiophene, oxadiazole and thiadiazole.

The aryl group represented by the $Ar_3$ and $Ar_4$ may have a substituent, for example, shown as in (1) to (8) below.

(1) Halogen atom, cyano group, nitro group, etc.

(2) Alkyl group; a straight-chain or branched-chain alkyl group having a carbon number of preferably 1 to 12, more preferably 1 to 8, and most preferably 1 to 4: the alkyl group may further include a fluorine atom, a hydroxyl group, a cyano group, an alkoxy group having a carbon number of 1 to 4, a phenyl group, a halogen atom, an alkyl group having a carbon number of 1 to 4 or a phenyl group substituted by an alkoxy group having a carbon number of 1 to 4. Specific examples thereof include a methyl group, an ethyl group, an n-butyl group, an i-propyl group, a t-butyl group, an s-butyl group, an n-propyl group, a trifluoromethyl group, a 2-hydroxyethyl group, a 2-ethoxyethyl group, a 2-cyanoethyl group, a 2-methoxyethyl group, a benzyl group, a 4-chlorobenzyl group, a 4-methylbenzyl group, and a 4-phenylbenzyl group.

(3) Alkoxy group (—$OR_2$) where $R_2$ is the alkyl group defined in the (2); specific examples thereof include a methoxy group, an ethoxy group, an n-propoxy group, an i-propoxy group, a t-butoxy group, an n-butoxy group, an s-butoxy group, an i-butoxy group, a 2-hydroxyethoxy group, a benzyloxy group, and a trifluoromethoxy group.

(4) Aryloxy group; examples of the aryl group include a phenyl group and a naphthyl group. This may include an alkoxy group having a carbon number of 1 to 4, an alkyl group having a carbon number of 1 to 4 or a halogen atom as a substituent. Specific examples include a phenoxy group, a 1-naphthyloxy group, a 2-naphthyloxy group, a 4-methoxyphenoxy group, and a 4-methylphenoxy group.

(5) Alkylmercapto group or arylmercapto group; specific examples thereof include a methylthio group, an ethylthio group, a phenylthio group, and p-methylphenylthio group.

(6) Group represented by the following General Formula (6):

General Formula (6)

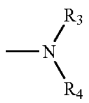

where $R_3$ and $R_4$ each represent independently a hydrogen atom, the alkyl group as defined in the (2), or an aryl group.

Examples of the aryl group include a phenyl group, a biphenyl group, and a naphthyl group, which may be substituted by an alkoxy group having a carbon number of 1 to 4, an alkyl group having a carbon number of 1 to 4, or a halogen atom. $R_3$ and $R_4$ may form a ring together with each other.

Specific examples thereof include an amino group, a diethylamino group, a N-methyl-N-phenyl amino group, a N,N-diphenylamino group, a N,N-di(tolyl)amino group, a dibenzylamino group, a piperidino group, a morpholino group and a pyrrolidino group.

(7) An alkylenedioxy group and an alkylenedithio group, such as a methylenedioxy group and a methylenedithio group.

(8) A substituted or unsubstituted styryl group, a substituted or unsubstituted β-phenylstyryl group, a diphenylaminophenyl group, a ditolylaminophenyl group, etc.

The arylene groups represented by $AR_1$ or $AR_2$ are divalent groups derived from the aryl groups represented by $AR_3$ or $AR_4$.

The X represents a single bond, a substituted or unsubstituted alkylene group, a substituted or unsubstituted cycloalkylene group, a substituted or unsubstituted alkylene ether group, an oxygen atom, a sulfur atom or vinylene group.

The substituted or unsubstituted alkylene group is a straight-chain or branched-chain alkylene group having a carbon number of preferably 1 to 12, more preferably 1 to 8, and most preferably 1 to 4: the alkylene group may further include a fluorine atom, a hydroxyl group, a cyano group, an alkoxy group having a carbon number of 1 to 4, a phenyl group, a halogen atom, an alkyl group having a carbon number of 1 to 4 or a phenyl group substituted by an alkoxy group having a carbon number of 1 to 4. Specific examples of the alkylene group include a methylene group, an ethylene group, a n-butylene group, an i-propylene group, a t-butylene group, a s-butylene group, a n-propylene group, a trifluoromethylene group, 2-hydroxyethylene group, 2-ethoxyethylene group, a 2-cyanoethylene group, a 2-methoxyethylene group, a benzylidene group, a phenylethylene group, a 4-chlorophenylethylene group, a 4-methylphenylethylene group, and a 4-biphenylethylene group.

The substituted or unsubstituted cycloalkylene group is cyclic alkylene groups having a carbon number of 5 to 7, and these cyclic alkylene groups may include a fluorine atom, a hydroxyl group, a cyano group, an alkyl group having a carbon number of 1 to 4, and an alkoxy group having a carbon number of 1 to 4. Specific examples thereof include a cyclohexylidene group, a cyclohexylene group, and a 3,3-dimethylcyclohexylidene group.

Examples of the substituted or unsubstituted alkylene ether group include alkyleneoxy groups such as ethyleneoxy and propylenoxy, alkylenedioxy groups derived from ethyleneglycol, propyleneglycol, etc., and di or poly(oxyalkylene)oxy groups derived from diethylenegycol, tetraethyleneglycol, tripropyleneglycol, etc. The alkylene group of the alkylene ether group may include a substituent such as a hydroxyl group, a methyl group and an ethyl group.

The vinylene group is preferably a group represented by the following general formula:

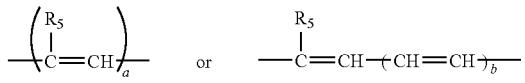

where $R_5$ represents a hydrogen atom, an alkyl group which is the same as defined in the (2), or an aryl group which is the same as the aryl group represented by $Ar_3$ or $Ar_4$; "a" represents 1 or 2, and "b" represents 1 to 3.

Z represents a substituted or unsubstituted alkylene group, a substituted or unsubstituted divalent alkylene ether group or a divalent alkyleneoxycarbonyl group.

The substituted or unsubstituted alkylene group includes the alkylene groups as those of the X.

The substituted or unsubstituted divalent alkylene ether group includes the divalent alkylene ether groups of the X.

The divalent alkyleneoxycarbonyl group includes divalent caprolactone-modified groups.

Still preferably, the radically polymerizable compound with one functional group that has a charge transporting structure is, for example, a compound represented by the following General Formula (7):

General Formula (7)

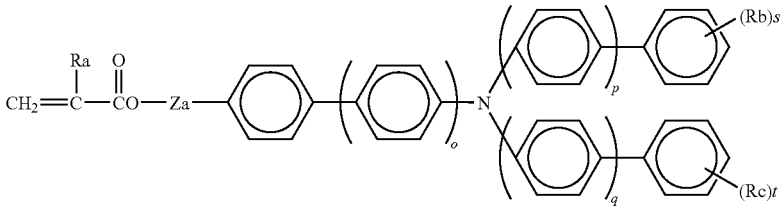

where o, p and q each represent 0 or 1; Ra represents a hydrogen atom or a methyl group; Rb and Rc represent a substituent other than a hydrogen atom which is an alkyl group having a carbon number of 1 to 6 and may be different when they are two or more; "s" and "t" represent an integer of 0 to 3; and Za represents a single bond, a methylene group, an ethylene group, or a group represented by the following structural formulae.

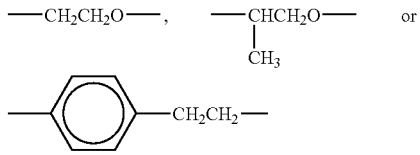

The compound represented by General Formula (7) is preferably a compound in which Rb and Rc as a substituent are each a methyl group or an ethyl group.

The monofunctional radically polymerizable compounds having a charge transport structure represented by General Formulae (4), (5), and (7), particularly, General Formula (7) do not attach to terminal sites of crosslinking structure since the polymerization is accomplished by the opening of the carbon-carbon double bond at both sides, but are incorporated into a continuous polymer chain. In the crosslinked polymer formed as a result of polymerization with the radically polymerizable monomer having three or more functional groups, the monofunctional radically polymerizable compound exists at the main chain of the polymer or at the crosslinking chain between main chains (the crosslinking chain includes an intermolecular crosslinking chain between polymers and an intramolecular crosslinking chain that connects a certain site of folded main chain in a polymer and another site in the main chain which is part of a monomer joined distant from the certain site). In both cases of existence at the main chain and at the crosslinking chain, the triarylamine structure attached to the chain has at least three aryl groups arranged radially from the nitrogen atom and is bulky. Since the triarylamine structure is not bonded to the chain directly but through the carbonyl group and is fixed in a sterically-flexible state, the triarylamine structures can be spatially arranged in the polymer in such a manner that they adjoin properly to each other, resulting in less structural distortion in the molecule. When the triarylamine structure is incorporated in the surface layer of an electrophotographic photoconductor, it is assumed that the triarylamine structure can adopt a structure that relatively free from the loss of charge transport path.

Specific examples of the radically polymerizable compound with one functional group and a charge transporting structure of the present invention are listed below, but are not limited to the compounds having these structures.

No. 1

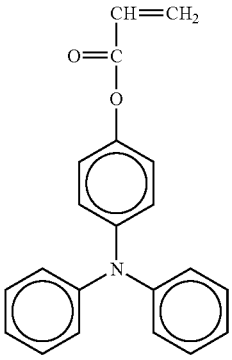

No. 2

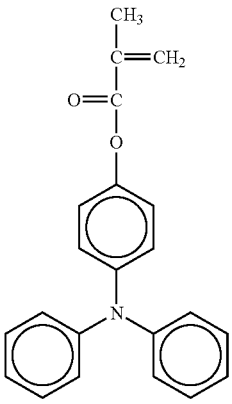

-continued

No. 3

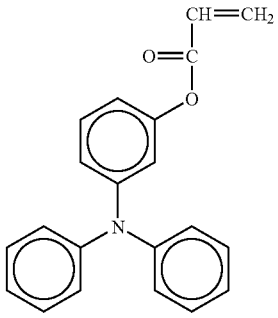

No. 4

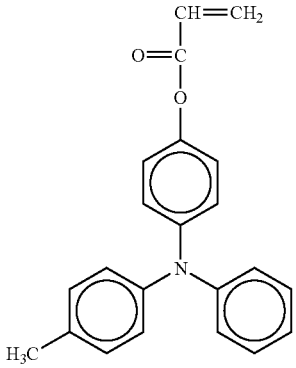

No. 5

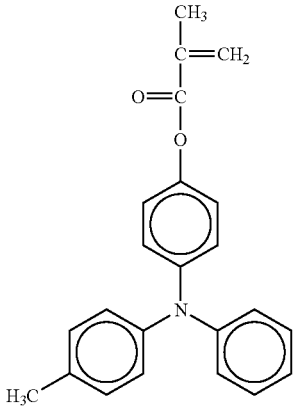

No. 6

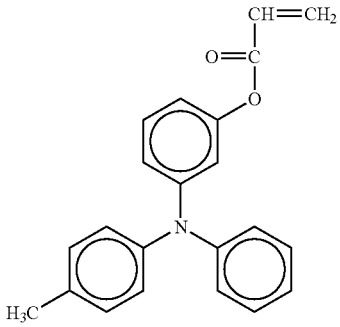

-continued
No. 7
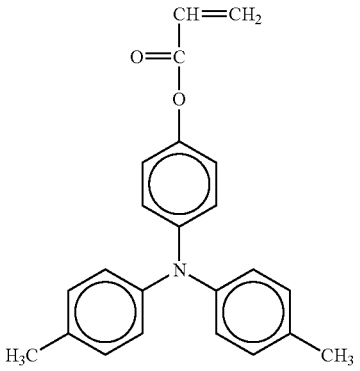
No. 8
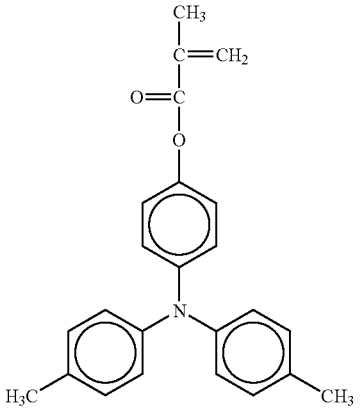
No. 9
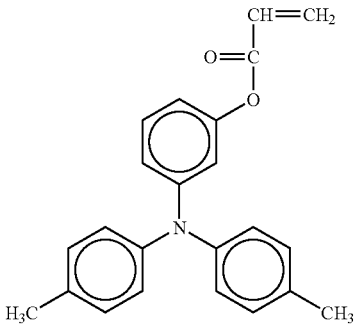
No. 10
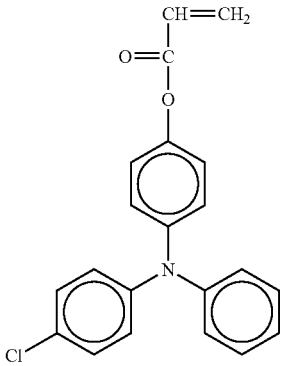
-continued
No. 11
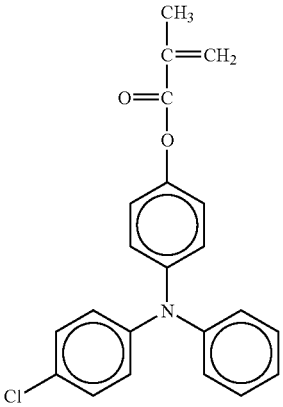
No. 12
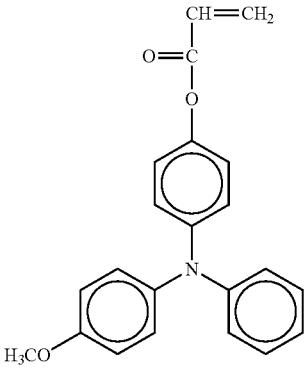
No. 13
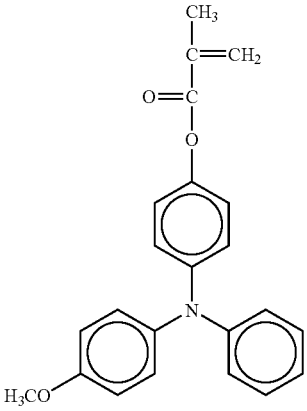
No. 14
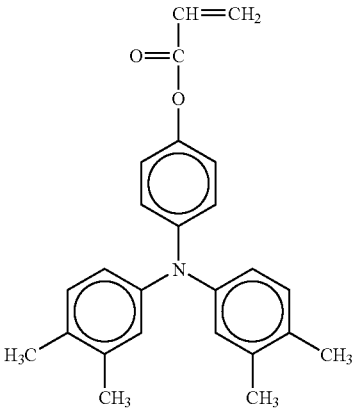

-continued
No. 15
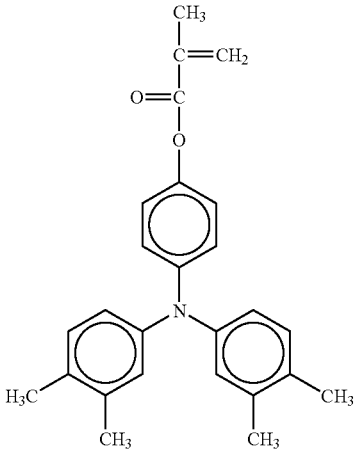
No. 16
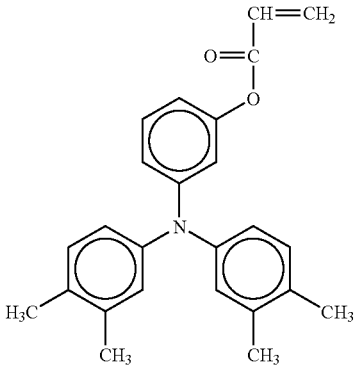
No. 17
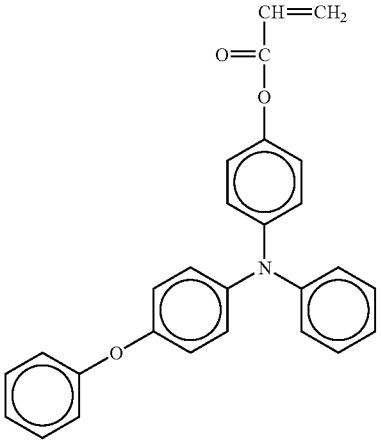
-continued
No. 18
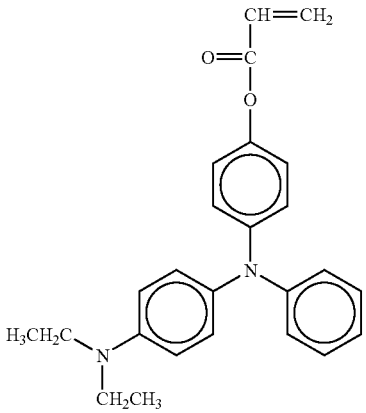
No. 19
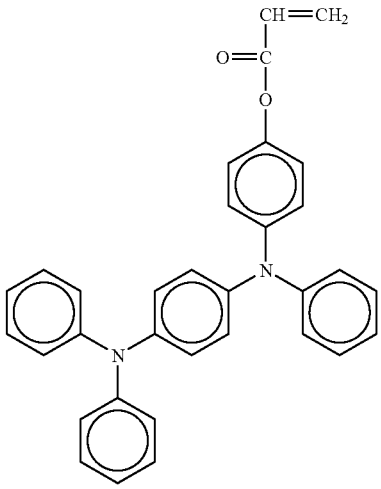
No. 20
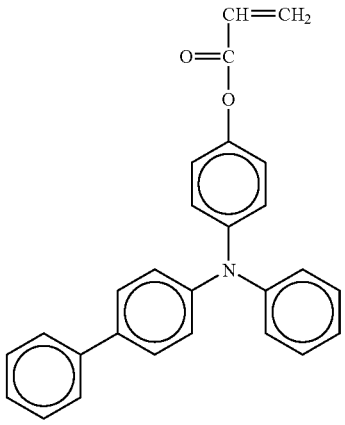

-continued
No. 21
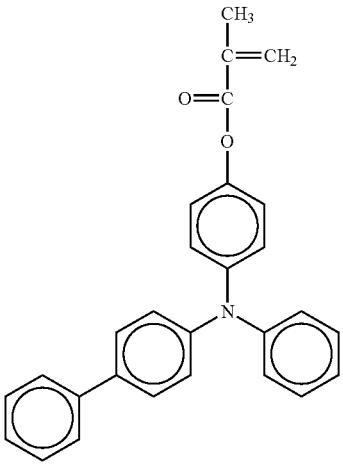
No. 22
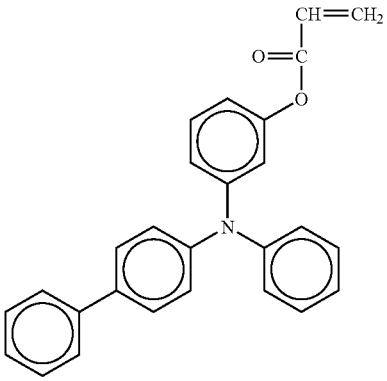
No. 23
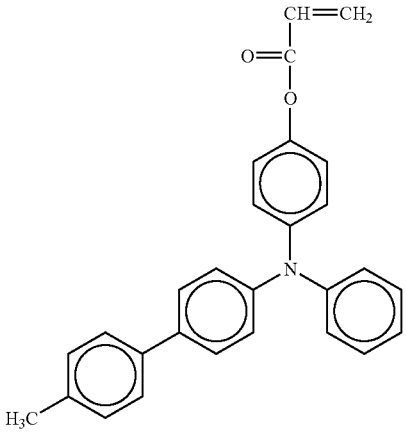
-continued
No. 24
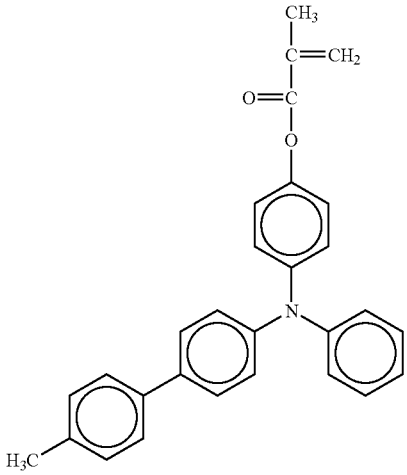
No. 25
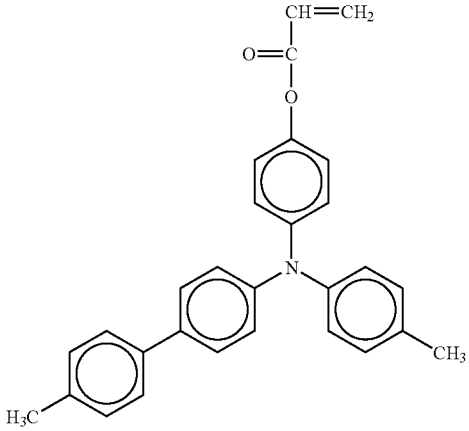
No. 26
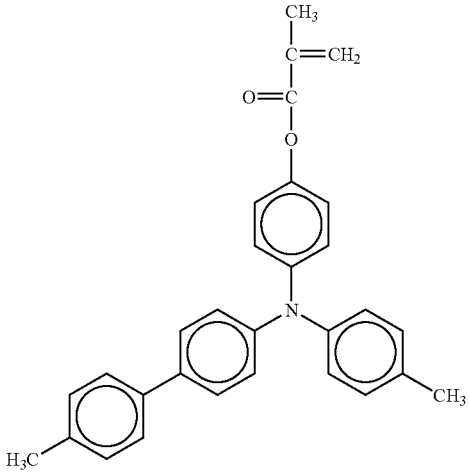

-continued
No. 27
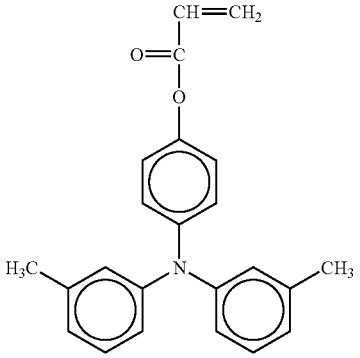
No. 28
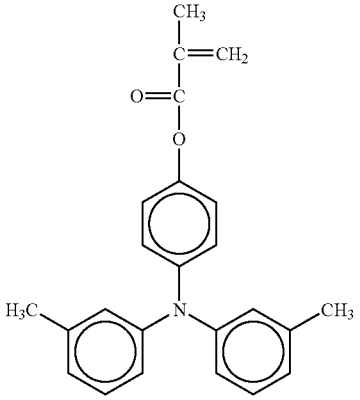
No. 29
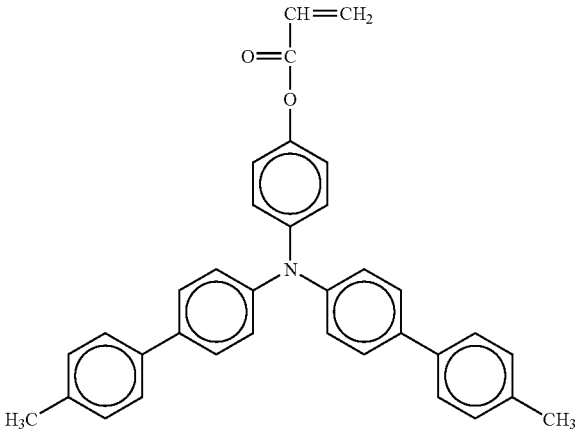
No. 30
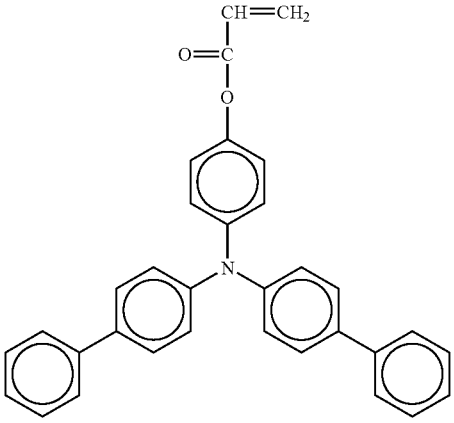
-continued
No. 31
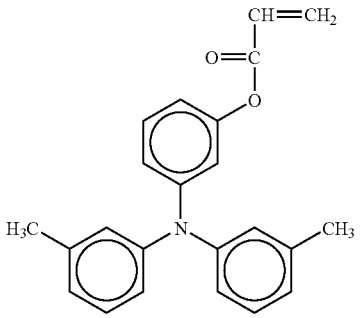
No. 32
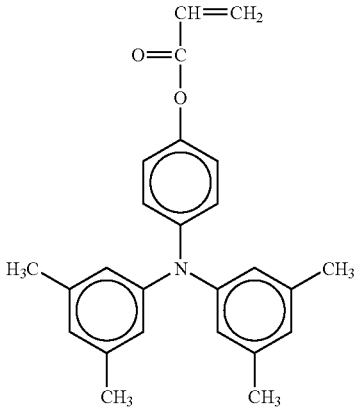
No. 33
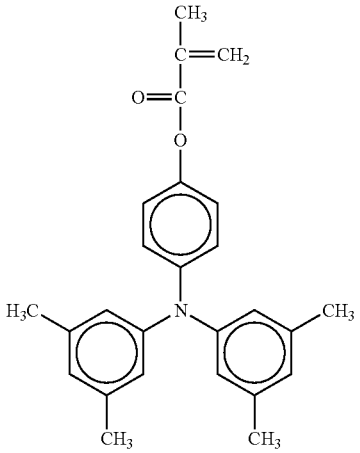
No. 34
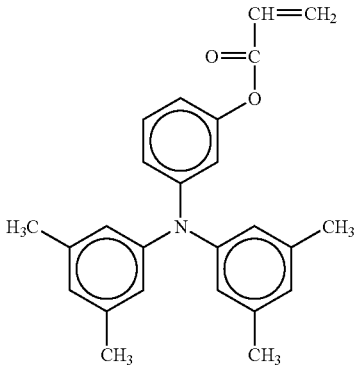

-continued
No. 35
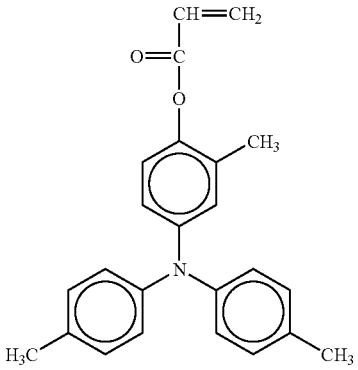
No. 36
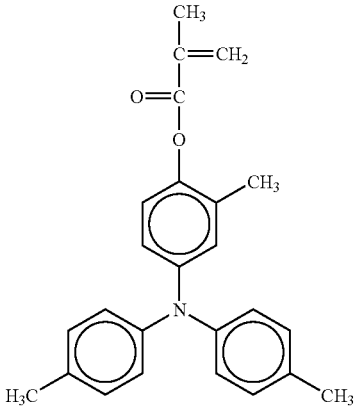
No. 37
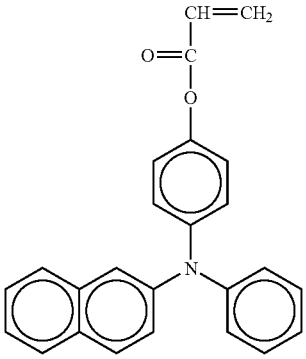
No. 38
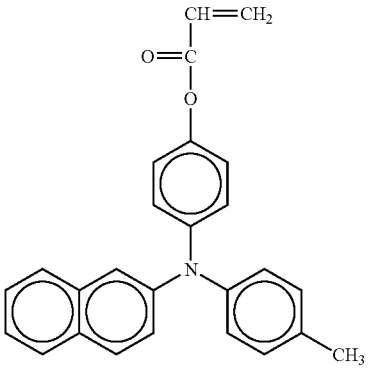
-continued
No. 39
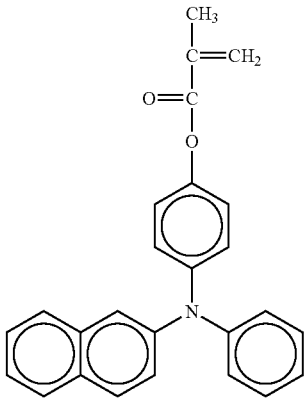
No. 40
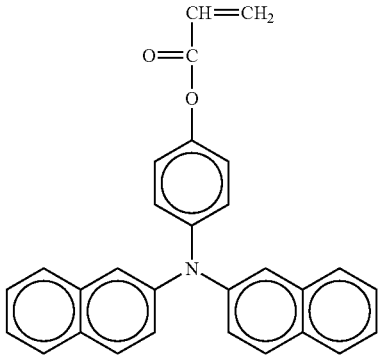
No. 41
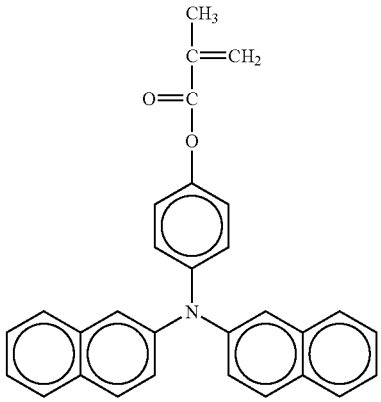

-continued
No. 42
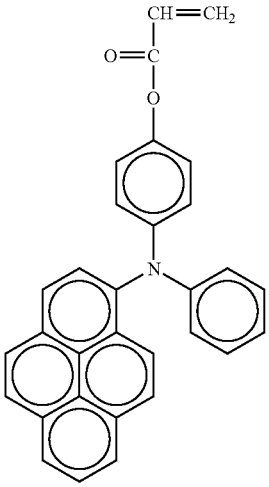
No. 43
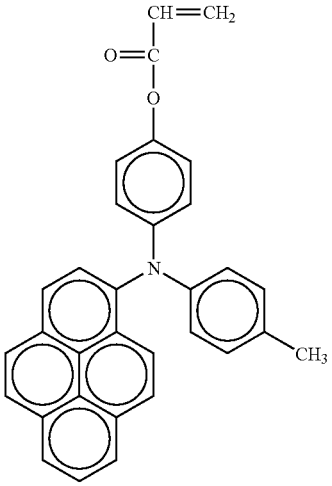
No. 44
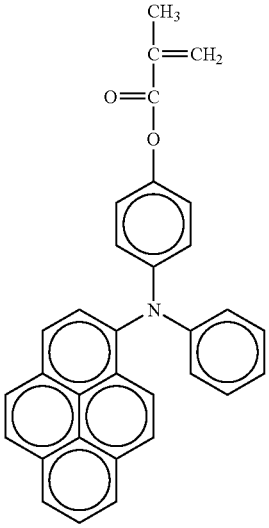
-continued
No. 45
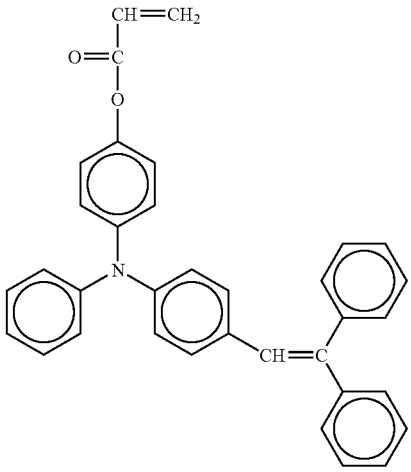
No. 46
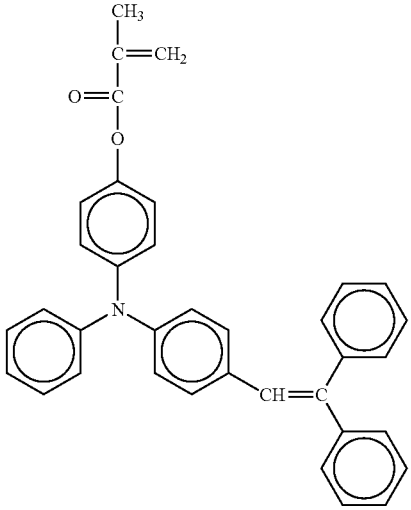
No. 47
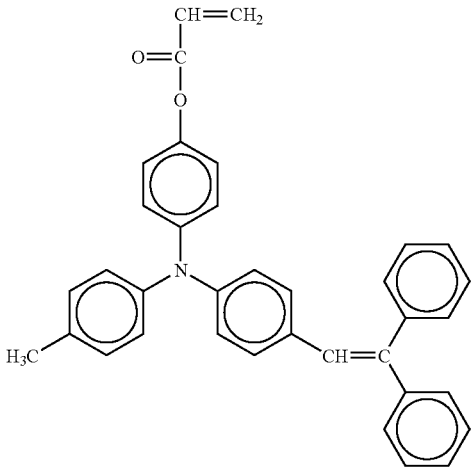

-continued
No. 48
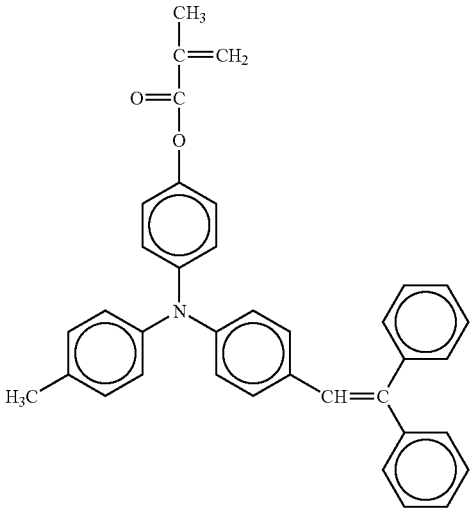
No. 49
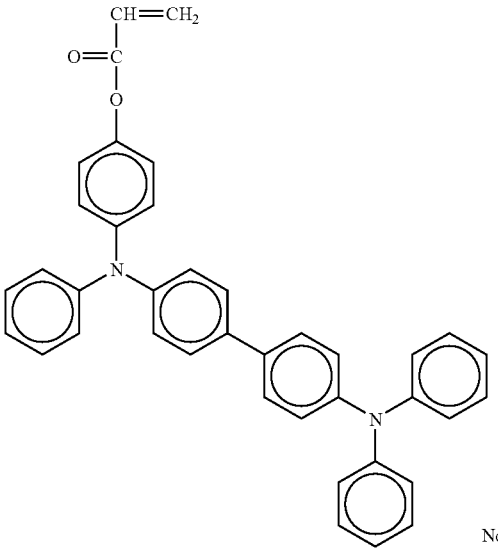
No. 50
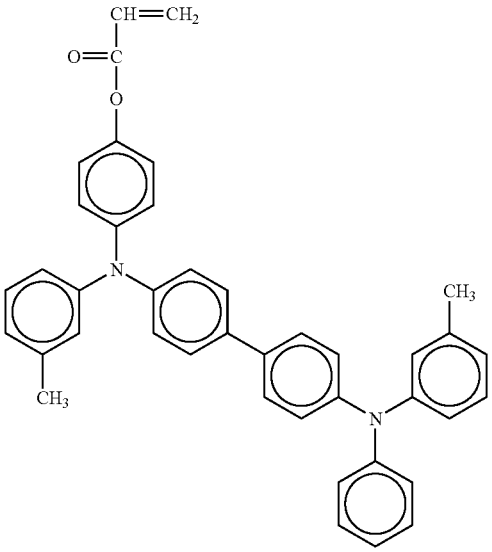
-continued
No. 51
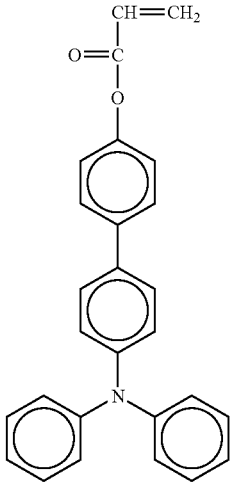
No. 52
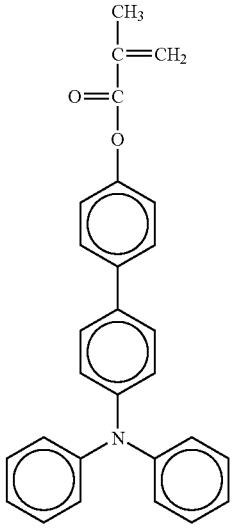
No. 53
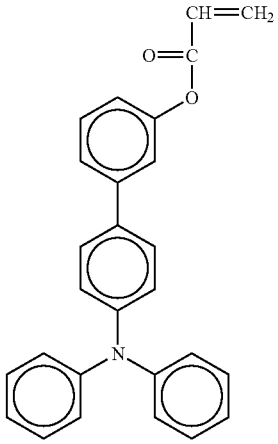

-continued
No. 54
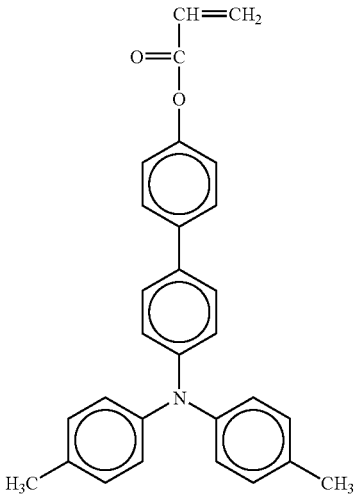
No. 55
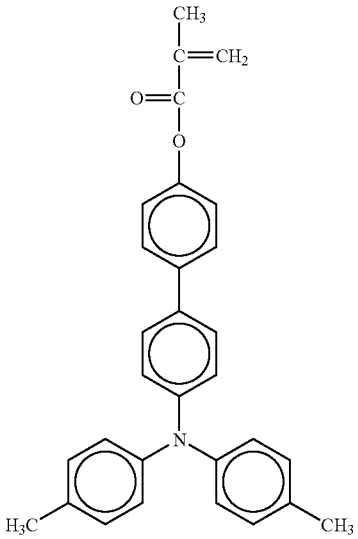
No. 56
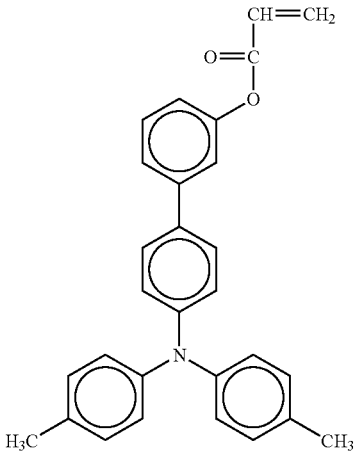
-continued
No. 57
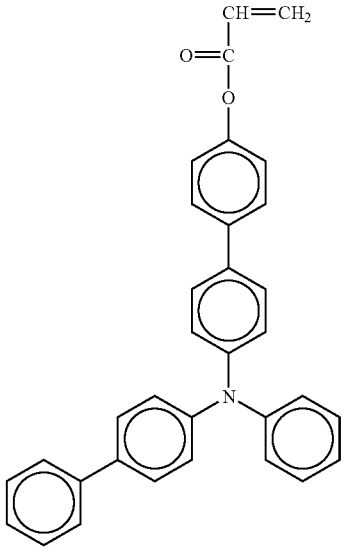
No. 58
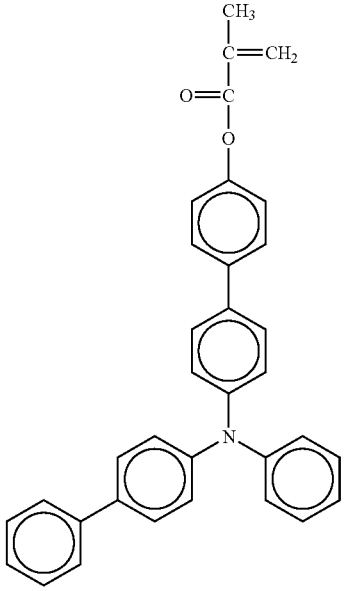

-continued
No. 59
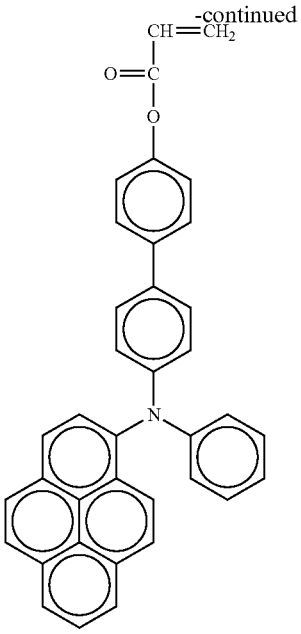
No. 60
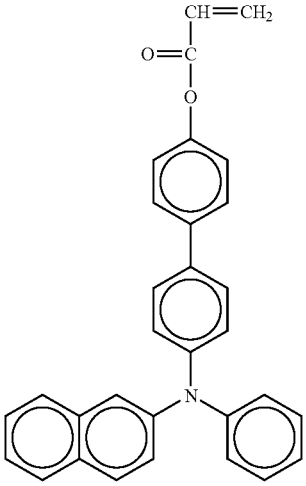
No. 61
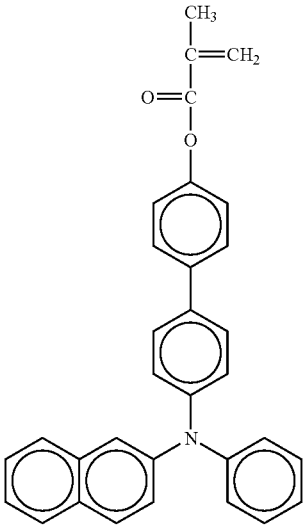
-continued
No. 62
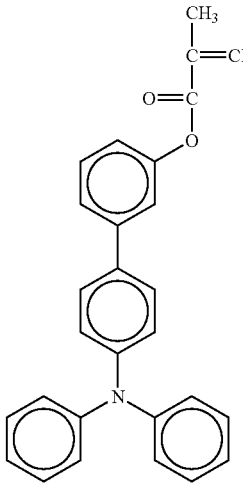
No. 63
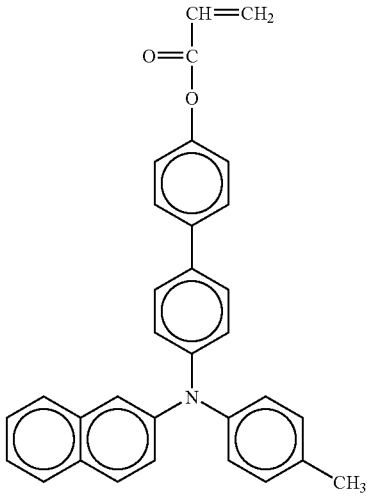
No. 64
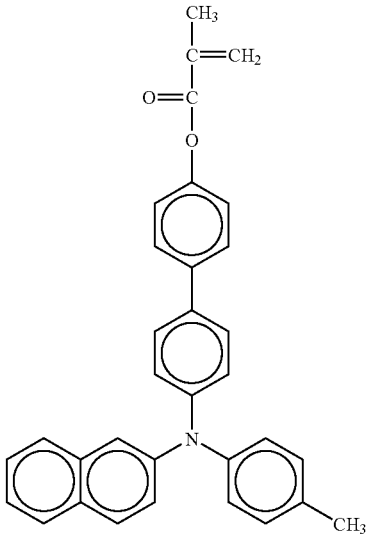

-continued
No. 65
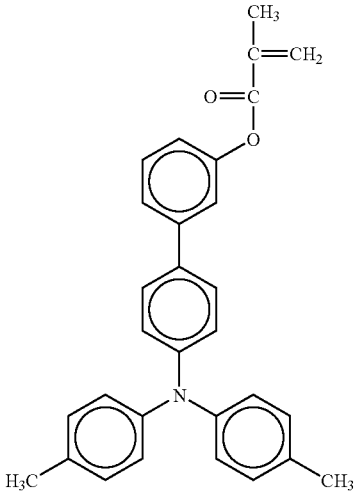
No. 66
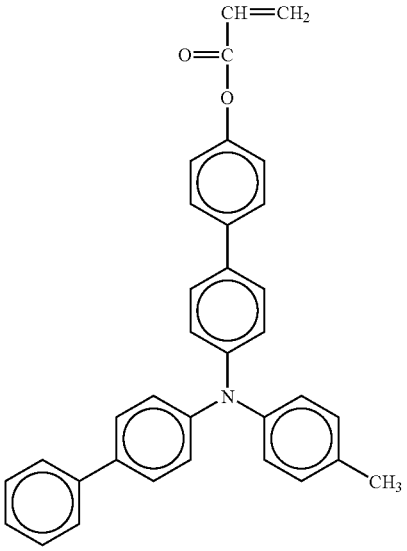
No. 67
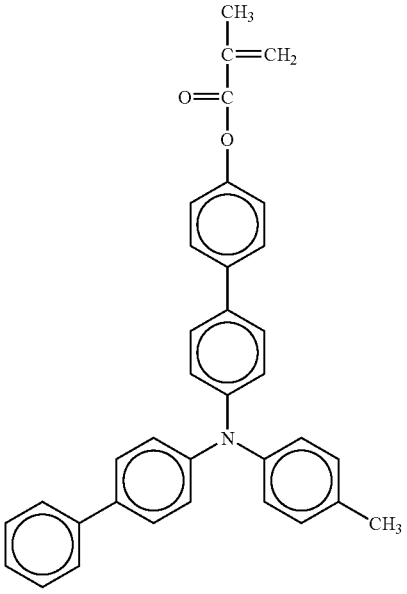
-continued
No. 68
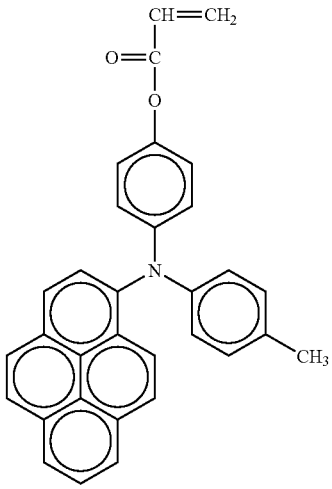
No. 69
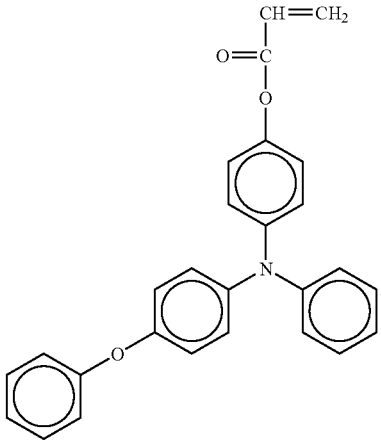
No. 70
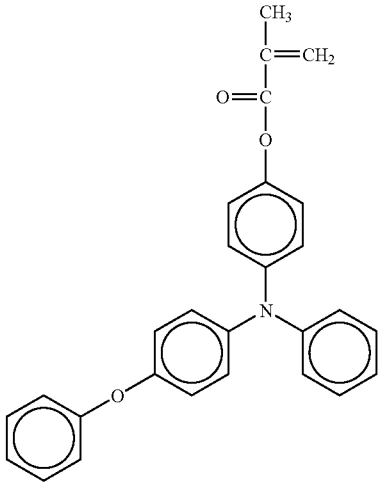

-continued
No. 71
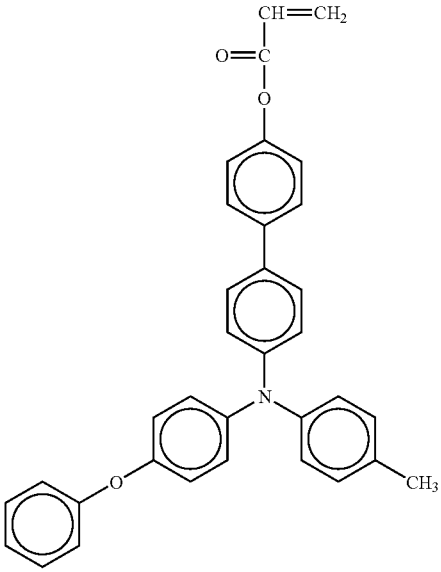
No. 72
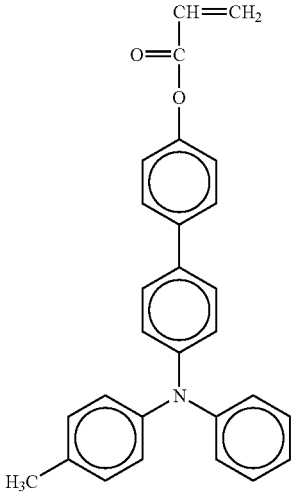
No. 73
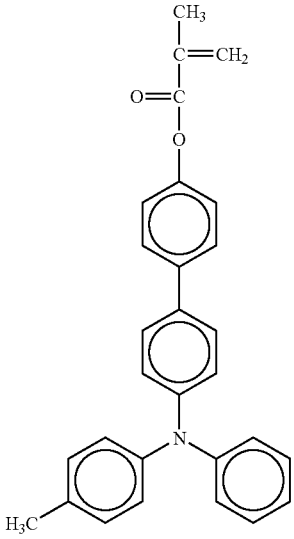
-continued
No. 74
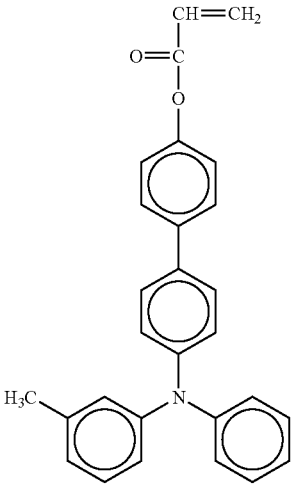
No. 75
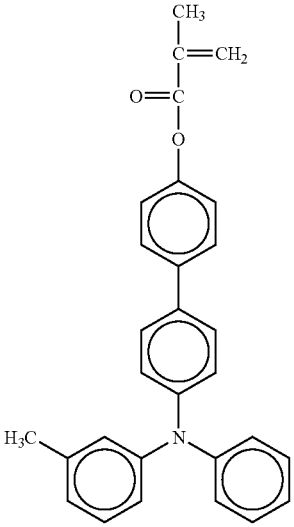
No. 76
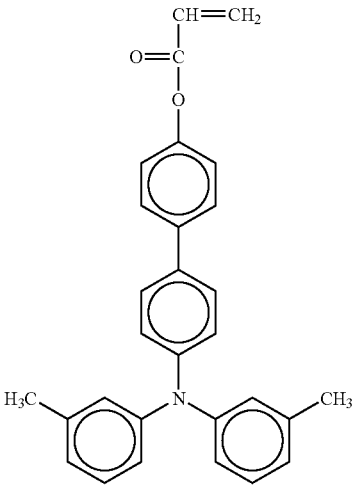

-continued
No. 77
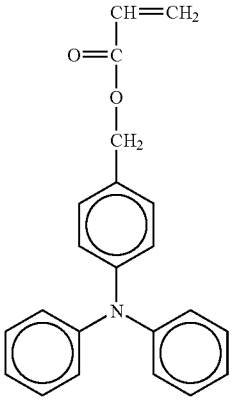
No. 78
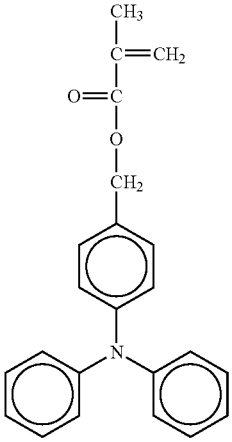
No. 79
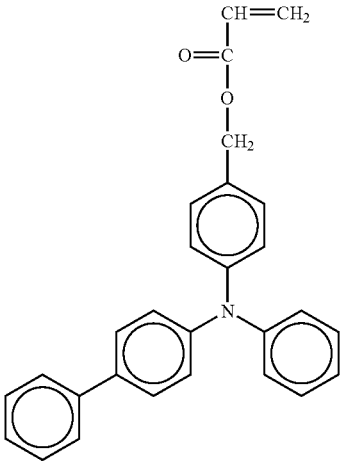
-continued
No. 80
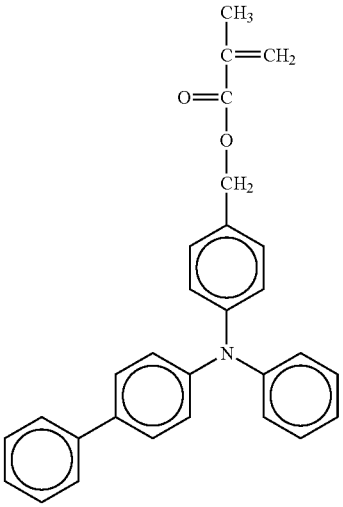
No. 81
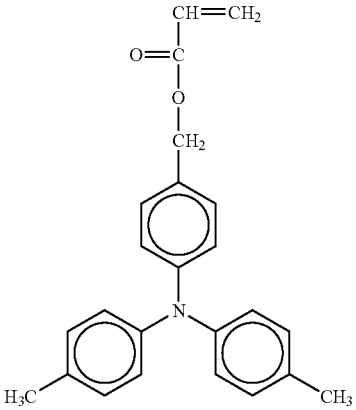
No. 82
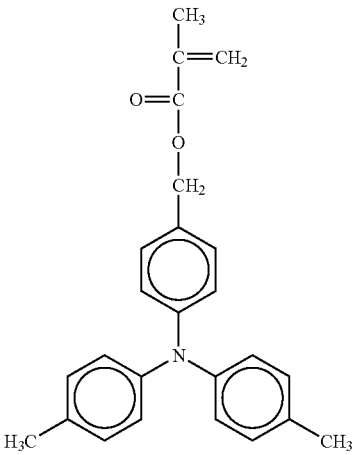

-continued
No. 83
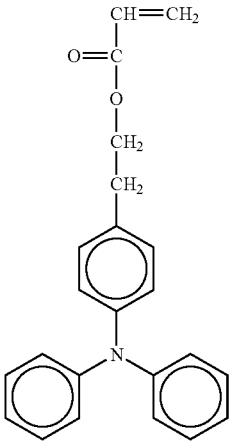
No. 84
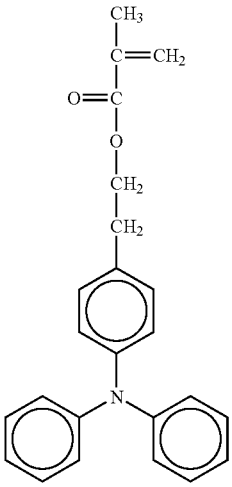
No. 85
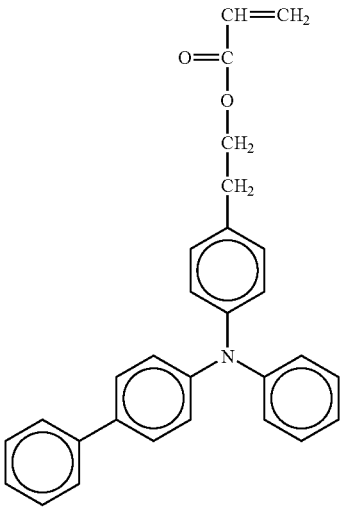
-continued
No. 86
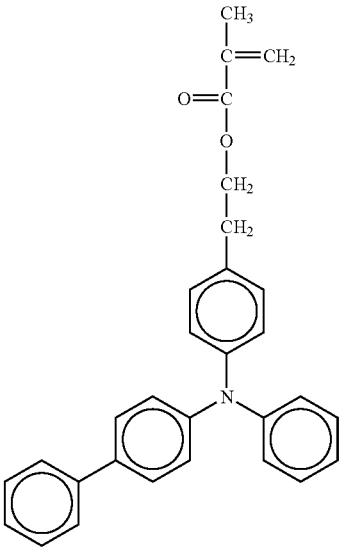
No. 87
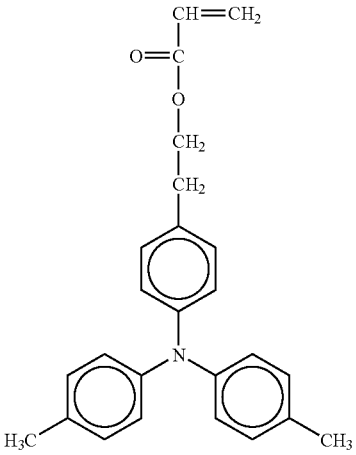
No. 88
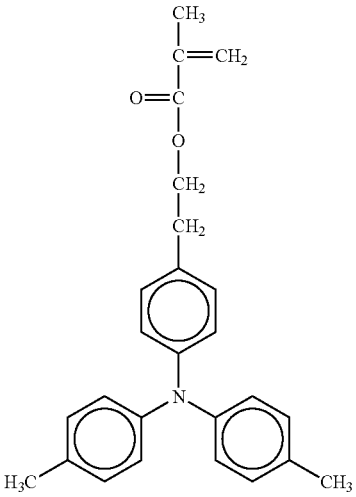

-continued
No. 89
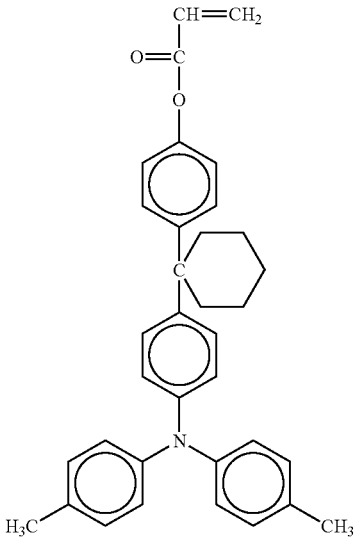
-continued
No. 91
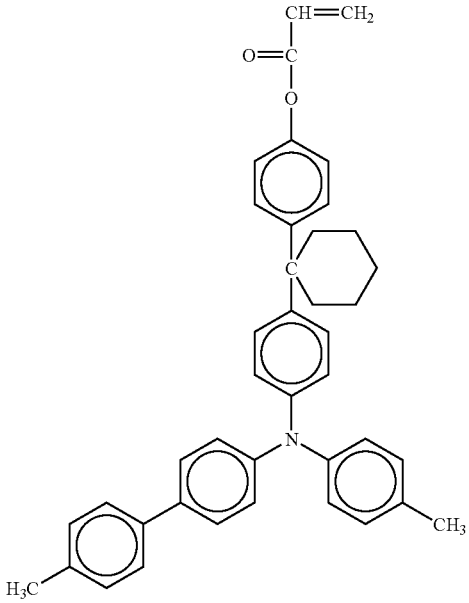
No. 90
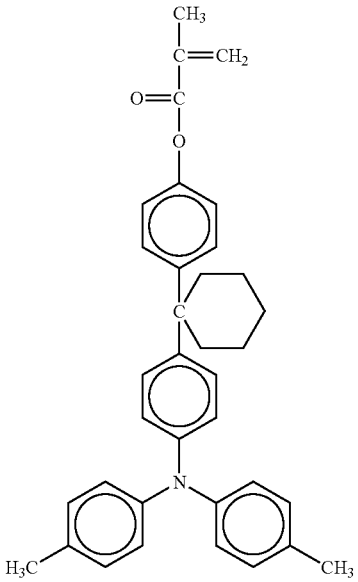
No. 92
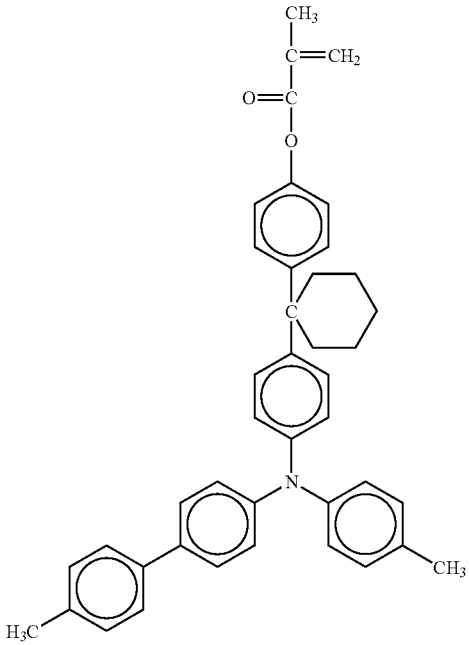

-continued
No. 93
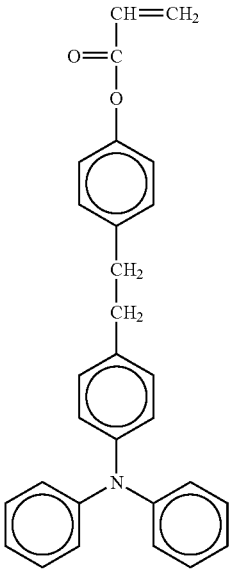
No. 94
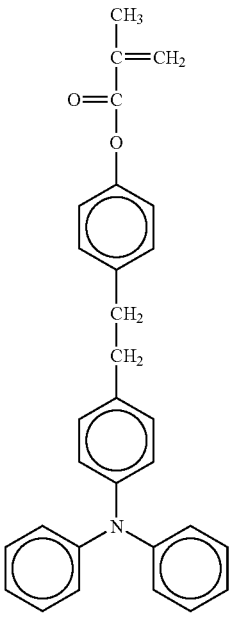
-continued
No. 95
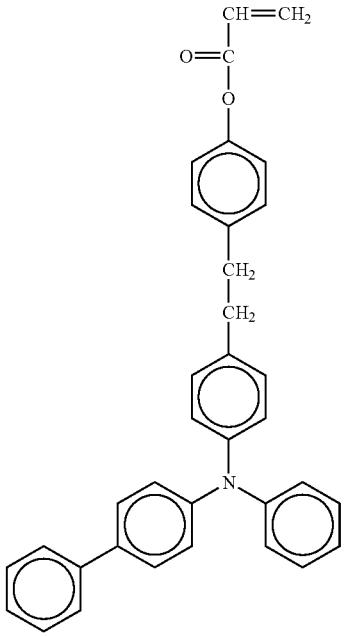
No. 96
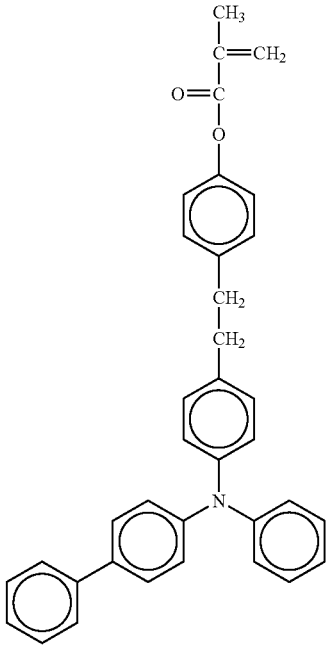

-continued
No. 97
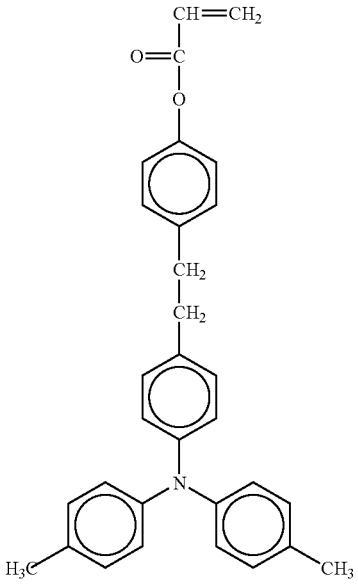
No. 98
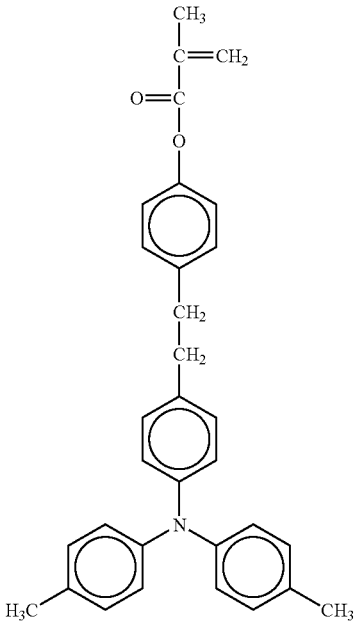
-continued
No. 99
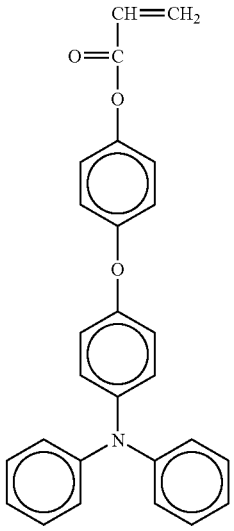
No. 100
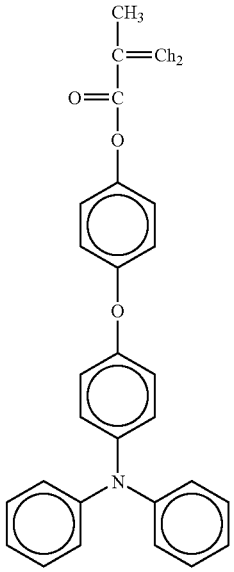

-continued
No. 101
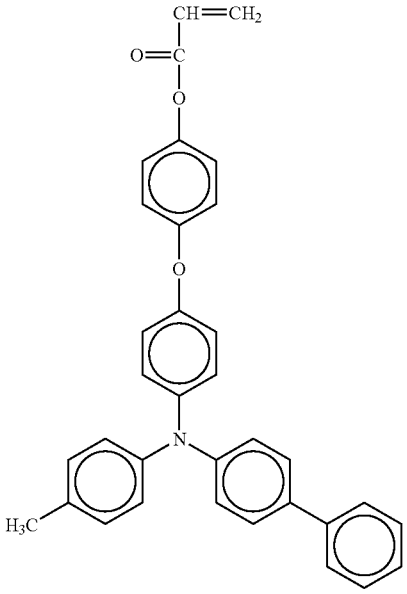
-continued
No. 103
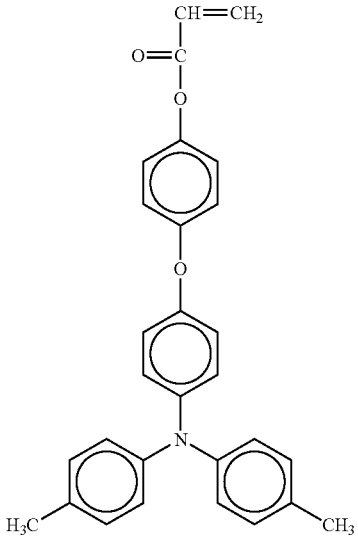
No. 102
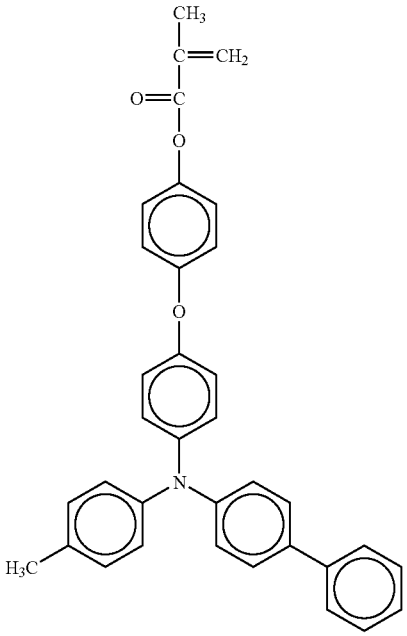
No. 104
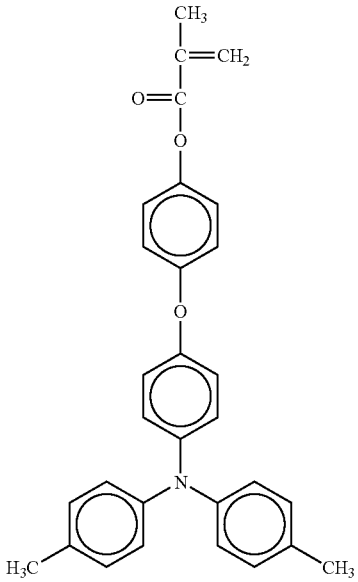

-continued
No. 105
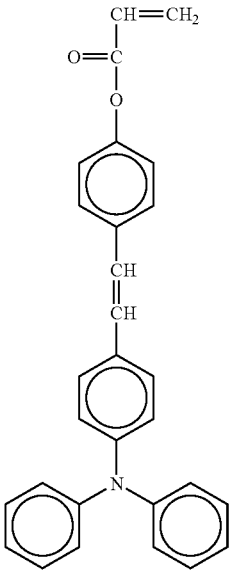
No. 106
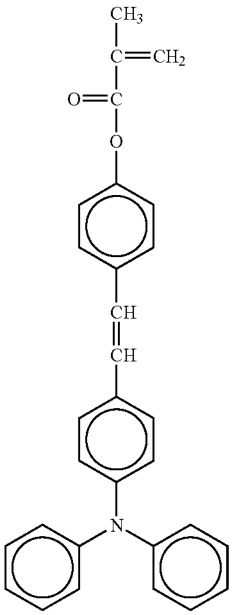
-continued
No. 107
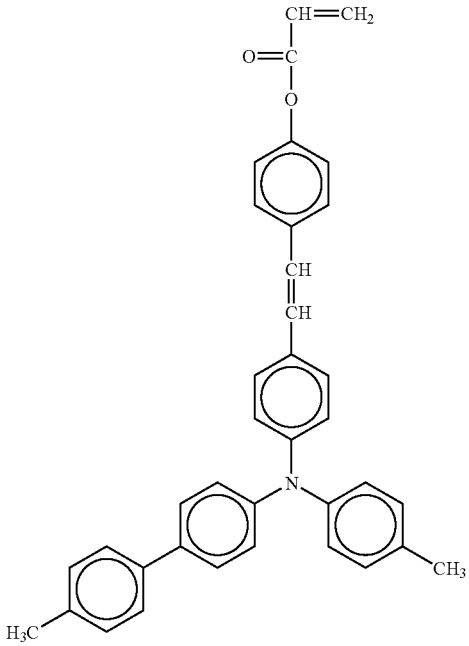
No. 108
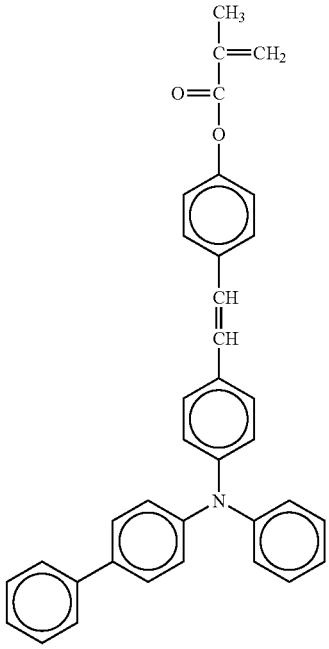

-continued
No. 109
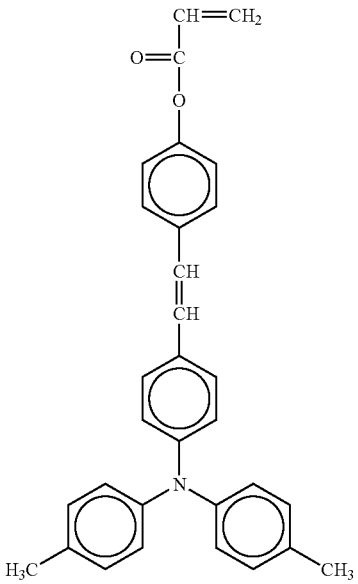
No. 110
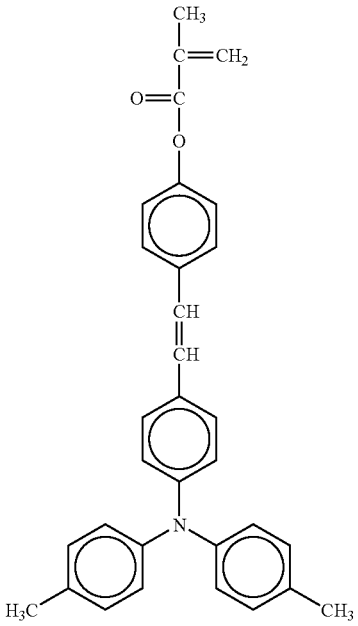
-continued
No. 111
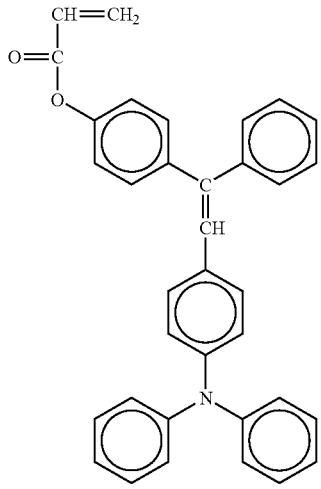
No. 112
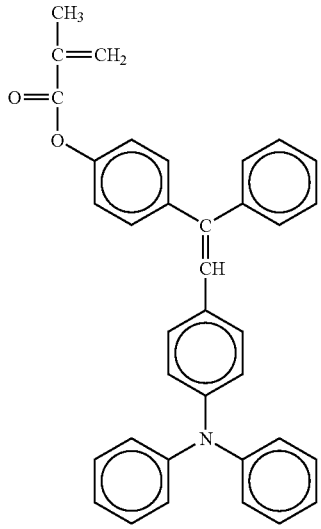
No. 113
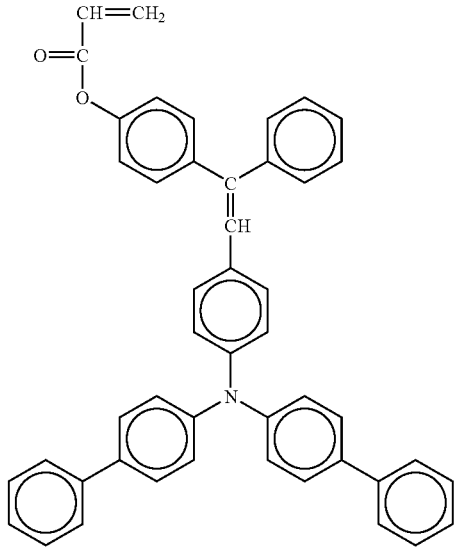

-continued
No. 114
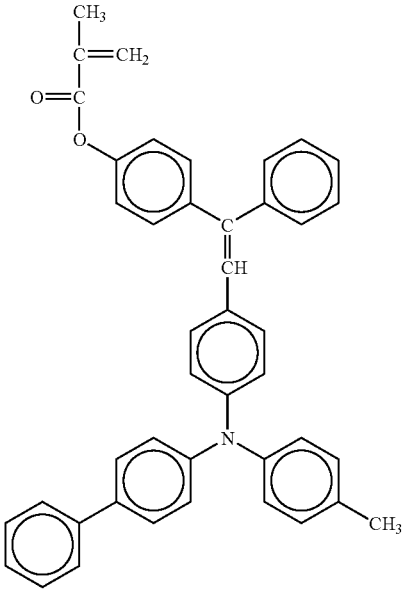
No. 115
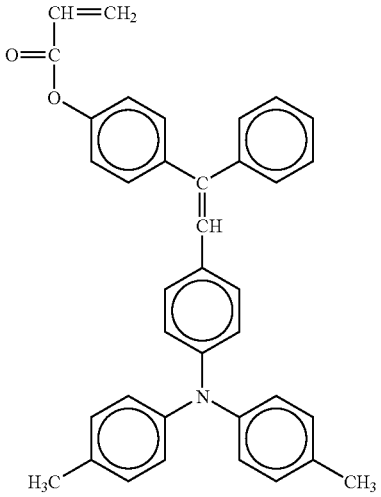
No. 116
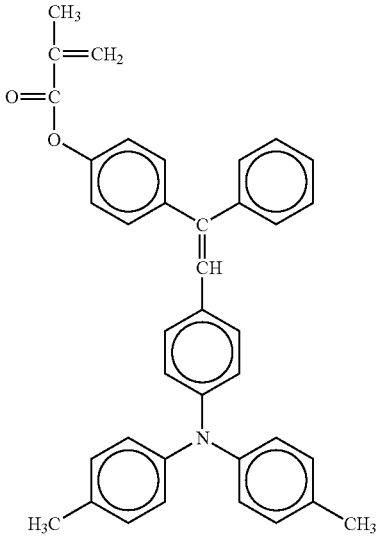
-continued
No. 117
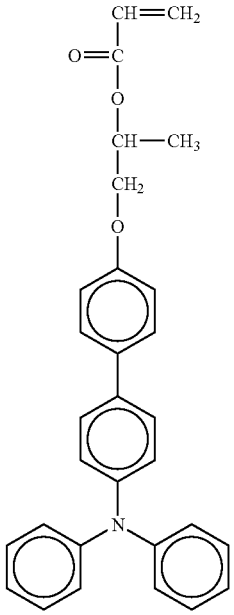
No. 118
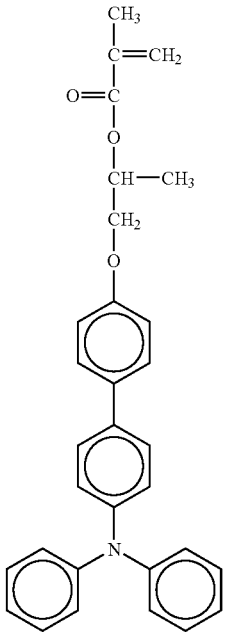

-continued
No. 119
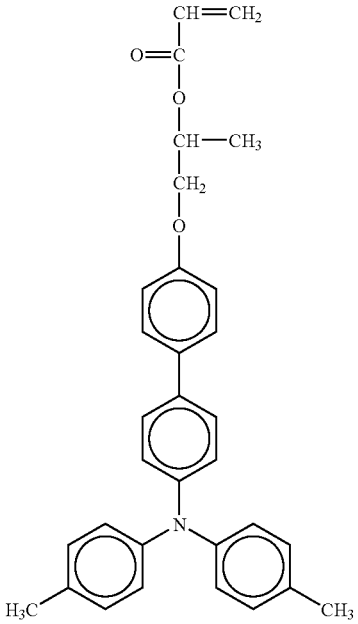
-continued
No. 121
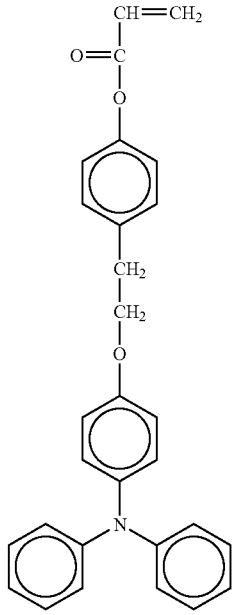
No. 120
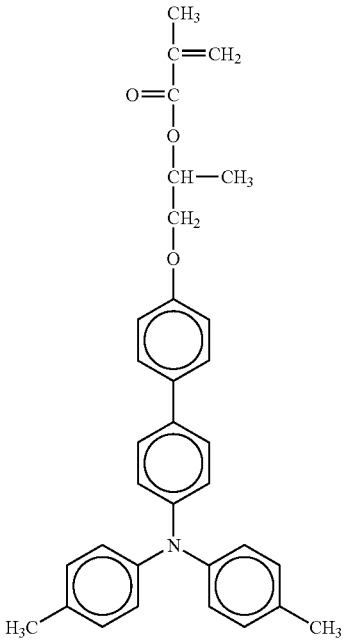
No. 122
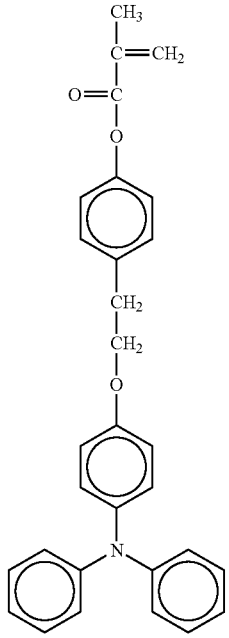

-continued
No. 123
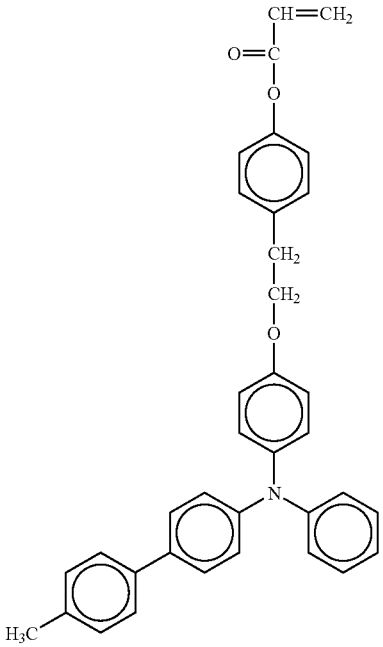
-continued
No. 125
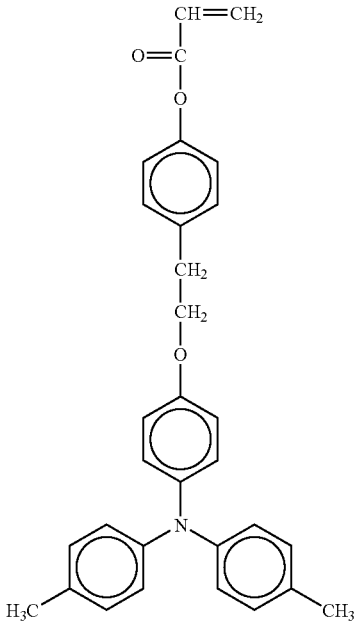
No. 124
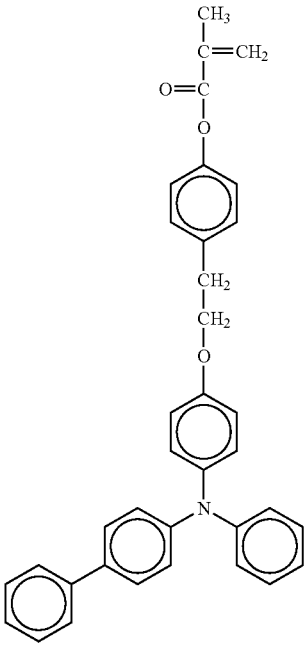
No. 126
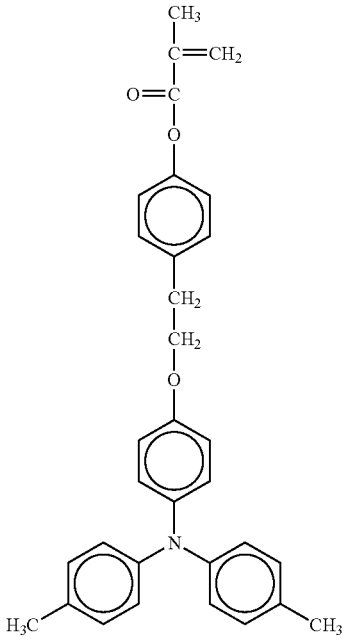

-continued
No. 127
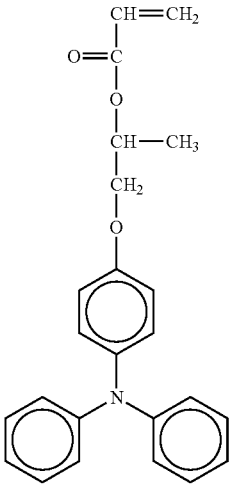
No. 128
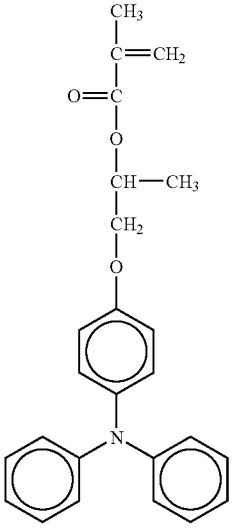
No. 129
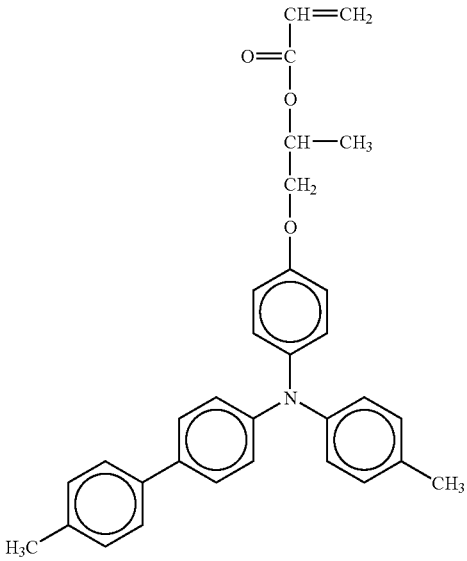
-continued
No. 130
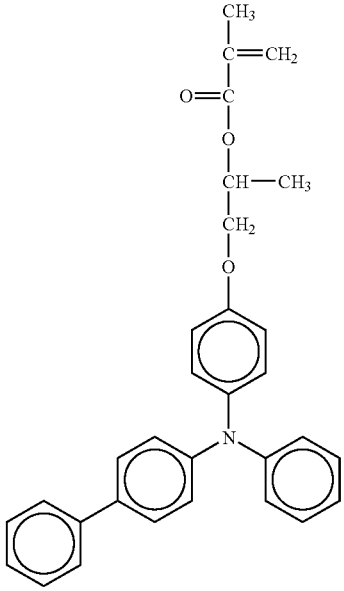
No. 131
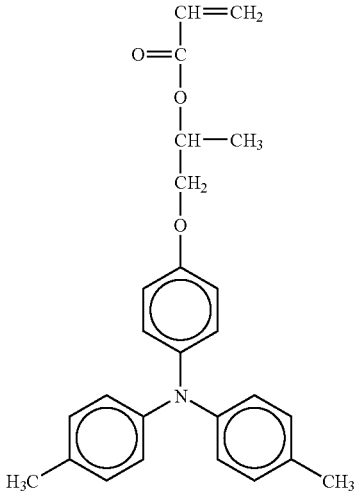
No. 132
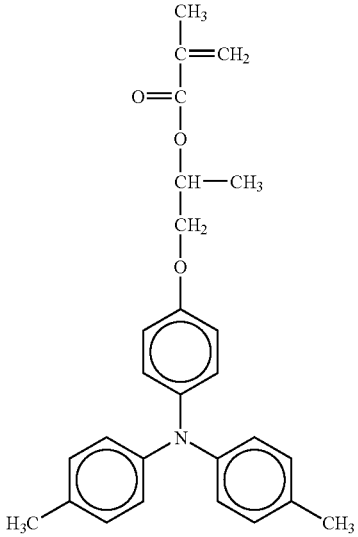

-continued
No. 133
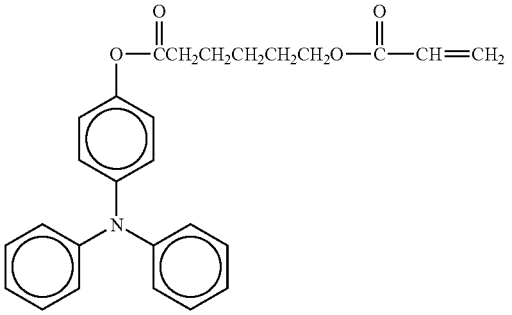
No. 134
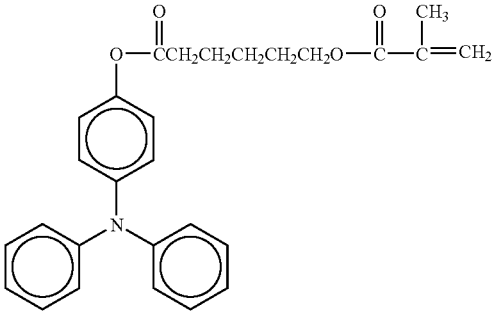
No. 135
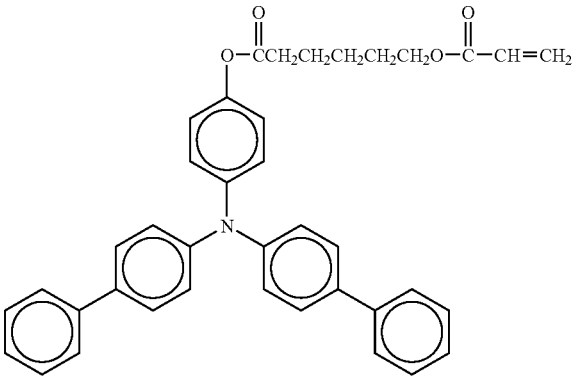
-continued
No. 136
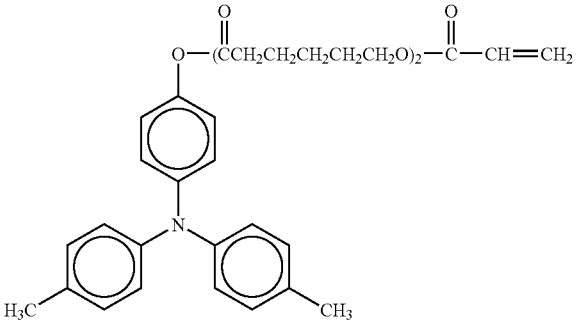
No. 137
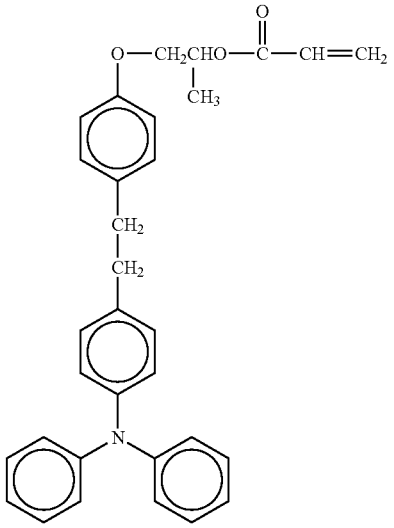
No. 138
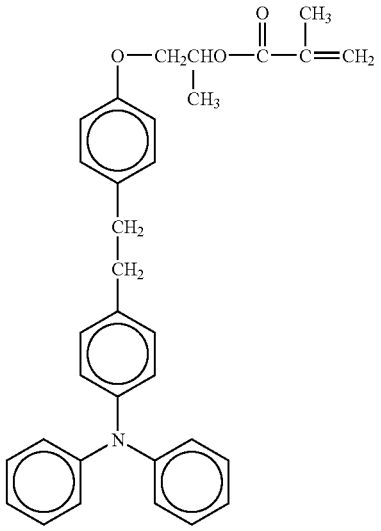

-continued
No. 139
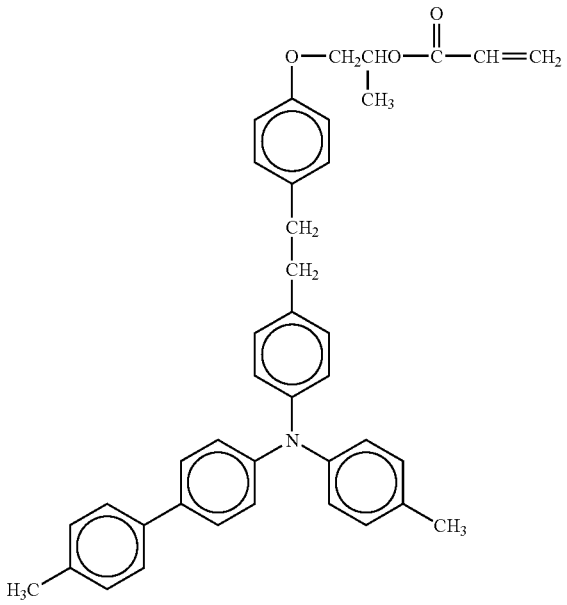
No. 140
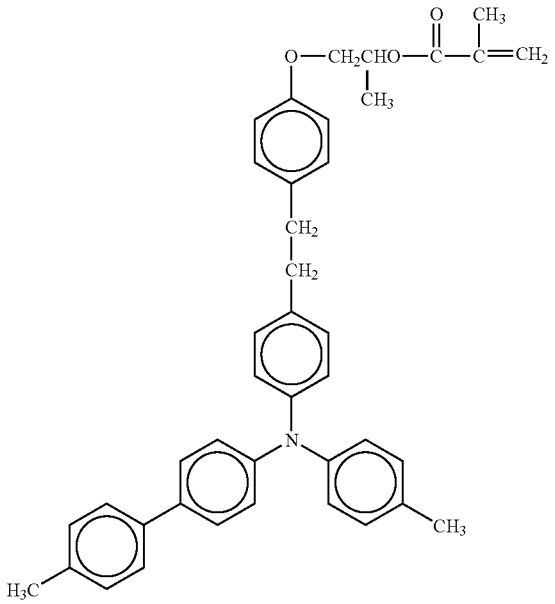
-continued
No. 141
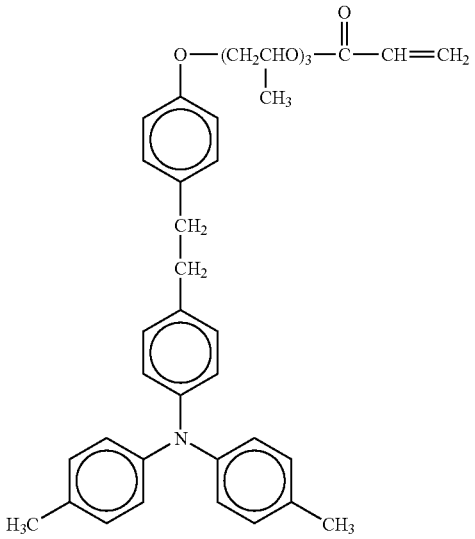
No. 142
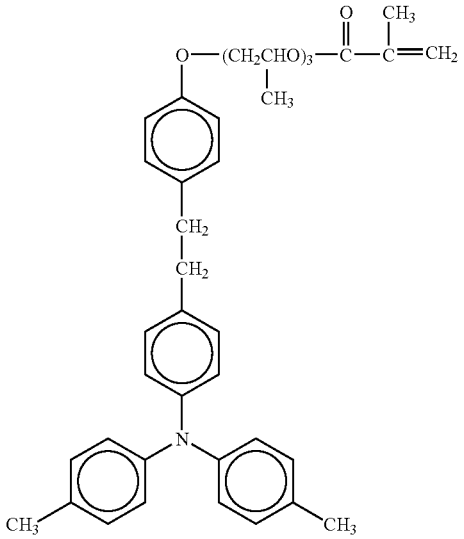
No. 143
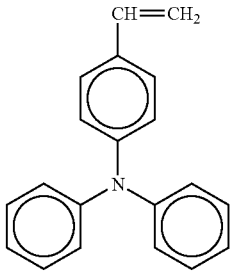

-continued
No. 144
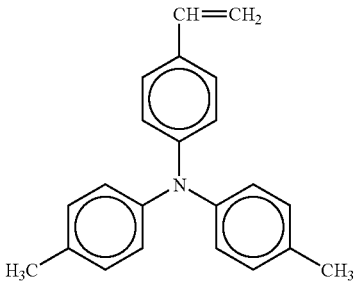
No. 145
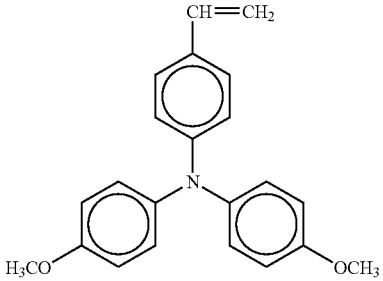
No. 146
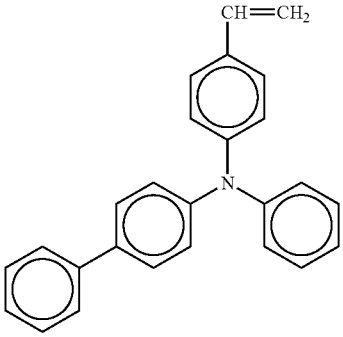
No. 147
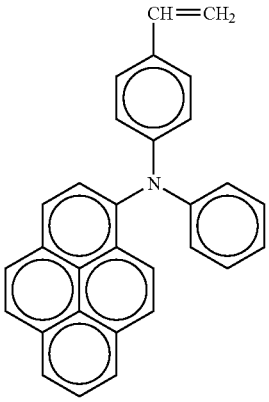
No. 148
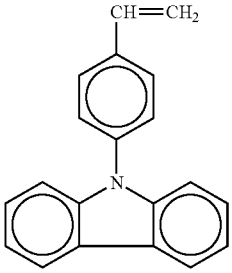
-continued
No. 149
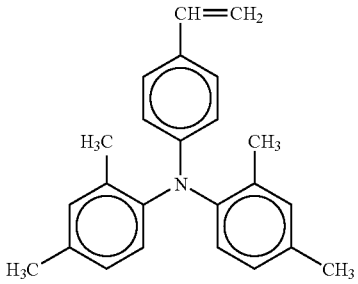
No. 150
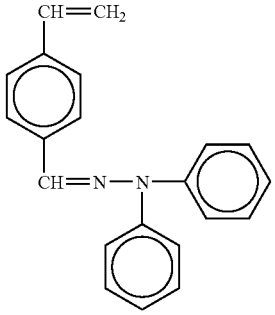
No. 151
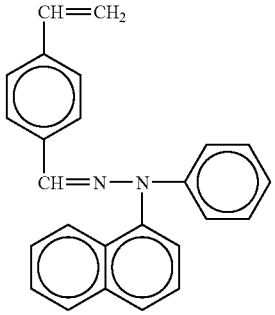
No. 152
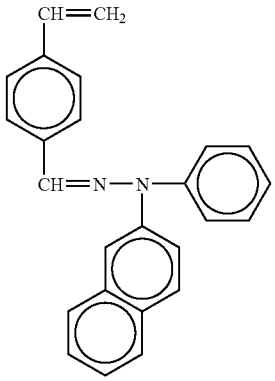
No. 153
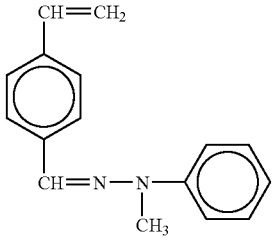

-continued

No. 154

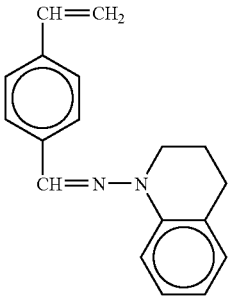

No. 155

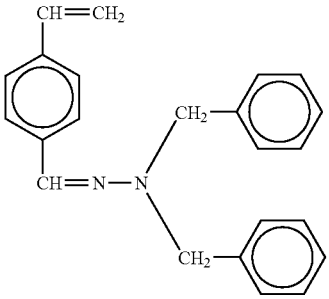

No. 156

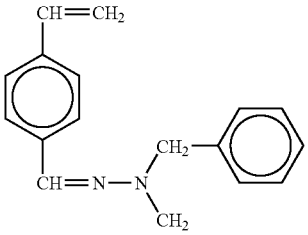

No. 157

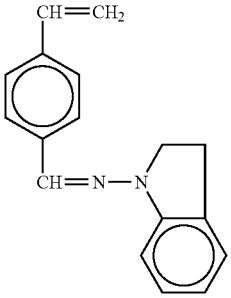

No. 158

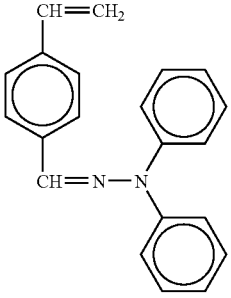

-continued

No. 159

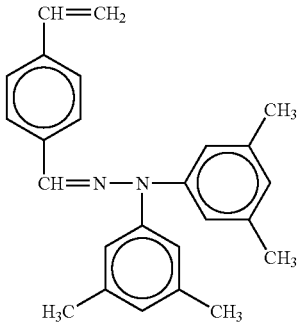

No. 160

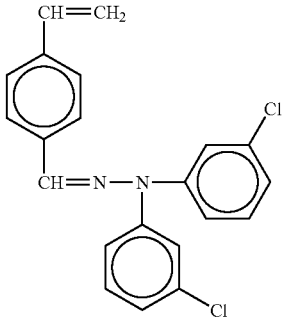

The radically polymerizable monomer with one functional group that has a charge transporting structure is essential for imparting charge transport property to the crosslinked charge transport layer. The amount of the radically polymerizable monomer with one functional group that has a charge transporting structure to be added is preferably 20% by mass to 80% by mass, and more preferably 30% by mass to 70% by mass, relative to the total mass of the crosslinked charge transport layer. When the amount is less than 20% by mass, the charge transport property of the crosslinked charge transport layer may not be sufficiently maintained, thus causing deterioration of electrical properties such as reduction of sensitivity and increase of rest potential under repeated usages. When the amount is more than 80% by mass, the content of the monomer with three or more functional groups that does not have a charge transporting structure is reduced, reduction of the crosslink density is invited and high abrasion resistance may not be attained. In view of the balance of the electrical properties and the abrasion resistance, the content is most preferably 30% by mass to 70% by mass, although required electrical properties and the abrasion resistance are different depending on a used process and the thickness of the crosslinked charge transporting layer of the photoconductor differs depending on the different electrical properties and the abrasion resistance.

The surface layer of the present invention is preferably a crosslinked surface layer in which the radically polymerizable monomer represented by the General Formula (A) and not having a charge transporting structure and the radically polymerizable compound with one functional group that has a charge transporting structure are cured. In this case, for the purpose of viscosity adjustment during coating of the surface layer, stress relaxation of the crosslinked surface layer, and providing features such as a low surface free energy and reduced coefficient of friction, radically polymerizable monomers and oligomers with one to four functional group(s) can be used in combination. This combinatorial use makes a radically polymerizable monomer that does not have a charge transporting structure or a surface layer coating solution to have a low viscosity, which makes the coated film smoother, resulting in smoothing and reduced distortion of the crosslinked surface layer. This leads to the improvement of cleaning ability and the suppression of crack when used practically. Due to this reason, it is preferable to use a radically polymerizable monomer with three functional groups in combination. A heretofore known radically polymerizable monomer and oligomer can be employed as such radically polymerizable monomer and oligomer. The ration of such radically polymerizable monomer and oligomer is preferably 1% by mass to 80% by mass, more preferably 5% by mass to 60% by mass, most preferably 10% by mass to 40% by mass, relative to the total amount of the crosslinked surface layer. Further, the viscosity of such radically polymerizable monomer is preferably 1,000 mPa·s or less (25° C.), and more preferably 800 mPa·s or less (25° C.), for example.

The crosslinked charge transport layer is a layer in which at least a radically polymerizable monomer with three or more functional groups that does not have a charge transporting structure and a radically polymerizable monomer with one functional group that has a charge transporting structure are cured. In addition to these, for the purpose of viscosity adjustment during coating of the surface layer, stress relaxation of the crosslinked surface layer, and providing features such as a low surface energy and reduced coefficient of friction, radically polymerizable monomers and oligomers with one or two functional group(s) can be used in combination. A heretofore known radically polymerizable monomer and oligomer can be employed as such radically polymerizable monomer and oligomer.

Examples of the radically polymerizable monomer with one functional group include 2-ethylhexylacrylate, 2-hydroxyethylacrylate, 2-hydroxypropylacrylate, tetrahydrofurfurylacrylate, 2-ethylhexylcarbitolacrylate, 3-methoxybutylacrylate, benzylacrylate, cyclohexylacrylate, isoamylacrylate, isobutylacrylate, methoxytriethyleneglycolacrylate, phenoxytetraethyleneglycolacrylate, cetylacrylate, isostearylacrylate, stearylacrylate, and styrene monomer.

Examples of the radically polymerizable monomer with two functional groups include 1,3-butanediol diacrylate, 1,4-butanediol diacrylate, 1,4-butanediol dimethacrylate, 1,6-hexanediol diacrylate, 1,6-hexanediol dimethacrylate, diethylene glycol diacrylate, neopentyl glycol diacrylate, bisphenol A-EO modified diacrylate, bisphenol F-EO-modified diacrylate, and neopentyl glycol diacrylate.

Examples of the functional monomer include octafluoropentyl acrylate, 2-perfluorooctylethyl acrylate, 2-perfluorooctylethyl methacrylate, 2-perfluoroisononylethyl acrylate, etc. of which fluorine atom is substituted; vinyl monomers, acrylate and methacrylate having a polysiloxane group such as acryloylpolydimethylsiloxaneethyl, methacryloylpolydimethylsiloxaneethyl, acryloylpolydimethylsiloxanepropyl, acryloylpolydimethylsiloxanebutyl, and diacryloylpolydimethylsiloxanediethyl, which have 20 to 70 siloxane repeating units, as disclosed in Japanese Patent Application Publication (JP-B) Nos. 5-60503 and 6-45770.

Examples of the radically polymerizable oligomer includes epoxyacrylate oligomers, urethaneacrylate oligomers and polyesteracrylate oligomers.

The content of the radically polymerizable monomers or oligomers with one functional group and the radically polymerizable monomers or oligomers with two functional groups is preferably 50 parts by mass or less, and more preferably 30 parts by mass or less, relative to 100 parts by mass of the radically polymerizable monomer with three or more functional groups.

When the content is more than 50 parts by mass, the density of a three dimensional crosslinkage in the crosslinked charge transport layer is substantially reduced, inviting the reduction of abrasion resistance.

The crosslinked charge transport layer is a layer in which at least radically polymerizable monomer with three or more functional groups that does not have a charge transporting structure and the radically polymerizable compound with one functional group that has a charge transporting structure are cured. If required, in order to allow this curing reaction to proceed effectively, the crosslinked charge transport layer coating solution may include a polymerization initiator. Examples of the polymerization initiator include thermal polymerization initiators and photopolymerization initiators. These polymerization initiators may be used alone or in combination.

Examples of the thermal polymerization initiator include peroxide initiators such as 2,5-dimethylhexane-2,5-dihydroperoxide, dicumyl peroxide, benzoyl peroxide, t-butylcumyl peroxide, 2,5-dimethyl-2,5-di(peroxybenzoyl)hexyne-3, di-t-butylperoxide, t-butylhydroperoxide, cumene hydroperoxide, lauroyl peroxide, and 2,2-bis(4,4-di-t-butylperoxycyclohexy)propane; and azo initiators such as azobisisobutyronitrile, azobis cyclohexanecarbonitrile, azobismethyl isobutyrate, azobisisobutylamidine hydrochloride, and 4,4'-azobis-4-cyanovaleric acid.

Examples of the photopolymerization initiator include acetophenone or ketal photopolymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl)butanone-1,2-hydroxy-2-methyl-1-phenylpropane-1-one, 2-methyl-2-morpholino(4-methylthiophenyl)propane-1-one, and 1-phenyl-1,2-propanedione-2-(o-ethoxycarbonyl)oxime; benzoin ether photopolymerization initiators such as benzoin, benzoin methyl ether, benzoin ethyl ether, benzoin isobutyl ether, and benzoin isopropyl ether; benzophenone photopolymerization initiators such as benzophenone, 4-hydroxybenzophenone, methyl o-benzoylbenzoate, 2-benzoylnaphthalene, 4-benzoylbiphenyl, 4-benzoylphenylether, acrylated benzophenone, and 1,4-benzoylbenzene; thioxanthone photopolymerization initiators such as 2-isopropylthioxanthone, 2-chlorothioxanthone, 2,4-dimethylthioxanthone, 2,4-diethylthioxanthone, and 2,4-dichlorothioxanthone; and other photopolymerization initiators such as ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide, bis(2,4-dimethoxybenzoyl)-2,4,4-trimethylpentylphosphine oxide, methylphenylglyoxyester, 9,10-phenanthrene, acridine compounds, triazine compounds, and imidazole compounds.

Further, a compound having a photopolymerization accelerating effect can be used alone or in combination with the above-mentioned photopolymerization initiators. Examples of the compound include triethanolamine, methyldiethanol amine, 4-dimethylaminoethylbenzoate, 4-dimethylaminoisoamylbenzoate, (2-dimethylamino)ethylbenzoate and 4,4'-dimethylaminobenzophenone.

The content of the polymerization initiator is preferably 0.5 part by mass to 40 parts by mass, and more preferably 1 part by mass to 20 parts by mass, relative to 100 parts by mass of the total contents which are radically polymerizable.

The crosslinked charge transport layer coating solution may optionally include additives such as plasticizers, leveling agents, and low-molecular-mass charge transport materials having no radical reactivity in order to relax the stress and to improve adhesiveness.

As the plasticizer, for example, those used in typical resins, such as dibutylphthalate and dioctylphthalate can be used.

The amount of the plasticizer to be used is preferably 20% by mass or less, and more preferably 10% by mass or less, relative to the total solid components of the crosslinked charge transport layer coating solution.

As the leveling agent, for example, silicone oils such as dimethylsilicone oil and methylphenylsilicone oil; and polymers and oligomers having a perfluoroalkyl group in their side chains can be used.

The amount of the leveling agent to be used is preferably 3% by mass or less relative to the total solid components of the crosslinked charge transport layer coating solution.

The crosslinked charge transport layer of the present invention is formed by applying a coating solution which includes at least the above-mentioned radically polymerizable monomer with three or more functional groups that does not have a charge transporting structure and radically polymerizable compound with one functional group that has a charge transporting structure on the charge transport layer described later and curing the applied layer. When the radically polymerizable monomer is liquid, the coating solution can be prepared by dissolving other components in the radically polymerizable monomer and applied, but may be applied after diluting with a solvent according to requirements.

The solvent is not particularly restricted and can be appropriately selected according to applications. Examples of thereof include alcohols such as methanol, ethanol, propanol and butanol; ketones such as acetone, methyl ethyl ketone, methyl isobutyl ketone and cyclohexanone; esters such as ethyl acetate and butyl acetate; ethers such as tetrahydrofuran, dioxane and propylether; halogens such as dichloromethane, dichloroethane, trichloroethane and chlorobenzene; aromatics such as benzene, toluene and xylene; and Cellosolves such as methyl Cellosolve, ethyl Cellosolve and Cellosolve acetate. These may be used alone or in combination.

A dilution ratio with the solvent is optionally determined depending on the solubility of compositions, a coating method and the intended layer thickness. Coating can be carried out, for example, by a dip-coating method, a spray-coating method, a bead-coating method and a ring-coating method.

In the present invention, after applying the crosslinked charge transport layer coating solution, it is cured by providing an external energy to form the crosslinked charge transport layer. The external energy used includes heat, light and radiation. A heat energy is applied by heating from the coated layer side or from the support side using gas such as air and nitrogen, steam, a variety of heating media, infrared radiation or electromagnetic wave.

The heating temperature is preferably from 100° C. to 170° C. When the heating temperature is less than 100° C., the reaction is slow in speed and the curing reaction may not be finished completely, and when the heating temperature is more than 170° C., too high temperature causes the curing reaction to proceed nonuniformly, which may cause a large distortion in the crosslinked charge transport layer or may generate a large number of unreacted functional groups and termini at which reaction is stopped. In order to allow the curing reaction to proceed uniformly, a method is also effective in which after heating at a relatively low temperature of 100° C. or less, the coated layer is further heated to 100° C. or more to complete the reaction.

As the light energy, UV irradiators such as high pressure mercury lamps and metal halide lamps having an emission wavelength of UV light can be used, but visible light sources can also be used if the radically polymerizable compound and/or the photopolymerization initiator used have absorption in a visible region. The irradiation light amount is preferably from 50 mW/cm$^2$ to 1,000 mW/cm$^2$. When the irradiation light amount is less than 50 mW/cm$^2$, it may take time for the curing reaction. When the irradiation light amount is more than 1,000 mW/cm$^2$, the reaction proceeds nonuniformly, resulting in the formation of wrinkles in a part of the surface of the resultant crosslinked charge transport layer, or in the generation of a large number of unreacted functional groups and termini at which reaction is stopped. In addition, internal stress becomes large due to rapid crosslinking, causing cracks or film peeling.

The radiation energy includes those using an electron beam.

Among these energies, the heat and light energies are useful because the reaction speed can be controlled easily and the apparatuses are simple.

The thickness of the crosslinked charge transport layer is more preferably 2 μm to 8 μm. As mentioned above, it is preferably 1 μm to 10 μm, but when the thickness is more than 8 μm, the cracks or film peeling may occur easily. The radical polymerization reaction tends to undergo oxygen inhibition, namely, on the surface exposed to the air, the crosslinking tends not to proceed due to the influence of radical trap by oxygen or tends to become nonuniform. These influences are significantly seen on the surface layer not greater than 1 μm, and the crosslinked charge transport layer having thickness not greater than 1 μm tends to have reduced abrasion resistance or nonuniform wear. In addition, during the coating of the crosslinked charge transport layer, components of underlying charge transport layer get mixed. When the thickness of applied crosslinked charge transport layer is thin, the mixed components of under layer spread the entire layer, resulting in the inhibition of curing reaction and the lowering of crosslink density. Thus, the thickness of the crosslinked charge transport layer is more preferably 2 μm or more.

For these reasons, the crosslinked charge transport layer of the present invention having a thickness of 2 μm or more has excellent abrasion resistance and scratch resistance. When a local portion is shaved to the underlying charge transport layer by repeated uses, the wear in this portion increases. Due to charge property and sensitivity change, the density of the intermediate images becomes easily nonuniform. Thus, also in terms of this respect, in order to attain prolonged life time and high image quality, it is preferable that the crosslinked charge transport layer have a thickness of 2 μm or more.

Additionally, as unexpected effect, it was found that when a crosslinked charge transport layer having a thickness of 2 μm to 8 μm is provided, in the durability test with respect to long-term image forming, particularly, durability test at high temperature and high humidity, pinholes are not generated easily on the surface of photoconductor. The reason or mechanism has not been found, but it is considered that the crosslinked charge transport layer of the present invention has a high strength as well as a moderate resilience, and has an appropriate thickness. It is assumed that the pinholes generated on a conventional photoconductor during image formation are associated with microscopic scratches generated on the surface of the photoconductor due to a fine powder such as silica added to a toner, and with temperature and humidity. The surface layer which is only hard is advantageous in that it is not shaved, on the other hand, when the surface layer is scratched, the scratches are expected to grow; thus it is assumed that pinholes are formed easily on the conventional photoconductor in the long-term durability test.

Other than the radically polymerizable compound with three or more functional groups that does not have a charge transporting structure, and the radically polymerizable compound with one functional group that has a charge transporting structure, the crosslinked charge transport layer coating solution may comprise as other components additives such as a binder resin, an antioxidant, and a plasticizer.

When these additives are added to the coating solution in a large amount, the crosslink density is lowered, a cured material generated by the reaction and the above-mentioned added material are phase-separated. This may cause the crosslinked charge transport layer to be soluble to an organic solvent. Specifically, it is important to set the total content of the additives 20% by mass or less relative to the total solid components of the coating solution. In addition, in order not to lower the crosslink density, the total content of respective radically polymerizable monomer having one or two functional group(s), a reactive oligomer, and a reactive polymer is preferably 20% by mass or less. Furthermore, when a radically polymerizable compound with two or more functional groups that has a charge transporting structure is added to the coating solution in a large amount, bulky structures are fixed in a crosslinking structure through plural bonds, thus distortion occurs easily and, an aggregate of tiny cured material tends to be formed. This may cause the crosslinked charge transport layer to be soluble to an organic solvent. The content of the radically polymerizable compound with two or more functional groups that has a charge transporting structure is preferably 10% by mass or less relative to the radically polymerizable compound with one functional group that has a charge transporting structure although it is different depending on the structure of the compound. Further, in the composition in which the charge generating layer, charge transport layer, crosslinked charge transport layer are laminated in this order, it is preferable that the uppermost crosslinked charge transport layer be insoluble in an organic solvent in order to achieve high abrasion resistance and high scratch resistance.

In the present invention, to make the crosslinked charge transport layer to be insoluble in an organic solvent, the following (i) to (v) are important, and controlling one factor does not always lead to the achievement: (i) the composition of crosslinked charge transport layer coating solution and adjustment of the content thereof, (ii) adjustment of a diluent solvent and the concentration of solid components of the crosslinked charge transport layer coating solution, (iii) selection of coating method of the crosslinked charge transport layer, (iv) control of curing conditions of the crosslinked charge transport layer, and (v) low solubility of underlying charge transport layer.

When a solvent with slow evaporation rate is used as the diluent solvent of the crosslinked charge transport layer coating solution, the residual solvent may inhibit the curing or increase the invading amount of the components of the under layer, causing nonuniform curing and the lowering of curing density. Thus, the crosslinked charge transport layer tends to be soluble to an organic solvent. Specifically, tetrahydrofuran, a mixed solvent of tetrahydrofuran and methanol, ethyl acetate, methyl ethyl keton, ethyl Cellosolve, and the like are useful, but the diluent solvent is selected together with a coating method. When the concentration of solid components is too low, due to a similar reason, the crosslinked charge transport layer tends to be soluble to an organic solvent. Contrary, from the limitations of thickness and viscosity of the coating solution, an upper limit of the concentration is restricted in some cases. Specifically, it is preferable 10% by mass to 50% by mass.

The crosslinked charge transporting layer can be coated preferably by a method that decreases the solvent content and a contacting time with the solvent when forming the coating film. Specifically, a spray-coating method and a ring-coating method restricting an amount of the coating solution are most preferable. Further, to suppress the invading amount of the components of the under layer it is effective to use a polymeric charge transport material as a charge transport layer and to dispose an intermediate layer which is insoluble in the coating solvent of the crosslinked charge transport layer.

Regarding the curing condition of the crosslinked charge transport layer, low energy of heating or light irradiation leads to incomplete curing, which increases the solubility to an organic solvent. Conversely, when very high energy is applied for curing, the curing reaction becomes nonuniform and it is likely that uncrosslinked portions and portions at which radical polymerization has been stopped increase, or an aggregate of tiny cured material tends to be formed. Thus, the crosslinked charge transport layer becomes soluble to an organic solvent in some cases.

In order to make the crosslinked charge transport layer to be insoluble in the organic solvent, the heat curing conditions are preferably at 100° C. to 170° C. and for 10 minutes to 3 hours. The curing conditions by the UV light irradiation are preferably 50 mW/cm$^2$ to 1,000 mW/cm$^2$, and 5 seconds to 5 minutes, and it is preferable to suppress nonuniform curing reaction by controlling a rise of temperature to 100° C. or lower.

Examples of a process for rendering the crosslinked charge transport layer insoluble in an organic solvent as follows. When an acrylate monomer having three acryloyloxy groups and a triarylamine compound having one acryloyloxy group are employed as a coating solution, the ratio is preferably 7:3 to 3:7. In addition, the coating solution is preferably prepared by adding the polymerization initiator in an amount of 3% by mass to 20% by mass relative to the total amount of the acrylate compounds, and further adding a solvent. For example, when triarylamine donor is employed as the charge transport material and polycarbonate is employed as the binder resin in the charge transport layer serving as the under layer of the crosslinked charge transport layer, and the surface layer is formed by spraying coating, the solvent of the above-mentioned coating solution is preferably tetrahydrofuran, 2-butane, ethyl acetate, or the like. The amount of the solvent to be used is 3 times to 10 times based on the total amount of the acrylate compounds.

Then, for example, the coating solution prepared above is applied by e.g. spraying on the photoconductor in which an undercoat layer, charge generating layer, the above-mentioned charge transport layer are laminated sequentially on the support such as an aluminum cylinder. Thereafter, the coating is subjected to natural drying or drying at a relatively low temperature for a short period of time (25° C. to 80° C. for 1 minute to 10 minutes), and is cured by UV irradiation or heating.

In the case of ultraviolet (UV) irradiation, a metal halide lamp etc. is used, and the intensity is preferably from 50 mW/cm$^2$ to 1,000 mW/cm$^2$. For example, when UV light with 200 mW/cm$^2$ is applied, the irradiation may be performed uniformly on the drum in circumferential direction from plural lamps for about 30 seconds during curing. The temperature of the drum is to be controlled so as not to exceed 100° C.

In the case of thermal curing, the heating temperature is preferably 100° C. to 170° C. For example, when an air type oven is used as a heater and the heating temperature is set to 150° C., the heating time is from 20 minutes to 3 hours.

After the completion of curing, it is further heated at 100° C. to 150° C. for 10 minutes to 30 minutes for reducing the residual solvent to obtain the electrophotographic photoconductor of the present invention.

<Intermediate Layer>

The image bearing member of the present invention may comprise an intermediate layer between the charge transport layer and crosslinked charge transport layer in order to suppress the invading of components of the charge transport layer to the crosslinked charge transport layer or to improve the adhesion between both layers. Thus, the intermediate layer is suitable to have insolubility or poor solubility to the crosslinked charge transport layer coating solution. Generally, a binder resin is employed as a main component. Examples of these resins are polyamides, alcohol-soluble nylon, water-soluble polyvinyl butyral, polyvinyl butyral, polyvinyl alcohol, and the like. As the method for forming an intermediate layer, the above-mentioned coating method can be adopted.

The thickness of the intermediate layer is not particularly restricted and can be appropriately selected according to applications. 0.05 μm to 2 μm is suitable.

<Undercoat Layer>

In the image bearing member of the present invention, an undercoat layer may be disposed between the conductive support and photoconductive layer. The undercoat layer generally includes resins as a main component, and these resins preferably have low solubility with respect to common organic solvents, considering that a photoconductive layer is coated with a solvent over these resins. Examples of the resin include water-soluble resins such as polyvinyl alcohol, casein, sodium polyacrylate; alcohol-soluble resins such as copolymer nylon and methoxy methylated nylon; a curing resin which forms three-dimensional network such as polyurethane, melamine resin, phenol resin, alkyd-melamine resin and epoxy resin. In addition, fine powder pigments of metal oxide such as titanium oxide, silica, alumina, zirconium oxide, tin oxide and indium oxide may be added to the undercoat layer to prevent moirés and to reduce the rest potential.

Also, as the undercoat layer, a layer formed with an anodic oxidation of $Al_2O_3$ or a layer formed with organic materials such as polyparaxylylene (parylene) and inorganic materials such as $SiO_2$, $SnO_2$, $TiO_2$, ITO and $CeO_2$ by means of a vacuum thin-film preparation process may be preferably used. Other layer formed with known substances may be used.

The undercoat layer may be formed using an appropriate solvent and by means of a coating method as the photoconductive layer was formed. Further, a silane coupling agent, titanium coupling agent and chromium coupling agent, etc. can be used for the undercoat layer.

The thickness of the undercoat layer is not particularly restricted and can be appropriately selected according to applications, preferably 0 μm to 5 μm.

In the present invention, antioxidant may be added to each layer of the crosslinked charge transport layer, the charge transport layer, the charge generating layer, the undercoat layer, and the intermediate layer in order to improve the environmental resistance, especially, to prevent reduction of sensitivity and rise of the rest potential.

Examples of the antioxidant include phenolic compounds, paraphenylene diamines, hydroquinones, organosulfur compounds, and organophosphorus compounds. These may be used alone or in combination.

Examples of the phenolic compound include 2,6-di-t-butyl-p-cresol, butylated hydroxyanisole, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t)-butylphenol, 4,4'-butylydenebis-(3-methyl-6-t-butylphenol), 1,1,3-tris-(2-methyl-4-hydroxy-5-t-butylphenyl)butane, 1,3,5-trimethyl-2,4,6-tris-(3,5-di-t-butyl-4-hydroxybenzyl)benzene, tetrakis-[methylene 3-(3',5'-di-t-butyl-4'-hydroxyphenyl)propionate]methane, bis[3,3'-bis(4'-hydroxy-3'-t-butylphenyl)butylic acid]glycolester, and tocopherols.

Examples of the paraphenylene diamines include N-phenyl-N'-isopropyl-p-phenylene diamine, N,N'-di-sec-butyl-p-phenylene diamine, N-phenyl-N-sec-butyl-p-phenylene diamine, N,N'-di-isopropyl-p-phenylene diamine, and N,N'-dimethyl-N,N'-di-t-butyl-p-phenylene diamine.

Examples of the hydroquinones include 2,5-di-t-octyl hydroquinone, 2,6-di-dodecyl hydroquinone, 2-dodecyl hydroquinone, 2-dodecyl-5-chlorohydroquinone, 2-t-octyl-5-methyl hydroquinone, and 2-(2-octadecenyl)-5-methyl hydroquinone.

Examples of the organosulfur compounds include dilauril-3,3'-thiodipropionate, distearil-3,3'-thiodipropionate, and ditetradecyl-3,3'-thiodipropionate.

Examples of the organophosphorus compounds include triphenyl phosphine, tri(nonylphenyl)phosphine, tri(di-nonyl phenyl)phosphine, tri-cresil phosphine, and tri(2,4-dibutyl phenoxy)phosphine.

These compounds are known as the antioxidants of rubber, plastic, fats, etc., and commercial products are easily available.

The amount of the antioxidant to be added is not particularly restricted and can be appropriately selected according to applications, preferably 0.01% by mass to 10% by mass relative to the total mass of the layer to which the antioxidant is added.

—Example of Synthesis of Compound with One Functional Group that has a Charge Transporting Structure—

The compound with one functional group that has a charge transporting structure of the present invention can be synthesized, for example, by the method disclosed in JP-B No. 3164426. One example is shown below.

(1) Synthesis of a Hydroxy Group-Substituted Triarylamine Compound (the Following Structural Formula (9))

To 240 ml of sulfolane, 113.85 g (0.3 mol) of methoxy group-substituted triarylamine compound (the following Structural Formula (8)) and 138 g (0.92 mol) of sodium iodide were added and heated to 60° C. in a nitrogen stream. 99 g (0.91 mol) of trimethylchlorosilane was dropped therein for 1 hour and stirred at about 60° C. for 4.5 hours, and the reaction was completed. About 1.5 L of toluene was added to the reaction product, cooled to room temperature and repeatedly washed with water and an aqueous sodium carbonate solution. Then, the solvent was removed from the toluene solution and purified by means of a column chromatography (adsorption medium: silica gel, developing solvent: toluene: ethyl acetate=20:1). The thus prepared light yellow oil was crystallized by adding cyclohexane. In this way, 88.1 g of white crystal represented by the following Structural Formula (9) was obtained (Yield-80.4%). The melting point thereof is 64.0° C. to 66.0° C.

TABLE 1

| | C | H | N |
|---|---|---|---|
| Measured value | 85.06% | 6.41% | 3.73% |
| Calculated value | 85.44% | 6.34% | 3.83% |

Structural Formula (8)

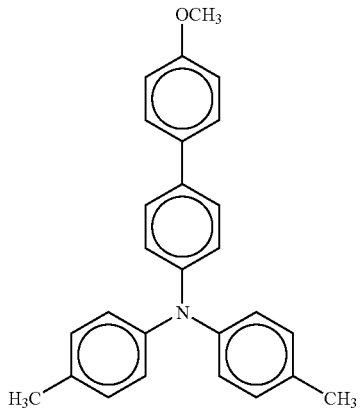

Structural Formula (9)

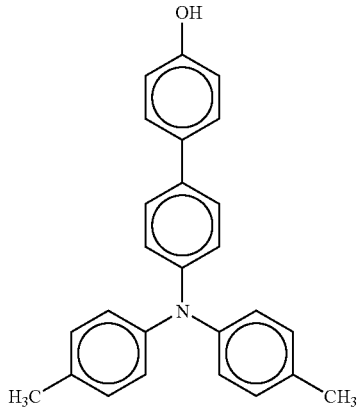

(2) Triarylamino Group-Substituted Acrylate Compound (Compound No. 54)

82.9 g (0.227 mol) of the hydroxy group-substituted triarylamine compound (Structural Formula (9)) obtained in above (1) was dissolved in 400 ml of tetrahydrofuran, and an aqueous sodium hydroxide solution (NaOH: 12.4 g and water: 100 ml) was dropped thereto in a nitrogen stream. The resulting solution was cooled to 5° C. and 25.2 g (0.272 mol) of acrylic acid chloride was dropped thereto over 40 minutes. Then, the mixture was stirred at 5° C. for 3 hours and the reaction was completed. The reaction product was poured into water and was extracted with toluene. The extract was repeatedly washed with an aqueous sodium hydrogen carbonate solution and water. Then, the solvent was removed from the toluene solution and was purified by means of a column chromatography (adsorption medium: silica gel, developing solvent: toluene). The resulting colorless oil was crystallized by adding n-hexane. In this way, 80.73 g of white crystal of Compound No. 54 was obtained (Yield=84.8%). The melting point is 117.5° C. to 119.0° C.

TABLE 2

| | C | H | N |
|---|---|---|---|
| Measured value | 83.13% | 6.01% | 3.16% |
| Calculated value | 83.02% | 6.00% | 3.33% |

<Example of Synthesis of Compound with Two Functional Groups that has a Charge Transporting Structure>

The compound with two functional groups that has a charge transporting structure according to the present invention, dihydroxymethyltriphenilamine, can be synthesized in the following manner.

First, in a flask equipped with a thermometer, a cooling tube, and a stirrer, and a dropping funnel, 49 g of Compound (1) shown in the following reaction scheme and 184 g of phosphorus oxychloride were placed, and dissolved by heating. 117 g of dimethylformamide was gradually dropped by the dropping funnel, and then was stirred for about 15 hours while maintaining the reaction liquid at 85° C. to 95° C. After the reaction liquid was poured gradually to excessive warm water and was slowly cooled while stirring. Then, after the deposited crystal was filtered and dried, Compound (2) was obtained by purifying by means of impurity absorption by e.g. silica gel and recrystallization by acetonitrile. The yield was 30 g.

30 g of the resulting Compound (2) and 100 ml of ethanol were placed in a flask and stirred. After 1.9 g of sodium borohydride was added gradually, the mixture was stirred for two hours while maintaining the liquid temperature at 40° C. to 60° C. Next, the reaction liquid was poured gradually into about 300 ml of water and stirred to deposit a crystal. After filtration, Compound (3) was obtained by washing sufficiently and drying. The yield was 30 g.

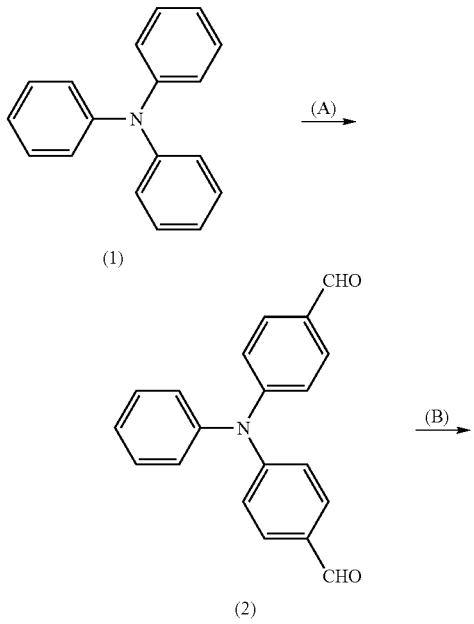

-continued

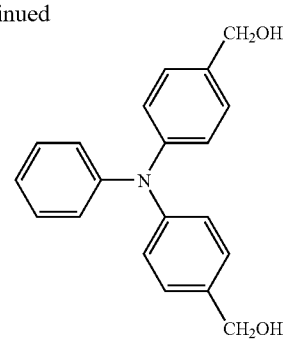

(3)

(Image Forming Method and Image Forming Apparatus)

An image forming apparatus of the present invention contains a image bearing member, a latent electrostatic image forming unit, a developing unit, a transferring unit and a fixing unit, and it further contains other units appropriately selected according to requirements such as discharging unit, recycling unit and controlling unit.

An image forming method of the present invention contains a latent electrostatic image forming process, a developing process, a transferring process, a fixing process and a cleaning process, and it further contains other processes appropriately selected according to requirements such as discharging process, recycling process and controlling process.

The image forming method of the present invention may be favorably performed by means of the image forming apparatus of the present invention. The latent electrostatic image forming process may be performed by the latent electrostatic image forming unit, the developing process may be performed by the developing unit, the transferring process may be performed by the transferring unit, the fixing process may be performed by the fixing unit, and the other processes may be performed by the other units.

In the image forming apparatus and image forming method of the present invention, the image bearing member of the present invention is used as an image bearing member and an image is formed by means of the image bearing member in a heated state, which enables the image bearing member to be heated and enables the relative humidity of the surface of the image bearing member to be reduced. Thus, a favorable image can be obtained over the entire image even in a high-humidity environment. In this case, typically, the temperature of the image bearing member (surface) during image formation is preferably 30° C. to 65° C. under the environment of 50% RH or more, and preferably 40° C. to 50° C. under the environment of 70% RH or more.

—Latent Electrostatic Image Forming Process and Latent Electrostatic Image Forming Unit—

The latent electrostatic image forming process is a process to form a latent electrostatic image on the image bearing member.

The material, shape, structure, size, etc. of the image bearing member is not particularly restricted and can appropriately selected from those known in the art. Suitable examples of the shape include drum-type image bearing members.

The image bearing member of the present invention can be applied to electrophotographic devices such as photocopiers, laser printers, LED printers, and liquid crystal shutter printers and further can be widely applied to devices, to which electrophotographic technology is applied, such as a display or a recording, near prints, engravings and facsimiles.

The latent electrostatic image may be formed, for example, by charging uniformly the surface of the image bearing member followed by imagewise exposure, which may be performed by the latent electrostatic image forming unit.

The latent electrostatic image forming unit houses at least a charging part that uniformly charges the surface of the image bearing member and an exposing part that performs an imagewise exposure of the surface of the image bearing member.

The charging may be performed, for example, by applying an electric potential to the surface of the image bearing member with the charging part.

The charging part is not particularly restricted and can be appropriately selected according to applications. Examples thereof include a contact charging unit, which itself is heretofore known, having a conductive or semiconductive roll, a brush, a film or a rubber blade; and a noncontact charging unit utilizing corona discharge such as corotron and scorotron.

The exposure may be performed, for example, by exposing imagewise the surface of the image bearing member with the exposing part.

The exposing unit is not particularly restricted as long as it can perform an imagewise exposure as intended on the surface of the image bearing member charged by the charging part, and it can be appropriately selected according to applications. Examples of the exposing unit include a copying optical system, a rod lens array system, a laser optical system and a liquid crystal shutter optical system.

In the present invention, the back-exposure method may be adopted in which an exposure is performed imagewise from the back side of the image bearing member.

When an image forming apparatus is used as a photocopier or a printer, the image exposure is performed by irradiating the photoconductor with the reflected light or the transmitted light from manuscripts, or the manuscripts are read by a sensor and converted into signals and in accordance with the signals, scanning by a laser beam, driving a LED array, or driving a crystal shutter array to irradiate the photoconductor with lights, and the like.

—Developing Process and Developing Unit—

The developing process is a process to develop the latent electrostatic image using a toner or a developer to form a visible image.

The formation of the visible image may be performed by developing the latent electrostatic image using the toner or the developer, and it may be performed by the developing unit.

The developing unit is not particularly restricted as long as it can perform a development using the toner or the developer, and it can be appropriately selected from heretofore known developing units. For example, a preferable developing unit contains the toner or the developer and includes a developing part which can impart the toner or the developer in a contact or noncontact manner to the latent electrostatic image.

The developing part typically employs a dry development. It may be a monochrome developing part or a multi-color developing part. For example, a developer having an agitator that frictions and agitates the toner or the developer for electrification and a rotatable magnet roller is preferable.

In the developing part, for example, the toner and the carrier are mixed and agitated, which causes a friction to charge the toner and maintains the charged toner on the surface of the rotating magnet roller in a state of a chain of magnetic particles, and a magnetic brush is formed. The magnet roller is arranged near the image bearing member;

therefore, the toner constituting the magnetic brush formed on the surface of the magnetic roller partially transfers to the surface of the image bearing member, due to electric attraction. As a result, the latent electrostatic image is developed by the toner, and a visible image by the toner is formed on the surface of the image bearing member.

The developer contained in the developing part is a developer containing a toner, and the developer may be a one-component developer or a two-component developer. A generally used toner can be used as the toner.

—Transferring Process and Transferring Unit—

The transferring process is a process to transfer the visible image to a recording medium. The transferring process preferably has an aspect that, with an intermediate recording medium, it performs a primary transfer to transfer the visible image to the intermediate recording medium followed by a secondary transfer to transfer the visible image to the recording medium. An aspect which includes a primary transferring process that transfers the visible image to the intermediate recording medium to form a complex transfer image and a secondary transferring process that transfers the complex transfer image to the recording medium using a toner having two or more colors or preferably a full-color toner is more preferable.

The transfer of the visible image may be performed by charging the image bearing member using a transfer charging part, and it may be performed by the transferring unit. The transferring unit preferably has an aspect that includes a primary transferring unit that transfers a visible image to an intermediate recording medium to form a complex transfer image and a secondary transferring unit that transfers the complex transfer image to a recording medium.

The intermediate recording medium is not particularly restricted and can be appropriately selected according to applications from heretofore known recording media. Favorable examples include a transfer belt.

The transferring units, i.e. the primary transferring unit and the secondary transferring unit, preferably contain at least a transferring part that strips and charges the visible image formed on the image bearing member to the side of the recording medium. There may be one transferring unit, or there may be two or more.

Examples of the transferring part include a corona transferring unit by corona discharge, a transfer belt, a transfer roller, a pressure transfer roller and an adhesive transferring part.

Also, the typical recording medium is plain paper, but it is not particularly restricted as long as an unfixed image after developing can be transferred. It can be appropriately selected according to applications, and a PET base for OHP may be used.

—Fixing Process and Fixing Unit—

The fixing process is a process to fix the visible image transferred to the recording medium by means of a fixing apparatus. It may be performed every time a toner of each color is transferred to the recording medium, or it may be performed at once when a toner of all colors is laminated.

The fixing apparatus is not particularly restricted and can be selected appropriately according to applications. A heretofore known hot-pressing unit is suitable. Examples of the hot-pressing unit include a combination of a heat roller and a pressure roller and a combination of a heat roller, a pressure roller and an endless belt.

In general, the heating in the hot-pressing unit is preferably 80° C. to 200° C.

In the present invention, a heretofore known optical fixing part, for example, may be used along with or in place of the fixing process and the fixing unit according to applications.

—Cleaning Process and Cleaning Unit—

The cleaning process is a process to clean the image bearing member by means of a cleaning unit.

Examples of the cleaning unit include a cleaning blade, a magnetic brush cleaner, a static brush cleaner, a magnetic roller cleaner, a blade cleaner, a brush cleaner, and a web cleaner.

Figure 3:
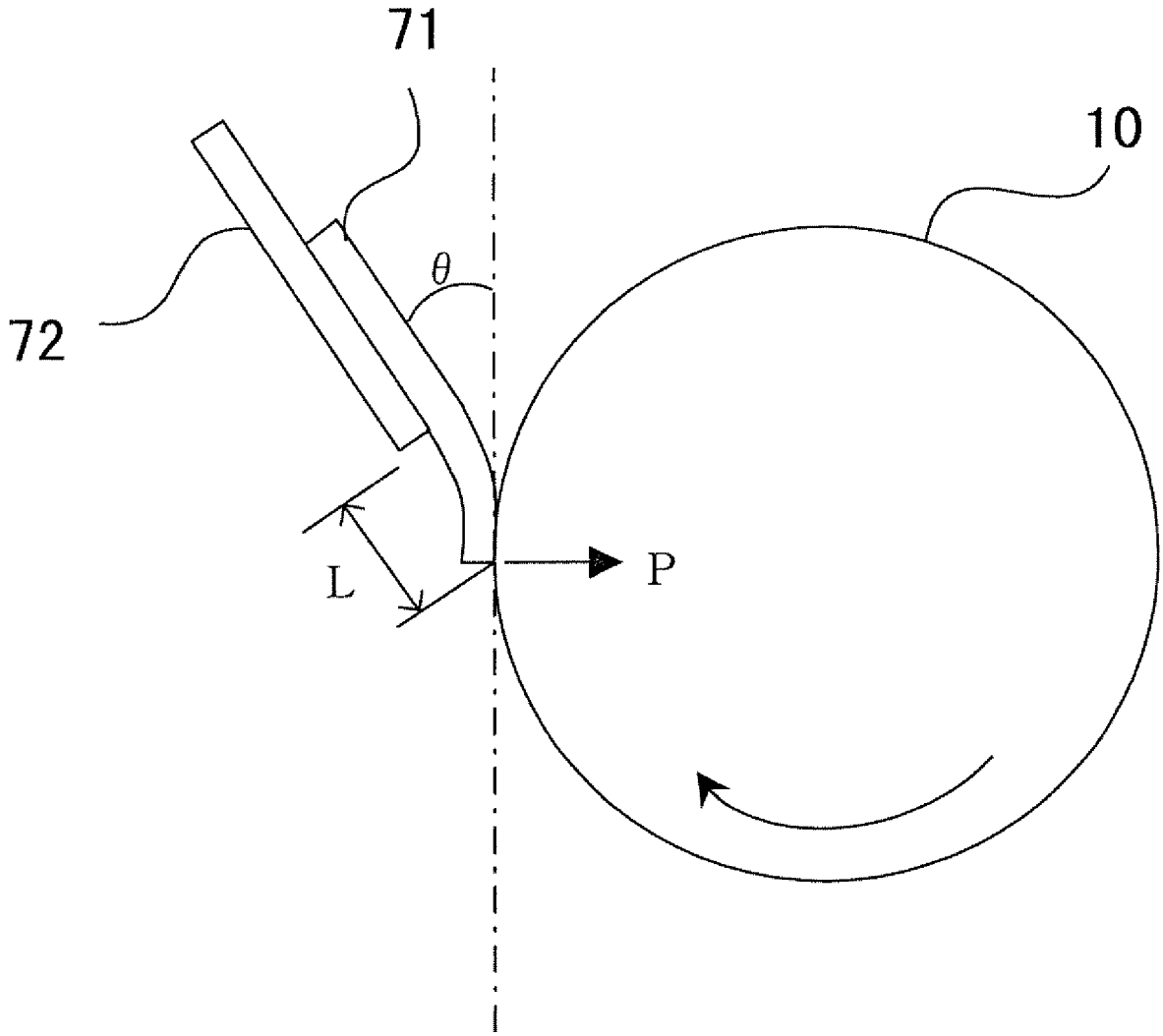
FIG. 3 is a schematic diagram showing an example of a cleaning unit used in the present invention.

The cleaning unit will be described. FIG. 3 is a schematic cross-section view of the cleaning system used in the present invention. In the present invention, known cleaning conditions and blade materials can be used. In such case, blades are preferably used through a counter contact with respect to the rotational direction of the photoconductor.

In FIG. 3, a contact load P is a vector value in the normal direction of pressure contact force when a cleaning blade 71 comes into contact with a photoconductor 10. A contact angle θ is an angle between the tangent line at the contact point of the photoconductor 10 and the blade prior to deformation. A free length L of the cleaning blade is a length from the end of a support member 72 to the tip of the blade prior to deformation.

The contact load P and the contact angle θ of the cleaning blade 71 to the photoconductor 10 are preferably P=5 gf/cm to 50 gf/cm and θ=5° to 35°. The free length L of the cleaning blade is preferably 3 mm to 15 mm. The thickness of the cleaning blade is preferably 0.5 mm to 10 mm.

Examples of the material of rubber blade for use in the blade cleaning system include urethane rubbers, silicone rubbers, fluoro rubbers, chloropyrene rubbers, and butadiene rubbers. Among these, the urethane rubber is most preferable.

The counterturn of the blade can be effectively prevented by concurrently controlling hardness and repulsion elasticity of the rubber blade. The JIS-A hardness of the rubber blade at 25±5° C. is preferably 65 to 80. When the JIS-A hardness of the blade is less than 65, the counterturn of the blade may easily occur, and when the JIS-A hardness is more than 80, cleaning performance may degrade. The repulsion elasticity of the rubber blade is preferably 20% to 75%. When the repulsion elasticity is more than 75%, the counterturn of the blade may easily occur, and when less than 20%, cleaning performance may degrade.

Both of the JIS-A hardness and the repulsion elasticity can be measured based on the physical testing methods for vulcanized rubber of JIS K6301.

The discharging process is a process to discharge the image bearing member by applying a discharging bias, and it may be favorably performed by a discharging unit.

The discharging unit is not particularly restricted as long as the discharging bias is applied to the image bearing member. It can be appropriately selected from heretofore known discharging parts, and favorable examples include a discharge lamp.

The recycling process is a process to recycle the electrophotographic toner removed in the cleaning process to the developing unit, and it may be favorably performed by a recycling unit.

The recycling unit is not particularly restricted, and a heretofore known transporting unit may be used.

The controlling process is a process to control each of the above-mentioned processes, and it may be favorably performed by a controlling unit.

The controlling unit is not particularly restricted as long as it can control the behavior of each unit. It can be appropriately selected according to applications. Examples thereof include equipments such as sequencers and computers.

An aspect of the image forming apparatus of the present invention will be described with reference to FIG. 4.

Figure 4:
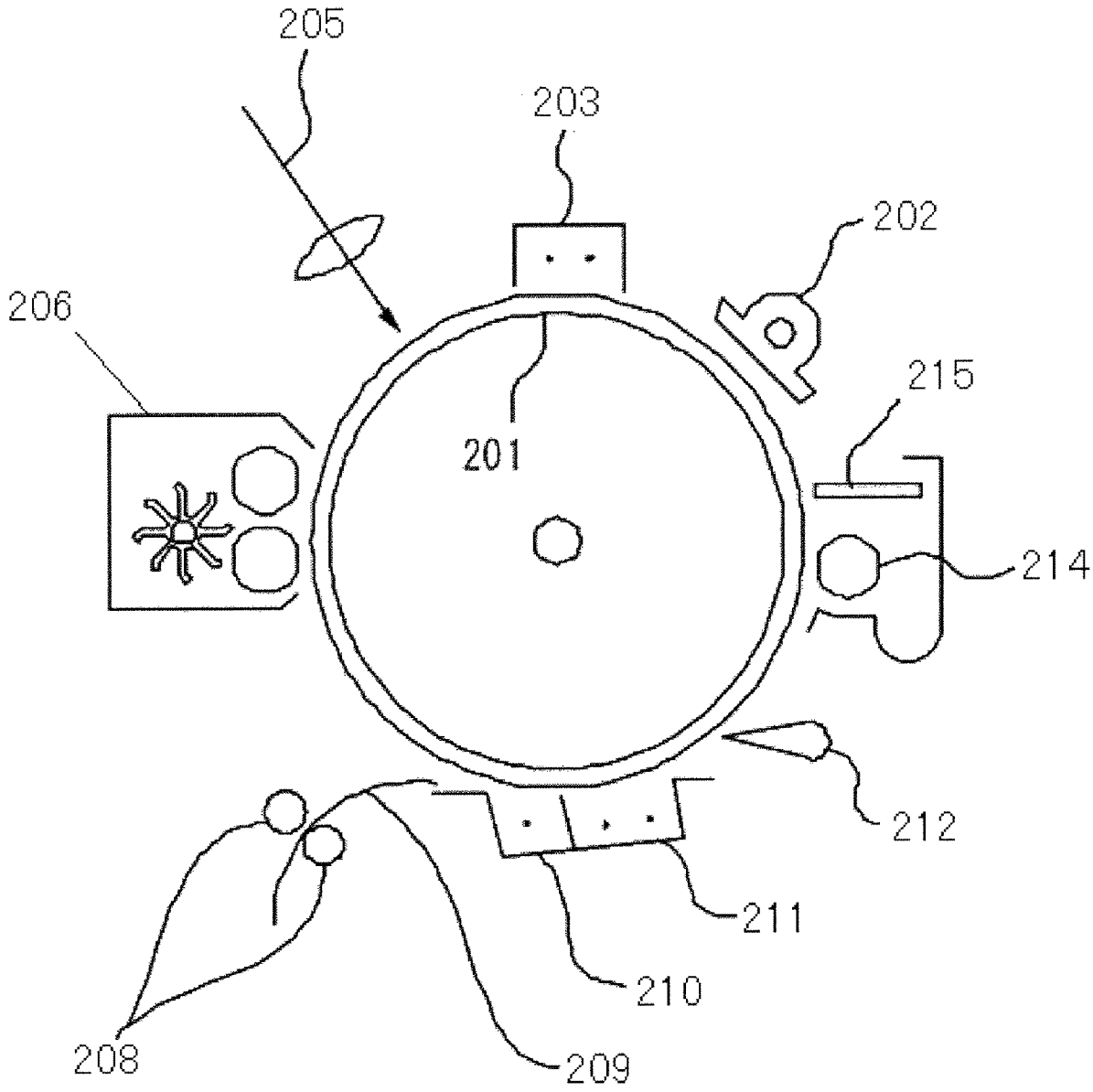
FIG. 4 is a schematic diagram showing an example of an image forming apparatus of the present invention.

FIG. 4 is a schematic diagram showing an example of an image forming apparatus of the present invention, and modified examples described below belong to the category of the present invention.

A photoconductor 201 as an image bearing member comprises on a support a photoconductive layer that includes a charge generating layer, a charge transport layer and a crosslinked charge transport layer in this order. The figure shows the photoconductor 201 having a shape of a drum, but it may be in a shape of a sheet or an endless belt.

A wire-type charging member and a roller-shaped charging member can be used as a charging member 203.

For high-speed charging, a scorotron-type charging member can be preferably used. The photoconductor is charged by this charging member, and the higher the electric intensity applied to the photoconductor is, the better the dot reproducibility becomes.

A light source that can ensure high intensity and can write with high resolution (resolution with 600 dpi or more) such as a light-emitting diode (LED), laser diode (LD), and electroluminescence (EL) is used for an image exposing part 205.

A heretofore known charging part may be used for the transferring unit, and as shown in FIG. 4, the combination of a transfer charger 210 and a separation charger 211 is effective. In addition, it is also possible to use a transfer belt and a transfer roller, and the use of a contact charging part that generates less ozone, such as a transfer belt and transfer roller, is preferable. During transfer, a voltage/current can be applied by any one of a constant-voltage system and a constant-current system, but the constant-current system is preferable since the amount of charge transferred can be maintained at a constant level and the system has an excellent stability.

A developing member 206 has one developing sleeve, and the toner developed on the photoconductor 201 is transferred onto a transfer paper 209.

The toner image formed on the photoconductor is transferred onto the transfer paper to thereby form an image on the transfer paper. There are two methods for the transfer: one is a method as shown in FIG. 4, in which a toner image developed on the surface of the photoconductor is directly transferred onto the transfer paper; and the other is a method in which a toner image is first transferred onto an intermediate recording medium and then transferred onto the transfer paper. In the present invention, both methods can be used.

A heretofore known transfer member can be used if it satisfies the composition of the present invention in terms of construction.

When an image exposure is performed with a positively (negatively) charged photoconductor, a positive (negative) latent electrostatic image is formed on the surface of the photoconductor. A positive image may be obtained by developing this with a negative (positive) toner, i.e. detecting particles, and a negative image may be obtained by developing this with a positive (negative) toner.

A light source that can be used in e.g. a charge eliminating lamp 202 may be light-emitting materials in general such as fluorescent lighting, tungsten lamp, halogen lamp, mercury lamp, sodium lamp, light-emitting diode (LED), laser diode (LD) and electroluminescence (EL). Various filters such as sharp-cut filter, band-pass filter, near-infrared-cut filter, dichroic filter, interference filter and color-temperature conversion filter may be used for irradiation with only a light having a desired wavelength.

A photoconductor is irradiated with light through such light source or the like by providing, other than the process shown in FIG. 4, a transferring process, a discharging process, cleaning process, or a process such as pre-exposure in which light irradiation is used in combination.

When using superimposed AC components in the above charging system, or when the rest potential of the photoconductor is small, this discharge system can be omitted. Not only optical discharge but also electrostatic discharge system (e.g. a discharge brush to which a reverse bias is applied, or which is connected to the earth) can be used. In FIG. 4, 208 and 212 represent resist rollers and separating pawls, respectively.

The toner developed on the photoconductor 201 by the developing unit 206 is transferred onto the transfer paper 209; in some cases, some remains on the photoconductor 201. Such toner is removed from the photoconductor by means of a fur brush 214 and a blade 215. Cleaning may be performed with only cleaning brush, and a heretofore known brush including fur brush and mag fur brush can be used for the cleaning brush.

Figure 5:
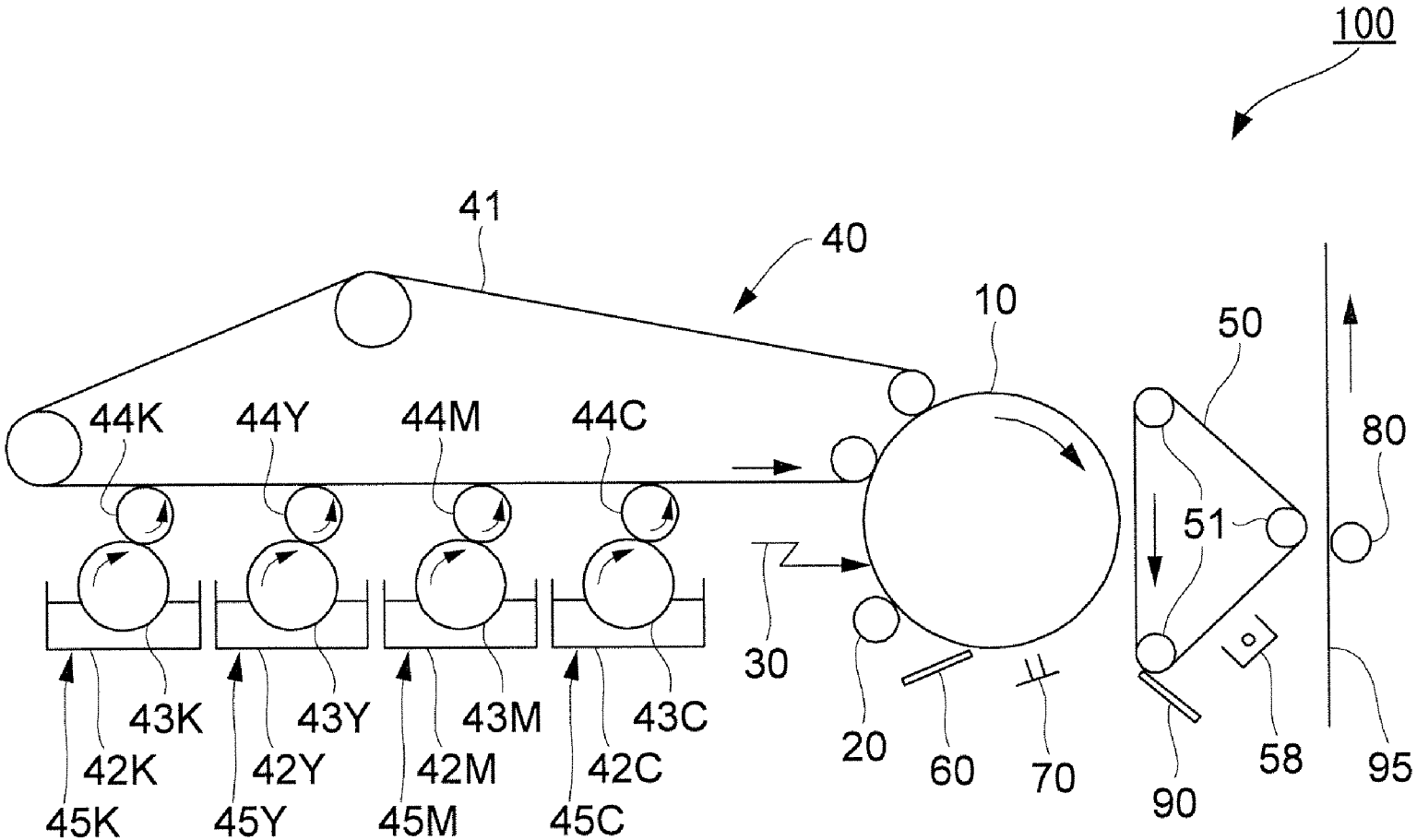
FIG. 5 is a schematic diagram showing one example of the operation of the image forming method of the present invention performed by the image forming apparatus of the present invention.

An aspect of the image forming method of the present invention performed by means of the image forming apparatus will be described with reference to FIG. 5. The image forming apparatus 100 shown in FIG. 5 is equipped with a photoconductor drum 10 (photoconductor 10) as the image bearing member, a charge roller 20 as the charging unit, an exposure device 30 as the exposing unit, a developing device 40 as the developing unit, an intermediate transferring member 50, a cleaning device 60 having a cleaning blade as the cleaning unit and a discharge lamp 70 as the discharging unit.

The intermediate transferring member 50 is an endless belt that is being extended by the three rollers 51 placed inside the belt and designed to be moveable in arrow direction. A part of three rollers 51 function as a transfer bias roller that can imprint a specified transfer bias, the primary transfer bias, to the intermediate transferring member 50. The cleaning blade 90 for intermediate transferring member is placed near the intermediate transferring member 50, and a transfer roller 80, as the transferring unit which can imprint the transfer bias for transferring the visible image, toner image (second transferring), onto the recording medium 95, is placed face to face with the intermediate transferring member 50. In the surrounding area of the intermediate transferring member 50, the corona charger 58, for charging visible image on the intermediate transferring member 50, is placed between contact area of the photoconductor 10 and the intermediate transferring member 50 and contact area of the intermediate transferring member 50 and the recording medium 95 in the rotating direction of the intermediate transferring member 50.

The developing device 40 is constructed with developing belt 41 as a developer bearing member, black developing unit 45K, yellow developing unit 45Y, magenta developing unit 45M and cyan developing unit 45C that are juxtapositioned in the surrounding area of developing belt 41. The black developing unit 45K is equipped with developer container 42K, developer feeding roller 43K and developing roller 44K whereas yellow developing unit 45Y is equipped with developer container 42Y, developer feeding roller 43Y and developing roller 44Y. The magenta developing unit 45M is equipped with developer container 42M, developer feeding roller 43M and developing roller 44M whereas the cyan developing unit 45C is equipped with developer container 42C, developer feeding roller 43C and developing roller 44C.

The developing belt 41 is an endless belt and is extended between a number of belt rollers as rotatable and the part of developing belt 41 is in contact with the photoconductor 10.

For example, the charge roller 20 charges the photoconductor drum 10 evenly in the image forming apparatus 100 as shown in FIG. 5. The exposure device 30 exposes imagewise on the photoconductor drum 10 and forms a latent electrostatic image. The latent electrostatic image formed on the photoconductor drum 10 is then developed with the toner fed from the developing device 40 to form a visible image (toner image). The visible image (toner image) is then transferred onto the intermediate transferring member 50 by the voltage applied from the roller 51 as the primary transferring and it is further transferred onto the transfer paper 95 as the secondary transferring. As a result, a transfer image is formed on the transfer paper 95. The residual toner on the photoconductor 10 is removed by the cleaning device 60 and the charge built up over the photoconductor 10 is temporarily removed by the discharge lamp 70.

Figure 6:
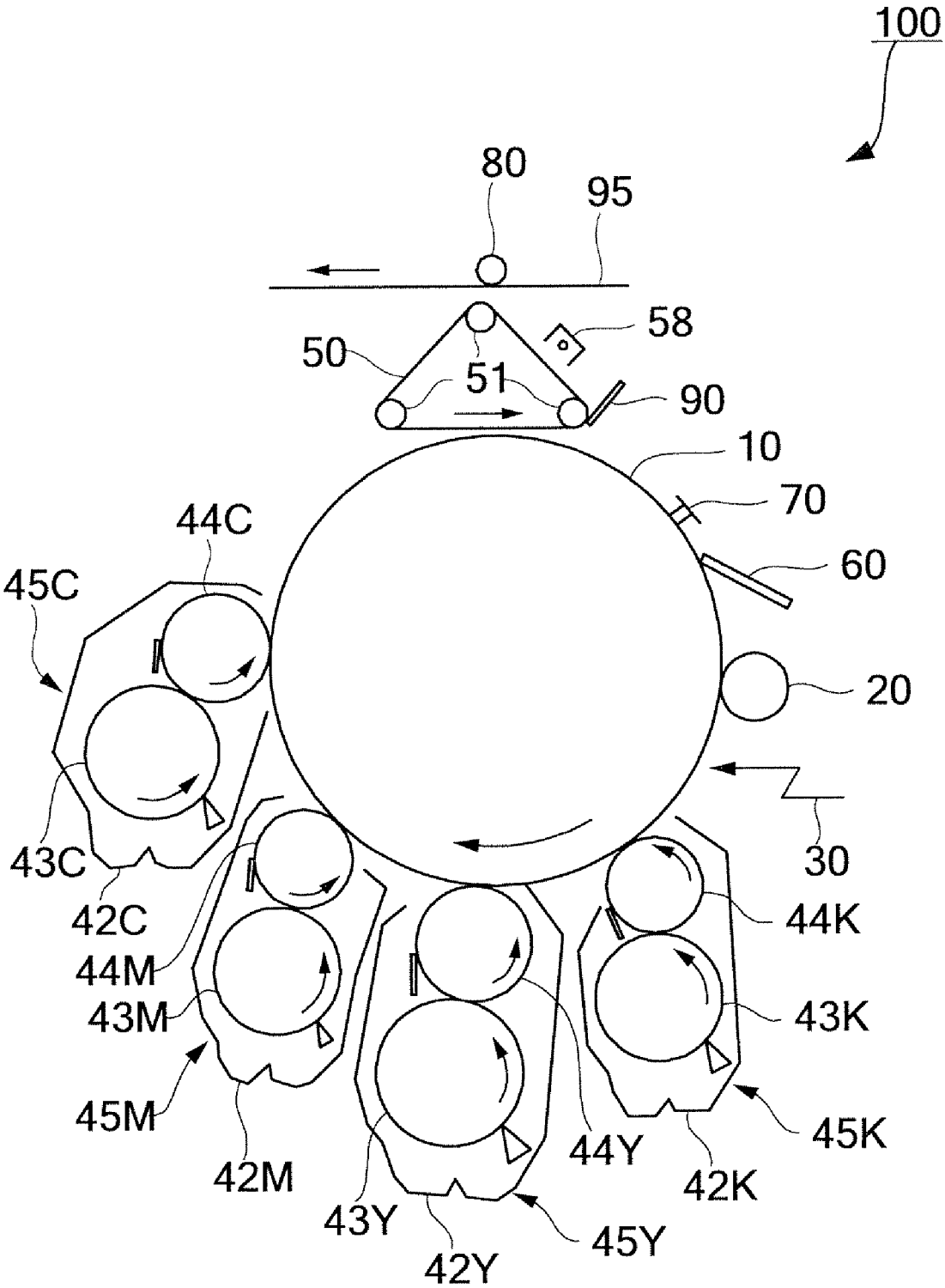
FIG. 6 is a schematic diagram showing another example of the operation of the image forming method of the present invention performed by the image forming apparatus of the present invention.

The other aspect of the operation of image forming methods of the present invention by the image forming apparatuses is described referring to FIG. 6. The image forming apparatus 100 as shown in FIG. 6 has the same lineups and effects as the image forming apparatus 100 shown in FIG. 5 except for the developing belt 41 is not equipped and the black developing unit 45K, the yellow developing unit 45Y, the magenta developing unit 45M and the cyan developing unit 45C are placed directly facing the photoconductor 10. The symbols used in FIG. 6 correspond to the symbols used in FIG. 5.

Figure 7:
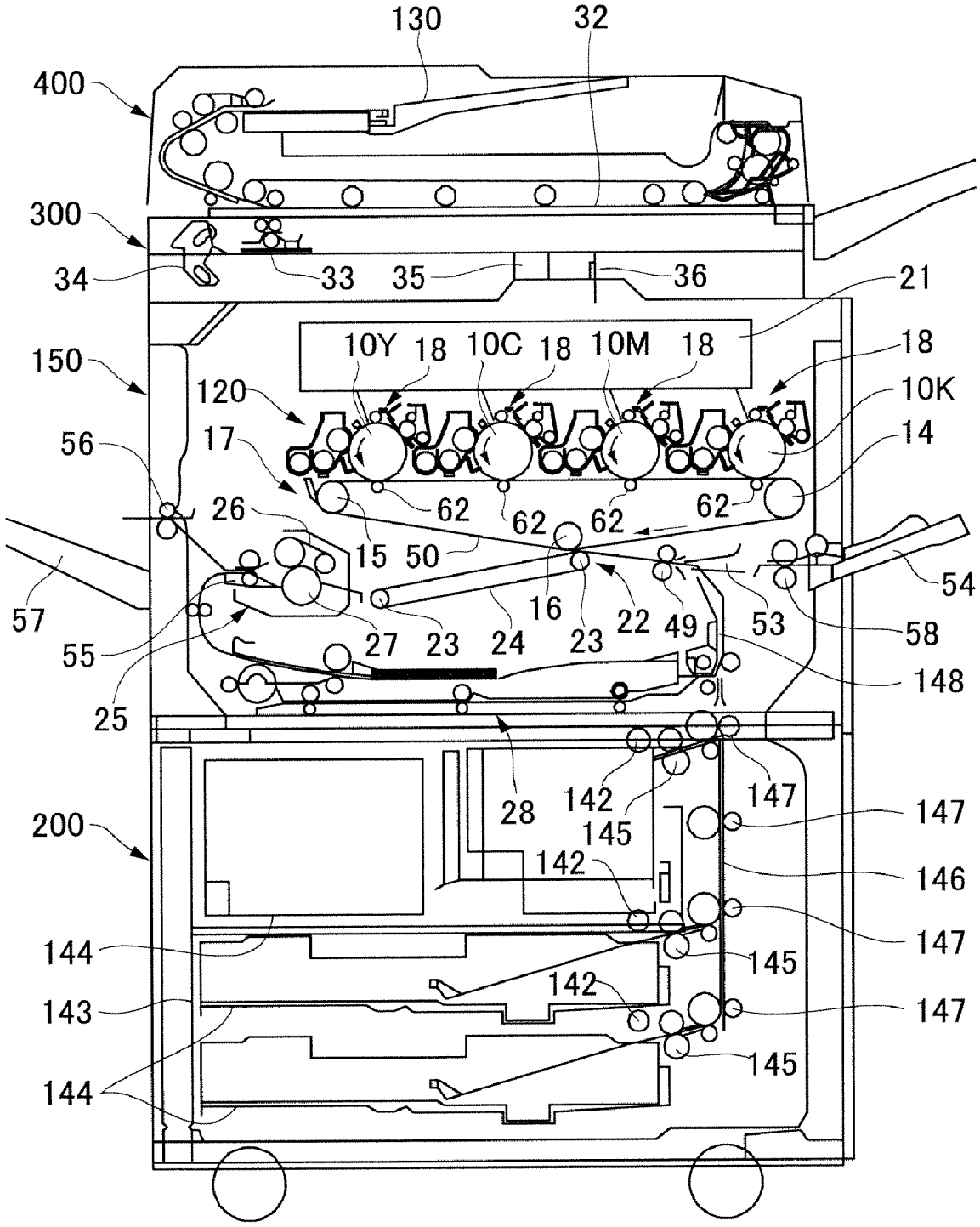
FIG. 7 is a schematic diagram showing an example of the operation of the image forming method of the present invention performed by the image forming apparatus (tandem color image forming apparatus) of the present invention.

The other aspect of the operation of image forming methods of the present invention by the image forming apparatuses is described referring to FIG. 7. The tandem image forming apparatus as shown in FIG. 7 is a tandem color image forming apparatus. The tandem image forming apparatus is equipped with a copier main body 150, a feeding paper table 200, a scanner 300 and an automatic document feeder (ADF) 400.

The intermediate transferring member 50 in a form of an endless belt is placed in the center part of the copier main body 150. The intermediate transferring member 50 is extended between support rollers 14, 15 and 16 as rotatable in the clockwise direction as shown in FIG. 7. An intermediate transferring member cleaning device 17 is placed near the support roller 15 in order to remove the residual toner on the intermediate transferring member 50. The tandem developing part 120 is placed on the intermediate transferring member 50. In the tandem developing unit, four image forming units 18, yellow, cyan, magenta and black, are positioned in line along the transport direction in the intermediate transferring member 50, which is being extended between the support rollers 14 and 15. The exposure device 21 is placed near the tandem developing part 120. The secondary transferring device 22 is placed on the opposite side where tandem developing part 120 is placed in the intermediate transferring member 50. The secondary transfer belt 24, an endless belt, is extended between a pair of the roller 23 and the transfer paper transported on the secondary transfer belt 24 and the intermediate transferring member 50 are accessible to each other in the secondary transferring device 22. A fixing device 25 is placed near the secondary transferring device 22. The fixing device 25 is equipped with a fixing belt 26, an endless belt, and a pressure roller 27 which is arranged by being pressed thereby.

The sheet inversion unit 28 is placed near the secondary transferring device 22 and the fixing device 25 in the tandem image forming apparatus, in order to invert the transfer paper to form images on both sides of the transfer paper.

The full-color image formation, color copy, using the tandem developing part 120 is explained. At the start, a document is set on the document table 130 of the automatic document feeder (ADF) 400 or the automatic document feeder 400 is opened and a document is set on a contact glass 32 of the scanner 300 and the automatic document feeder 400 is closed.

By pushing the start switch (not shown), the scanner 300 is activated after the document was transported and moved onto the contact glass 32 when the document was set on the automatic document feeder 400, or the scanner 300 is activated right after, when the document was set onto the contact glass 32, and a first carrier 33 and a second carrier 34 will start running. The light from the light source is applied from the first carrier 33, and simultaneously the light reflected at the document surface is reflected by the mirror of second carrier 34. Then a scanning sensor 36 receives the light via an imaging lens 35 and the color copy (color image) is scanned to provide image information of black, yellow, magenta and cyan.

Figure 8:
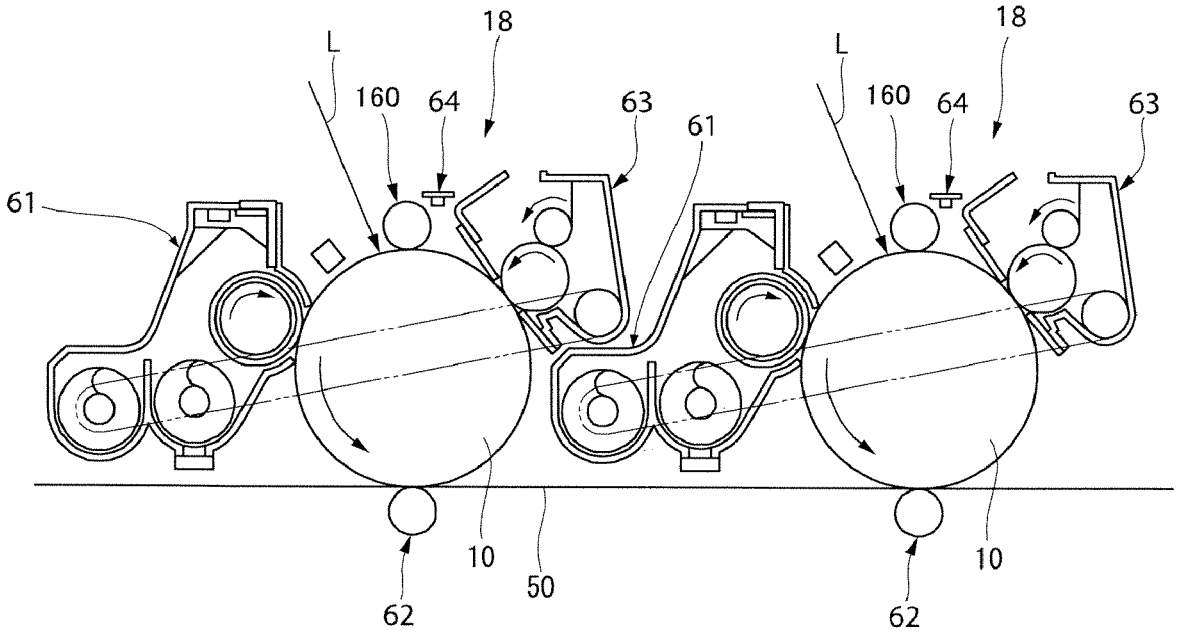
FIG. 8 is a partially enlarged schematic diagram of the image forming apparatus shown in FIG. 7.

Each image information for black, yellow, magenta and cyan is transmitted to each image forming unit 18: black image forming unit, yellow image forming unit, magenta image forming unit and cyan image forming unit, of the tandem developing part 120 and each toner image of black, yellow, magenta and cyan is formed in each image forming unit. The image forming unit 18: black image forming unit, yellow image forming unit, magenta image forming unit and cyan image forming unit of the tandem developing part 120 as shown in FIG. 8 is equipped with the photoconductor 10: photoconductor 10K for black, photoconductor 10Y for yellow, photoconductor 10M for magenta and photoconductor 10 C for cyan, the charger 160 that charges the photoconductor 10 evenly, an exposure device by which the photoconductor is exposed imagewise corresponding to each color images based on each color image information as indicated by L in FIG. 8 to form a latent electrostatic image corresponding to each color image on the photoconductor, a developing device 61 by which the latent electrostatic image is developed using each color toner: black toner, yellow toner, magenta toner and cyan toner to form toner images, a transfer-charging part 62 by which the toner image is transferred onto the intermediate transferring member 50, a cleaning device 63 and a discharger 64. The image forming unit 18 is able to form each single-colored image: black, yellow, magenta and cyan images, based on each color image information. These formed images: black image formed on the photoconductor 10K for black, yellow image formed on the photoconductor 10Y for yellow, magenta image formed on the photoconductor 10M for magenta and cyan image formed on the photoconductor 10C for cyan, are transferred sequentially onto the intermediate transferring member 50 which is being rotationally transported by the support rollers 14, 15 and 16 (the primary transferring). And the black, yellow, magenta and cyan images are overlapped to form a synthesized color image, a color transfer image.

In the feeding table 200, one of the feeding rollers 142 is selectively rotated and sheets (recording paper) are rendered out from one of a plurality of feeding cassettes 144 in a paper bank 143 and sent out to feeding path 146 after being separated one by one by a separation roller 145. The sheets are then transported to the feeding path 148 in the copier main body 150 by a transport roller 147 and are stopped running down to a resist roller 49. Alternatively, sheets (recording paper) on a manual sheet tray 54 are rendered out by rotating a feeding roller 142, inserted into the manual feeding path 53 after being separated one by one by the separation roller 145 and stopped by running down to the resist roller 49 in the same way. Generally, the resist roller 49 is used being grounded; however, it is also usable while bias is imposed for the sheet powder removal. The resist roller 49 is rotated in synchronism with the synthesized color image (color transfer image) on the intermediate transferring member 50, and a sheet (recording paper) is sent out between the intermediate transferring member 50 and the secondary transferring device 22. The color image is are then formed on the sheet (recording paper) by transferring (secondary transferring) the synthesized color image (color transfer image) by the secondary transferring device 22. The residual toner on the intermediate transferring member 50 after the image transfer is cleaned by the intermediate transferring member cleaning device 17.

The sheet (recording paper) on which the color image is transferred and formed is taken out by the secondary transferring device 22 and sent out to the fixing device 25 in order to fix the synthesized color image (color transfer image) onto the sheet (recording paper) under the thermal pressure. Triggered by a switch claw 55, the sheet (recording paper) is discharged by a discharge roller 56 and stacked on a discharge tray 57. Alternatively, triggered by the switch claw 55, the sheet is inverted by the sheet inversion unit 28 and led to the transfer position again. After recording an image on the back side, the sheet is then discharged by the discharge roller 56 and stacked on the discharge tray 57.

In the image forming apparatus and image forming method of the present invention, the photoconductive layer comprises a reaction product of a radically polymerizable compound with three or more functional groups that does not have a charge transporting structure, and a radically polymerizable compound with one functional group that has a charge transporting structure, and an image bearing member that comprises the photoconductive layer with less abrasion loss is used, thereby allowing the formation of image with high resolution and high quality over a long period.

(Process Cartridge)

A process cartridge of the present invention comprises an image bearing member and at least any one unit selected from a latent electrostatic image forming unit that forms a latent electrostatic image on the image bearing member, a developing unit that develops the latent electrostatic image using a toner to form a visible image, a transferring unit that transfers the visible image onto a recording medium, and a cleaning unit that removes a residual toner on the image bearing member, and it further comprises other units appropriately selected according to requirements.

The image bearing member comprises a support, a photoconductive layer that includes at least a charge generating layer, a charge transport layer and a crosslinked charge transport layer in this order, wherein the crosslinked charge transport layer comprises a reaction product of a radically polymerizable compound with three or more functional groups that does not have a charge transporting structure, and a radically polymerizable compound with one functional group that has a charge transporting structure, and the image bearing member is the same as that described above.

The developing unit includes at least: a developer container which contains the toner or the developer, and a developer bearing member which bears and transports the toner or the developer contained in the developer container, and it may further include a layer thickness regulating member for regulating the layer thickness of the carried toner.

The process cartridge of the present invention may be detachably mounted on a variety of image forming apparatuses and is preferably detachably mounted on the image forming apparatus of the present invention described above.

Figure 9:
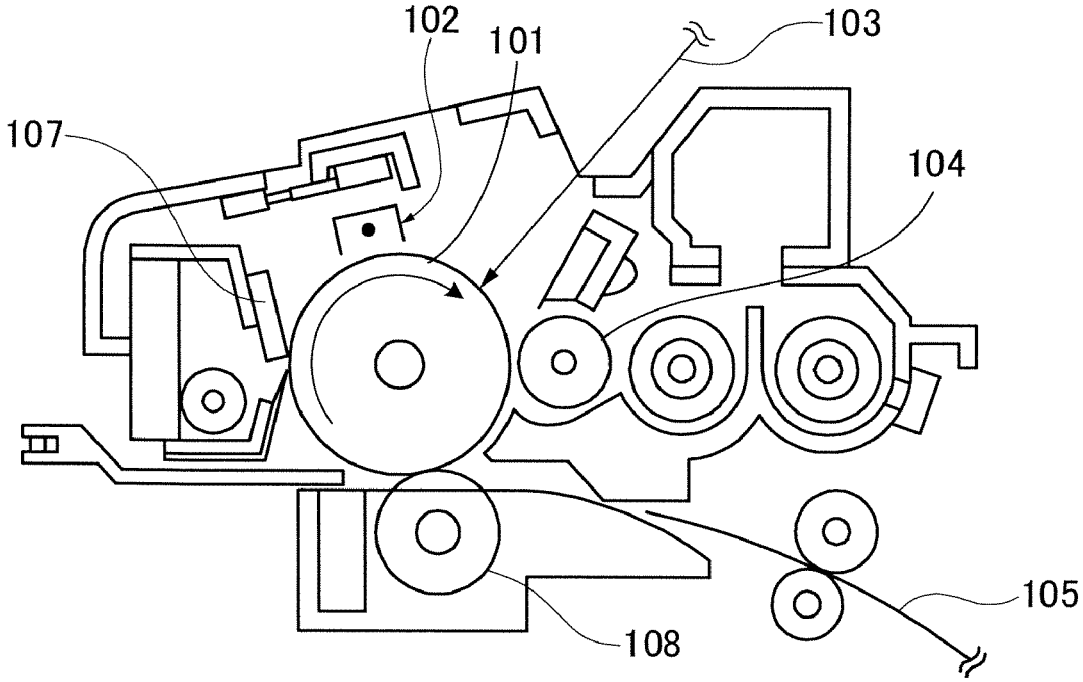
FIG. 9 is a schematic diagram showing an example of a process cartridge of the present invention.

The process cartridge, for example as shown in FIG. 9, houses a photoconductor 101. It also includes a charging unit 102, a developing unit 104, a transferring unit 108, a cleaning unit 107 and further includes other units according to requirements. In FIG. 9, 103 and 105 represent exposure from an exposing unit, and a recording medium, respectively.

The photoconductor 101 comprises a support and a photoconductive layer that includes at least a charge generating layer, a charge transport layer and a crosslinked charge transport layer in this order.

A heretofore known charging member can be used for the charging unit 102, for example.

A light source that can write with high resolution can be used for the exposing unit 103, for example.

An image forming process by means of the process cartridge shown in FIG. 9 is illustrated. A latent electrostatic image corresponding to an exposure image is formed on the surface of the photoconductor 101, which is rotating in the direction of the arrow, by the charge from the charging unit 102 and exposure 103 from an exposing unit (not shown). This latent electrostatic image is toner developed in the developing unit 104, and the toner development is transferred to the recording medium 105 by the transferring unit 108 and printed out. Next, the surface of the image bearing member after the image transfer is cleaned with the cleaning unit 107 and further discharged by a discharging unit (not shown). The above operations are repeated again.

Regarding the image forming apparatus of the present invention, components such image bearing member mentioned above, developing device and cleaning device are integrated to form a process cartridge, and this unit may be detachably attached to the apparatus body. Also, at least any one of the charging device, the image exposing device, the developing device, the transferring or separating device and the cleaning device is supported with the photoconductor to form the process cartridge as a single unit which can be detachably attached to the apparatus body, and the unit may have a detachable configuration by a guiding means such as rail on the apparatus body.

Examples of the present invention are illustrated below, but these are not to be construed as limiting the present invention. In the following Examples, all parts are by mass unless otherwise specified.

Example 1

Preparation of Image Bearing Member 1

On an aluminum cylinder having a diameter of 100 mm, an undercoat layer coating solution having the following composition was applied by a dip-coating method and dried to form an undercoat layer having a thickness of 3.5 μm.

<Composition of Undercoat Layer Coating Solution>

| | |
|---|---|
| Alkyd resin (BECKOSOL 1307-60-EL manufactured by Dainippon Ink and Chemicals, Incorporated) | 6 parts |
| Melamine resin (SUPER BECKAMINE G-821-60 manufactured by Dainippon Ink and Chemicals, Incorporated) | 4 parts |
| Titanium oxide | 40 parts |
| Methyl ethyl ketone | 50 parts |

Next, to the undercoat layer, a charge generating layer coating solution having the following composition was applied by dipping and dried to form a charge generating layer having a thickness of 0.2 μm.

<Composition of Charge Generating Layer Coating Solution>

| | |
|---|---|
| Y-form titanyl phthalocyanine | 6 parts |
| Silicone resin solution (KR5240, 15% by mass of xylene-butanol liquid, manufactured by Shinetsu Chemical Industry, Inc.) | 70 parts |
| 2-butanone | 200 parts |

Next, to the charge generating layer, a charge transport layer coating solution having the following composition was applied by dipping and dried to form a charge transport layer having a thickness of 22 μm.

<Composition of Charge Transport Layer Coating Solution>

| | |
|---|---|
| charge transport material (the following Structural Formula (A)) | 25 parts |
| Bisphenol Z polycarbonate resin (Yupilon Z300, manufactured by Mitsubishi Gas Chemical Inc.) | 30 parts |
| Dichloromethane | 300 parts |

Structural Formula (A)

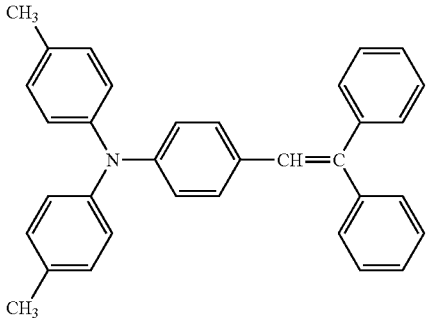

Next, a crosslinked charge transport layer coating solution having the following composition was applied by spraying on the charge transport layer, subjected to natural drying for 20 minutes, and then was cured by light irradiation under the conditions of metal halide lamp: 160 W/cm, irradiation distance: 120 mm, irradiation intensity: 500 mW/cm$^2$, irradiation time: 60 seconds. Further, the cured film was dried at 130° C. for 20 minutes to form a crosslinked charge transport layer having a thickness of 5.2 μm. Thus, a photoconductor was prepared.

<Composition of Crosslinked Charge Transport Layer Coating Solution>

| | |
|---|---|
| Radically polymerizable monomer with three or more functional groups that does not have a charge transporting structure (Trimethylolpropane triacrylate of the following formula, KAYARAD TMPTA, manufactured by Nippon Kayaku Co., Ltd., Molecular mass: 296, Number of functional group: 3, Molecular mass/ Number of functional group = 99) | 10 parts |

-continued

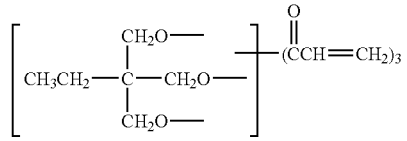

| | |
|---|---|
| Radically polymerizable compound with one functional group that has a charge transporting structure (Compound No. 54) | 10 parts |
| 1-hydorxy-cyclohexyl-phenyl-ketone as a photopolymerization initiator (IRGACURE 184, manufactured by Ciba Specialty Chemicals) | 1 part |
| Tetrahydrofuran | 100 parts |

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 1 was prepared.

Example 2

Preparation of Image Bearing Member 2

A photoconductor was prepared in the same way as in Example 1, except that, in Example 1, the thickness of the crosslinked charge transport layer was changed to 1.3 μm.

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 2 was prepared.

Example 3

Preparation of Image Bearing Member 3

A photoconductor was prepared in the same way as in Example 1, except that, in Example 1, the thickness of the crosslinked charge transport layer was changed to 7.7 μm.

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 3 was prepared.

Example 4

Preparation of Image Bearing Member 4

A photoconductor was prepared in the same way as in Example 1, except that, the composition of the coating solution for a crosslinked charge transport layer in Example 1 was changed to the following composition, and the thickness of the crosslinked charge transport layer was changed to 5.4 μm.

<Composition of Crosslinked Charge Transport Layer Coating Solution>

| | |
|---|---|
| Radically polymerizable monomer with three or more functional groups that does not have a charge transporting structure | 10 parts |

-continued

| | |
|---|---|
| (Pentaerythritol tetraacrylate, SR-295, manufactured by Kayaku Sartomer Co., Ltd., Molecular mass: 352, Number of functional group: 4, Molecular mass/Number of functional group = 88) | |
| Radically polymerizable compound with one functional group that has a charge transporting structure (Compound No. 138) | 10 parts |
| 1-hydorxy-cyclohexyl-phenyl-ketone as a photopolymerization initiator (IRGACURE 184, manufactured by Ciba Specialty Chemicals) | 1 part |
| Tetrahydrofuran | 100 parts |

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 4 was prepared.

Example 5

Preparation of Image Bearing Member 5

A photoconductor was prepared in the same way as in Example 4, except that, in Example 4, the thickness of the crosslinked charge transport layer was changed to 1.4 μm.

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 5 was prepared.

Example 6

Preparation of Image Bearing Member 6

A photoconductor was prepared in the same way as in Example 4, except that, in Example 4, the thickness of the crosslinked charge transport layer was changed to 7.7 μm.

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 6 was prepared.

Example 7

Preparation of Image Bearing Member 7

A photoconductor was prepared in the same way as in Example 1, except that, the composition of the coating solution for a crosslinked charge transport layer in Example 1 was changed to the following composition, and the thickness of the crosslinked charge transport layer was changed to 5.0 μm.

<Composition of Crosslinked Charge Transport Layer Coating Solution>

| | |
|---|---|
| Radically polymerizable monomer with three or more functional groups that does not have a charge transporting structure (Dipentaerythritol caprolactone-modified hexaacrylate of the following formula, KAYARAD DPCA-60, manufactured by Nippon Kayaku Co., Ltd., Molecular mass: 1263, Number of functional group: 6, Molecular mass/ Number of functional group = 211) | 10 parts |

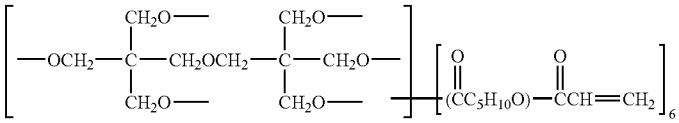

| | |
|---|---|
| Radically polymerizable compound with one functional group that has a charge transporting structure (Compound No. 54) | 10 parts |
| 2,2-dimethoxy-1,2-diphenylethane-1-one as a photopolymerization initiator (IRGACURE 651, manufactured by Ciba Specialty Chemicals) | 1 part |
| Tetrahydrofuran | 100 parts |

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 7 was prepared.

Example 8

Preparation of Image Bearing Member 8

A photoconductor was prepared in the same way as in Example 7, except that, in Example 7, the thickness of the crosslinked charge transport layer was changed to 9.6 μm.

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 8 was prepared.

Example 9

Preparation of Image Bearing Member 9

A photoconductor was prepared in the same way as in Example 7, except that, in Example 7, the thickness of the crosslinked charge transport layer was changed to 1.6 μm.

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 9 was prepared.

Example 10

Preparation of Image Bearing Member 10

A photoconductor was prepared in the same way as in Example 7, except that, in Example 7, the thickness of the crosslinked charge transport layer was changed to 2.6 μm.

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 10 was prepared.

Example 11

Preparation of Image Bearing Member 11

A photoconductor was prepared in the same way as in Example 7, except that, in Example 7, the thickness of the crosslinked charge transport layer was changed to 7.8 μm.

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 11 was prepared.

Example 12

Preparation of Image Bearing Member 12

A photoconductor was prepared in the same way as in Example 1, except that, the composition of the coating solution for a crosslinked charge transport layer in Example 1 was changed to the following composition, and the thickness of the crosslinked charge transport layer was changed to 5.0 μm.

<Composition of Crosslinked Charge Transport Layer Coating Solution>

| | |
|---|---|
| Radically polymerizable monomer with three or more functional groups that does not have a charge transporting structure<br>Dipentaerythrithol hexaacrylate of the following formula (1:1 (mass ratio) mixture of hexaacrylate and pentaacrylate); KAYARAD, DPHA, manufactured by Nippon Kayaku Co., Ltd., Average Molecular mass: 536, Number of functional group: 5.5, Molecular mass/ Number of functional group = 97) | 10 parts |

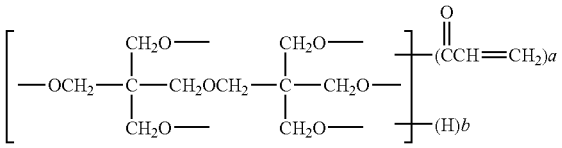

(1:1 (mass ratio) mixture of a compound of a = 5, b = 1 and a compound of a = 6, b = 0)

| | |
|---|---|
| Radically polymerizable compound with one functional group that has a charge transporting structure (Compound No. 54) | 10 parts |
| 2,2-dimethoxy-1,2-diphenylethane-1-one as a photopolymerization initiator (IRGACURE 651, manufactured by Ciba Specialty Chemicals) | 1 part |
| Tetrahydrofuran | 100 parts |

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 12 was prepared.

Example 13

Preparation of Image Bearing Member 13

A photoconductor was prepared in the same way as in Example 1, except that, the composition of the coating solution for a crosslinked charge transport layer in Example 1 was changed to the following composition, and the thickness of the crosslinked charge transport layer was changed to 5.0 μm.

<Composition of Crosslinked Charge Transport Layer Coating Solution>

| | |
|---|---|
| Radically polymerizable monomer with three or more functional groups that does not have a charge transporting structure (Mixture of two monomers in which the following (1) and (2) were used at a mass ratio of 1:1<br>(1) Caprolactone-modified dipentaerythritol hexaacrylate of the following formula, KAYARAD DPCA-120, manufactured by Nippon Kayaku Co., Ltd., Molecular mass: 1947, Number of functional group: 6, Molecular mass/ Number of functional group = 325) | 10 parts |

-continued

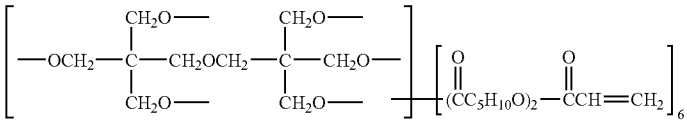

(2) Trimethylolpropane triacrylate of the following formula (TMPTA, manufactured by Tokyo Chemical Industry Co., Ltd., Molecular mass: 296, Number of functional group: 3, Molecular mass/ Number of functional group = 99)

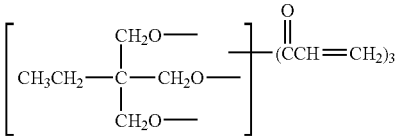

| | |
|---|---|
| Radically polymerizable compound with one functional group that has a charge transporting structure (Compound No. 54) | 10 parts |
| 2,2-dimethoxy-1,2-diphenylethane-1-one as a photopolymerization initiator (IRGACURE 651, manufactured by Ciba Specialty Chemicals) | 1 part |
| Tetrahydrofuran | 100 parts |

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 13 was prepared.

Example 14

Preparation of Image Bearing Member 14

A photoconductor was prepared in the same way as in Example 1, except that, the composition of the coating solution for a crosslinked charge transport layer in Example 1 was changed to the following composition, and the thickness of the crosslinked charge transport layer was changed to 5.0 μm.

<Composition of Crosslinked Charge Transport Layer Coating Solution>

| | |
|---|---|
| Radically polymerizable monomer with three or more functional groups that does not have a charge transporting structure (Mixture of two monomers in which the following (1) and (2) were used at a mass ratio of 1:1<br>(1) Dipentaerythrithol hexaacrylate of the following formula (1:1 (mass ratio) mixture of hexaacrylate and pentaacrylate); KAYARAD, DPHA, manufactured by Nippon Kayaku Co., Ltd., Average Molecular mass: 536, Number of functional group: 5.5, Molecular mass/ Number of functional group = 97) | 10 parts |

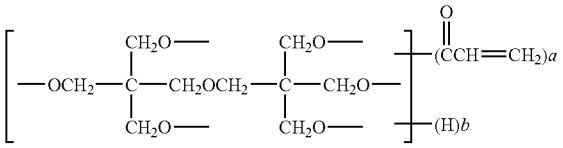

(1:1 (mass ratio) mixture of a compound of a = 5, b = 1 and a compound of a = 6, b = 0)
(2) Trimethylolpropane triacrylate of the following formula (TMPTA, manufactured by Tokyo Chemical Industry Co., Ltd., Molecular mass: 296, Number of functional group: 3, Molecular mass/ Number of functional group = 99)

-continued

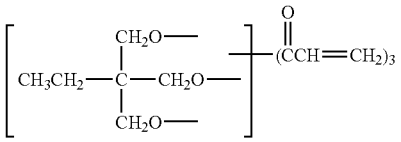

| | |
|---|---|
| Radically polymerizable compound with one functional group that has a charge transporting structure (Compound No. 54) | 10 parts |
| 2,2-dimethoxy-1,2-diphenylethane-1-one as a photopolymerization initiator (IRGACURE 651, manufactured by Ciba Specialty Chemicals) | 1 part |
| Tetrahydrofuran | 100 parts |

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 14 was prepared.

Example 15

Preparation of Image Bearing Member 15

A photoconductor was prepared in the same way as in Example 14, except that, in Example 14, the thickness of the crosslinked charge transport layer was changed to 9.6 μm.

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 15 was prepared.

Example 16

Preparation of Image Bearing Member 16

A photoconductor was prepared in the same way as in Example 14, except that, in Example 14, the thickness of the crosslinked charge transport layer was changed to 1.5 μm.

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 16 was prepared.

Example 17

Preparation of Image Bearing Member 17

A photoconductor was prepared in the same way as in Example 14, except that, in Example 14, the thickness of the crosslinked charge transport layer was changed to 2.5 μm.

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 17 was prepared.

Example 18

Preparation of Image Bearing Member 18

A photoconductor was prepared in the same way as in Example 14, except that, in Example 14, the thickness of the crosslinked charge transport layer was changed to 7.8 μm.

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 18 was prepared.

Comparative Example 1

Preparation of Image Bearing Member 19

A photoconductor was prepared in the same way as in Example 1, except that, the crosslinked charge transport layer in Example 1 was not formed, and the thickness of the charge transport layer was changed to 27 μm.

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 19 was prepared.

Comparative Example 2

Preparation of Image Bearing Member 20

Layers up to a charge transport layer were formed in the same way as in Example 1. A solution for applying an adhesion layer having the following composition was applied on this charge transport layer and was subjected to a heat treatment at 100° C. for 30 minutes to form an adhesion layer having a thickness of 0.3 μm.

<Composition of Adhesion Layer Coating Solution>

| | |
|---|---|
| Silyl acrylate (PC-7A, manufactured by Shinetsu Chemical Industry, Inc.) | 6 parts |
| 2-butanone | 200 parts |

Next, a protective layer coating solution having the following composition was applied on the adhesion layer and cured by heating at 120° C. for 1 hour to form a protective layer having a dried thickness of 1 μm. Thus, a photoconductor was formed.

<Composition of Protective Layer Coating Solution>

To a methanol solution of polysiloxane consisting of 80% by mole of methylsiloxane unit and 20% by mole of methylphenylsiloxane unit, was added molecular sieve 4A, was allowed to stand for 15 hours, followed by a dehydration treatment. 10 parts of this solution was dissolved in 10 parts of toluene, and to the mixture, were added 1 part of methyltrimethoxysilane and 0.2 part of dibutyltin acetate to form a uniform protective layer coating solution.

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 20 was prepared.

Comparative Example 3

Preparation of Image Bearing Member 21

A photoconductor was prepared in the same way as in Comparative Example 2, except that, 0.5 part of colloidal silica was added to the protective layer coating solution in Comparative Example 2.

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 21 was prepared.

Comparative Example 4

Preparation of Image Bearing Member 22

Layers up to an adhesion layer were formed in the same way as in Comparative Example 2. 60 parts of commercially available organosilicon compound (KP-85, manufactured by Shinetsu Chemical Industry, Inc.) and 60 parts of 2-propanol were added and dissolved uniformly to prepare a surface protective layer coating solution. This surface protective layer coating solution was applied on the adhesion layer so as to have a dried thickness of 1 μm and dried at 110° C. for 1 hour to form a surface protective layer. Thus, a photoconductor was prepared.

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 22 was prepared.

Comparative Example 5

Preparation of Image Bearing Member 23

Layers up to an adhesion layer were formed in the same way as in Comparative Example 2. 60 parts of commercially available organosilicon compound (X-40-2269, manufactured by Shinetsu Chemical Industry, Inc.) and 60 parts of 2-propanol were added and dissolved uniformly. Then, this solution was applied on the adhesion layer so as to form a protective layer having a dried thickness of 1 μm and dried at 110° C. for 1 hour to prepare a photoconductor.

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 23 was prepared.

Comparative Example 6

Preparation of Image Bearing Member 24

Layers up to a charge transport layer were formed in the same way as in Example 1. 30 parts of commercially available organosilicon compound (X-40-2269, manufactured by Shinetsu Chemical Industry, Inc.) and 60 parts of 2-propanol were added and dissolved uniformly, and to this solution, was mixed 6 parts of dihydroxy methyl triphenylamine to prepare a uniform solution. This solution was applied on the charge transport layer so as to form a protective layer having a dried thickness of 1 μm, dried at 100° C. for 1 hour to prepare a photoconductor.

A sheet heating element, in which a nichrome wire heating element was sandwiched by polyethylene terephthalate resin, was inserted into the inside of the support of the resulting photoconductor, making it possible to heat the photoconductor from the inside thereof. Thus, an image bearing member 24 was prepared.

<Image Evaluation>

Each of the obtained image bearing members Nos. 1 to 24 in Examples 1 to 18 and Comparative Examples 1 to 6 was mounted on an image forming apparatus (imagio MF7070 manufactured by Ricoh Company, Limited), and light exposure was made appropriate. Then, the initial charge potential was set to −850 V, and evaluation of formed images was performed by copying 50,000 sheets under the environment of high temperature and high humidity (30° C. and 90% RH) while maintaining the surface temperature of each image bearing member at 40° C. Samples were taken of initial image and image after copying 50,000 sheets and evaluated according to the following standards. Further, the image after left for 12 hours was evaluated in the same way. The results are shown in Table 3.

[Evaluation Standards]

A: Nothing peculiar

B: Slight decrease of resolution, but practically acceptable

C: Partial decrease of resolution and not preferable from a practical standpoint D: Generation of image deletion and practical application is impossible <Evaluation of Abrasion Resistance>

The thickness of each image bearing members was measured before and after copying 80,000 sheets with an eddy-current thickness measuring instrument (manufactured by Fischer Instruments K.K.), and abrasion loss (μm) was determined from the difference of thickness between before and after the copying.

TABLE 3

| | Image bearing member No. | Abrasion loss (mm) | Initial image | Image after copying 50,000 sheets | Image after left for 12 hours |
|---|---|---|---|---|---|
| Example 1 | 1 | 0.29 | A | A | A |
| Example 2 | 2 | 0.33 | A | A | A |
| Example 3 | 3 | 0.29 | A | A | A |
| Example 4 | 4 | 0.29 | A | A | A |
| Example 5 | 5 | 0.33 | A | A | A |
| Example 6 | 6 | 0.29 | A | A | A |
| Example 7 | 7 | 0.38 | A | A | A |
| Example 8 | 8 | 0.38 | A | A | A |
| Example 9 | 9 | 0.45 | A | A | B |
| Example 10 | 10 | 0.39 | A | A | A |
| Example 11 | 11 | 0.38 | A | A | A |
| Example 12 | 12 | 0.27 | A | A | A |
| Example 13 | 13 | 0.25 | A | A | A |
| Example 14 | 14 | 0.23 | A | A | A |
| Example 15 | 15 | 0.23 | A | A | A |
| Example 16 | 16 | 0.26 | A | A | A |
| Example 17 | 17 | 0.23 | A | A | A |
| Example 18 | 18 | 0.23 | A | A | A |
| Comp. Example 1 | 19 | 2.00 | B | C | C |
| Comp. Example 2 | 20 | 0.83 | B | C | D |
| Comp. Example 3 | 21 | 0.60 | B | C | D |
| Comp. Example 4 | 22 | 0.60 | B | C | D |
| Comp. Example 5 | 23 | 0.65 | A | B | D |
| Comp. Example 6 | 24 | 0.65 | A | B | C |

The results of Table 3 indicate that control of the surface temperature of the image bearing members of Examples 1 to 18 in an appropriate temperature range by heating the image bearing member improves the abrasion resistance of the uppermost crosslinked charge transport layer of the image bearing member. Thus, in Examples 1 to 18, high-quality image can be obtained.

In contrast, in Comparative Examples 1 to 6, the image bearing member that did not comprise a crosslinked charge transport layer was used, and thus heating effect by a heating unit was not obtained. Images obtained especially under the environment of high temperature and high humidity are poor.

The image forming method, image forming apparatus, and process cartridge using the image bearing member of the present invention are widely used for e.g. a full-color photocopier, a full-color laser printer, and a full-color plain paper fax using a direct or indirect electrophotographic multi-color image developing method.

What is claimed is:

1. An image bearing member comprising:

a photoconductor; and a heating unit which heats the photoconductor, wherein the photoconductor comprises: a support; a charge generating layer on the support, a charge transport layer, and a crosslinked charge transport layer in this order, wherein the crosslinked charge transport layer comprises a reaction product of a radically polymerizable compound with three or more functional groups which does not have a charge transporting structure, and a radically polymerizable compound with one functional group, which compound has a charge transporting structure;

wherein the radically polymerizable compound with three or more functional groups which does not have a charge transporting structure comprises plural radically polymerizable compounds which have a different structure, wherein at least one of the plural radically polymerizable compounds is a compound represented by the following General Formula (A):

General Formula (A)

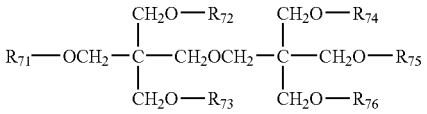

where, in the General Formula (A), $R_{71}$, $R_{72}$, $R_{73}$, $R_{74}$, $R_{75}$ and $R_{76}$ each represent one of a hydrogen atom and a group represented by the following structural formula; four or more of $R_{71}$ to $R_{76}$ are not hydrogen atoms at the same time:

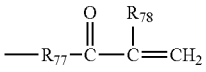

where $R_{77}$ represents any one of a single bond, an alkylene group, an alkylene ether group, a polyoxyalkylene group, an alkylene ether group substituted with a hydroxy group, an alkylene ether group substituted with a (meth)acryloyloxy group, an oxyalkylene carbonyl group, and a poly(oxyalkylene carbonyl) group; and $R_{78}$ represents one of a hydrogen atom and a methyl group.

2. The image bearing member according to claim 1, wherein the heating unit is housed in the photoconductor, and the photoconductor is heated by the heating unit from the inside thereof.

3. The image bearing member according to claim 1, wherein the crosslinked charge transport layer has a thickness of 1 μm to 10 μm.

4. The image bearing member according to claim 3, wherein the crosslinked charge transport layer has a thickness of 2 μm to 8 μm.

5. The image bearing member according to claim 1, wherein a radically polymerizable functional group of the radically polymerizable compound with three or more functional groups and the radically polymerizable compound with one functional group is at least one of an acryloyloxy group and a methacryloyloxy group.

6. The image bearing member according to claim 1 wherein the General Formula (A) is a represented by one of the following structural formulae (B) to (K):

Structural formula (B)

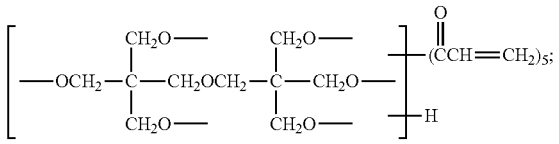

Structural formula (C)

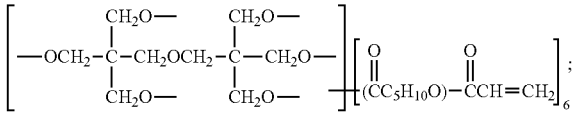

Structural formula (D)

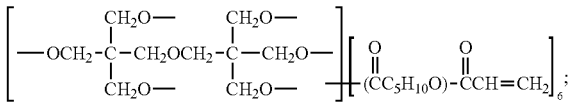

Structural formula (E)

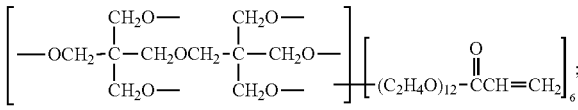

Structural formula (F)

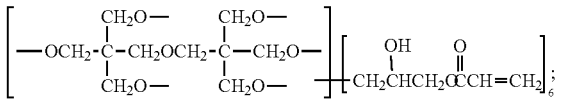

Structural formula (G)

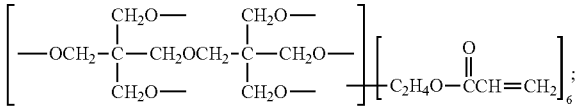

Structural formula (H)

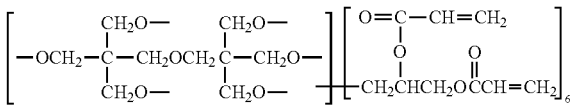

-continued

Structural formula (I)

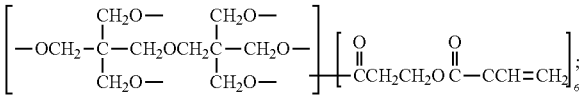

Structural formula (J)

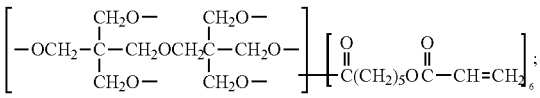

Structural formula (K)

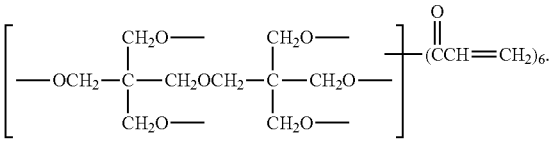

7. The image bearing member according to claim 1 wherein the radically polymerizable compound with one functional group which compound has a charge transporting structure is a compound represented by one of the following structural formulae (4) and (5):

General Formula (4)

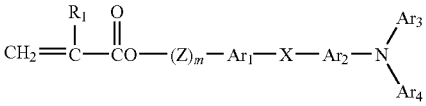

General Formula (5)

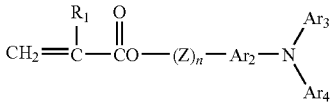

where $R_1$ represents a hydrogen atom, a halogen atom, an alkyl group that may have a substituent, an aralkyl group that may have a substituent, an aryl group that may have a substituent, a cyano group, a nitro group, an alkoxy group, —$COOR_7$ (wherein $R_7$ represents a hydrogen atom, an alkyl group that may have a substituent, an aralkyl group that may have a substituent or an aryl group that may have a substituent), a halogenated carbonyl group or $CONR_8R_9$ (wherein $R_8$ and $R_9$ represent a hydrogen atom, a halogen atom, an alkyl group that may have a substituent, an aralkyl group that may have a substituent or an aryl group that may have a substituent, and may be the same as or different from each other); $Ar_1$ and $Ar_2$ represent a substituted or unsubstituted arylene group and may be the same or different; $Ar_3$ and $Ar_4$ represent a substituted or unsubstituted aryl group and may be the same or different; X represents a single bond, a substituted or unsubstituted alkylene group, a substituted or unsubstituted cycloalkylene group, a substituted or unsubstituted alkylene ether group, an oxygen atom, a sulfur atom or a vinylene group; Z represents a substituted or unsubstituted alkylene group, a substituted or unsubstituted divalent alkylene ether group or a divalent alkyleneoxycarbonyl group; and m and n represent an integer of 0 to 3.

8. A process cartridge comprising an image bearing member and at least any one unit selected from: a latent electrostatic image forming unit which forms a latent electrostatic image on the image bearing member, a developing unit which forms a visible image by developing the latent electrostatic image with a toner, a transferring unit which transfers the visible image to a recording medium, and a cleaning unit which removes a residual toner on the image bearing member, wherein the image bearing member comprises: a photoconductor; and a heating unit which heats the photoconductor, wherein the photoconductor comprises: a support; a charge generating layer on the support, a charge transport layer, and a crosslinked charge transport layer in this order, wherein the crosslinked charge transport layer comprises a reaction product of a radically polymerizable compound with three or more functional groups which does not have a charge transporting structure, and a radically polymerizable compound with one functional group, which compound has a charge transporting structure, wherein an image is formed using the image bearing member in a heated state;

wherein the radically polymerizable compound with three or more functional groups which does not have a charge transporting structure comprises plural radically polymerizable compounds which have a different structure, wherein at least one of the plural radically polymerizable compounds is a compound represented by the following General Formula (A):

General Formula (A)

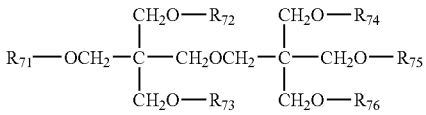

where, in the General Formula (A), $R_{71}$, $R_{72}$, $R_{73}$, $R_{74}$, $R_{75}$ and $R_{76}$ each represent one of a hydrogen atom and a group represented by the following structural formula; four or more of $R_{71}$ to $R_{76}$ are not hydrogen atoms at the same time:

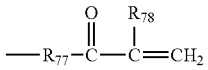

where $R_{77}$ represents any one of a single bond, an alkylene group, an alkylene ether group, a polyoxyalkylene group, an alkylene ether group substituted with a hydroxy group, an alkylene ether group substituted with a (meth)acryloyloxy group, an oxyalkylene carbonyl group, and a poly(oxyalkylene carbonyl) group; and $R_{78}$ represents one of a hydrogen atom and a methyl group.

* * * * *